US005357879A

United States Patent [19]

Shiono et al.

[11] Patent Number: 5,357,879

[45] Date of Patent: Oct. 25, 1994

[54] DRIED SLUDGE MELTING FURNACE

[75] Inventors: Shunichi Shiono; Kazuyuki Suzuki, both of Tokyo, Japan

[73] Assignee: Ebara-Infilco Co., Ltd., Tokyo, Japan

[21] Appl. No.: 63,307

[22] Filed: May 19, 1993

[30] Foreign Application Priority Data

May 20, 1992 [JP] Japan ..... 4-152783
May 20, 1992 [JP] Japan ..... 4-152786
Dec. 18, 1992 [JP] Japan ..... 4-355687

[51] Int. Cl.[5] ..... F23N 5/18

[52] U.S. Cl. ..... 110/188; 110/190; 110/251; 395/61

[58] Field of Search ..... 110/188, 190, 251; 236/15 E; 395/61, 900

[56] References Cited

U.S. PATENT DOCUMENTS 4,861,262 8/1989 Gitman et al. ..... 110/188 X
4,910,684 3/1990 Ostergaard et al. ..... 395/61 X
5,261,337 11/1993 Orita et al. ..... 110/188 X

FOREIGN PATENT DOCUMENTS 0436759 7/1991 European Pat. Off. .
2-33511 2/1990 Japan .
3-28617 2/1991 Japan .
3-28618 2/1991 Japan .
3-36412 2/1991 Japan .
3-36413 2/1991 Japan .
3160213 7/1991 Japan .
3194314 8/1991 Japan .
4-115307 4/1992 Japan .
4119814 4/1992 Japan .

OTHER PUBLICATIONS

Shiono, S. et al. "Fuzzy Control of a Sewage Sludge Melting Furnace", 2nd WEF Asia/Pacific RIM Conference on Water Pollution Control, Jun. 25-27, 1992, pp. 551-558, Yokohama, Japan.

Nakamori, Y. et al., "A New Design of a Fuzzy Model Predictive Control System for Nonlinear Porcesses", pp. 738-835, Proceedings of the International Fuzzy Engineering Symposium '91, Nov. 13-15, 1991, Yokohama, Japan.

Nakamori, Y., "Model Predictive Control of Nonlinear Processes by Multi-Model Approach", Proceedings of the 1991 International Conference on Industrial Electronics, Control and Instrumentation, pp. 1902-1907, Oct. 28-Nov. 1, 1991, Kobe, Japan, vol. 3 of 3.

Nakamori, Y. et al., "Model Predictive Control Using Fuzzy Dynamic Models", Computer, Management & Systems Science, IFSA '91 Brussels, Jul. 1991, pp. 135-138.

(List continued on next page.)

*Primary Examiner*—William E. Wayner
*Attorney, Agent, or Firm*—Longacre & White

[57] ABSTRACT

In a dried sludge melting furnace apparatus, at least one of following two controls is executed. In one of the controls, the primary combustion chamber (PCC) upper combustion air supply amount and the PCC lower combustion air supply amount are adjusted so as to respectively become a target PCC upper combustion air supply amount and a target PCC lower combustion air supply amount which are obtained from an inferred PCC upper combustion air supply amount and an inferred PCC lower combustion air supply amount. The inferred PCC upper and lower combustion air supply amounts are obtained by a fuzzy inference device (221). In the other control, the total combustion air supply amount and the second combustion chamber (SCC) burner fuel supply amount are adjusted so as to respectively become a target combustion air supply amount and a target SCC burner fuel supply amount which are obtained from an inferred combustion air supply amount and an inferred SCC burner fuel supply amount. The inferred combustion air supply amount and the inferred SCC burner fuel supply amount are obtained by a fuzzy inference device (222).

6 Claims, 33 Drawing Sheets

OTHER PUBLICATIONS

Tanaka, K. et al., "A New Tuning Method of Fuzzy Controllers", Dept. of Mechanical Systems Engineering, Kanazawa University, pp. 207–210.

Suzuki, K. et al., "Model Predictive Control Based on Fuzzy Dynamics Models", 4th International Symposium on Process Systems Engineering, Aug. 5–9, 1991, Montello, Quebec, Canada, pp. II.18.1–II.18.15.

Brochure entitled "For converting the sewage sludge into resources–Sludge Management System", Ebara–Infilco Co., Ltd., Sep. 1991.

Naka Y. & Yokoo M., "Development of Noble Sludge Melting Process", Proceedings from The Future Direction of Municipal Sludge (Biosolids) Management: Where We Are and Where We're Going, Specialty Conference Series, Portland, Oreg., Jul. 26–30, 1992, pp. 745–759.

Shimizu, H. et al., "Application of Fuzzy Control to a Yeast Fed–Batch Culture", Proceedings of the Int'l Fuzzy Eng'g Symposium '91, Nov. 13–15, 1991, Yokohama, Japan, pp. 824–835.

Suzuki, K. et al., "Fuzzy Multi–model Control of a High–purity Distillation System", Proceedings of the Int'l Fuzzy Engineering Symposium '91, Nov. 13–15, 1991, Yokohama, Japan pp. 684–693.

Proceeding IECON '91–International Conf. on Industrial Electronics, Control and Instrumentation, vol. 2, Oct. 28, 1991, Kobe, Japan, Toshio Miyayama et al. "A combustion control support expert system for a coil–fired boiler", pp. 1513–1516.

Fuzzy Sets and Systems, vol. 36, No. 1, May 30, 1990, Amsterdam NL, Wu Zhi–Qiao, "The application of fuzzy control theory to an oil–fueld annealing furnace", pp. 145–156.

Proceedings of the 1989 American Control Conference, vol. 3, Jun. 21, 1989, Pittsburg, Pa., S. J. Hoffman et al., "Fuzzy logic control of a fluidized bed combustor", pp. 2756–2758.

200
220
FUZZY CONTROLLER

230
SEQUENCE CONTROLLER
240
PID CONTROL-LER

210
TEMPERATURE CORRECTING DEVICE
260
DISPLAY DEVICE
250
MANUAL CONTROLLER
AIR1H'
AIR1L'
AIRTL'
F2'
AIR1H°
AIR1L°
AIRTL°
F2°
AIR1HC
AIR1LC
AIRTLC
F2C
112B
113B
121F
122C
AIRTL*
F2*
AIR1L*
AIR1H*
121E
122B
113A
112A
T1H**
T3**
CONNOX*
T1L*
CONO2*
T1H*
T3*
D*
F1*
131
116
132
115
133
111D
114C
FNc
IG1
IG2
Fic
Dc
111C
114
122
114D
111E 200
240
PID CONTROL-LER

230
SEQUENCE CONTROLLER
220
FUZZY CONTROLLER

210
TEMPERATURE CORRECTING DEVICE
260
DISPLAY DEVICE
250
MANUAL CONTROLLER
AIR1HC
112B
AIR1LC
113B
AIRTLC
121F
F2C
122C
AIRTL*
121E
F2*
122B
AIR1L*
113A
AIR1H*
112A
AIR1H°
AIR1L°
AIRTL^M
F2^M
AIR1H^f
AIR1L^f
T1H**
CONNOX*
131
T1L*
116
CONO2*
132
T1H*
115
T3*
133
D*
111D
F1*
114C
FNc
111C
IG1
114
IG2
122
F1c
114D
Dc
111E 200
240
PID CONTROL-LER

230
SEQUENCE CONTROLLER
220
FUZZY CONTROLLER

210
TEMPERATURE CORRECTING DEVICE
260
DISPLAY DEVICE
250
MANUAL CONTROLLER
AIR1HC
112B
AIR1LC
113B
AIRTLC
121F
F2C
122C
AIRTL*
121E
F2*
122B
AIR1L*
113A
AIR1H*
112A
AIR1H^M
AIR1L^M
AIRTL^o
F2^o
AIRTL^f
F2^f
T3^xx
CONNOX*
131
T1L*
116
CONO2*
132
T1H*
115
T3*
133
D*
111D
F1*
114C
FNc
111C
IG1
114
IG2
122
F1c
114D
Dc
111E

DRIED SLUDGE MELTING FURNACE

BACKGROUND OF THE INVENTION

This invention relates to a dried sludge melting furnace apparatus in which dried sludge and combustion air are supplied to a primary combustion chamber, and the dried sludge is converted into slag in the primary combustion chamber and a secondary combustion chamber and then separated from the combustion gas in a slag separation chamber.

Conventionally, a dried sludge melting furnace apparatus of this kind and having the following structure is proposed. In such an apparatus, at least one temperature detector disposed at an appropriate position of a primary combustion chamber (PCC) detects the temperature of the PCC (referred to as "detected PCC temperature"), a temperature detector disposed at a lower portion of a slag separation chamber detects the temperature of slag (referred to as "detected slag temperature"), and a nitrogen oxide (NOX) concentration detector and oxygen concentration detector disposed at an upper portion of the slag separation chamber detect the NOX concentration (referred to as "combustion gas NOX concentration") and oxygen concentration (referred to as "combustion gas oxygen concentration") of combustion gas, respectively. While monitoring these detected values, the operator manually operates based on experience control valves, a control valve disposed in a dried sludge supply pipe which opens in the top of the PCC, control valves disposed in combustion air supply pipes which respectively open in the upper and lower portions of the PCC, a control valve disposed in a fuel supply pipe which is communicated with a burner disposed at the top of the PCC, a control valve disposed in a combustion air supply pipe which opens in a secondary combustion chamber (SCC), and a control valve disposed in a fuel supply pipe which is communicated with a burner disposed in the SCC, thereby adjusting the amount of dried sludge (referred to as "dried sludge supply amount") and amount of combustion air (referred to as "PCC combustion air supply amount") supplied to the PCC, the amount of fuel (referred to as "PCC burner fuel amount") supplied to the burner disposed in the PCC, the amount of combustion air (referred to as "SCC combustion air supply amount") supplied to the SCC, the amount of fuel (referred to as "SCC burner fuel amount") supplied to the burner disposed in the SCC.

In such a conventional dried sludge melting furnace apparatus, while monitoring the detected PCC temperature, the detected slag temperature, the detected combustion gas NOX concentration and the detected combustion gas oxygen concentration, the operator must adjust, in accordance with the change of these values and based on experience, the dried sludge supply amount, the PCC combustion air supply amount, the PCC burner fuel amount, the SCC combustion air supply amount and the SCC burner fuel amount. Therefore, the conventional dried sludge melting furnace apparatus has the following disadvantages: (i) the operator must always be stationed in a control room; (ii) the operation accuracy and efficiency change depending on the skill or experience of the operator; (iii) it is impossible to lengthen the lifetime or service life of the furnace casing; and (iv) the dried sludge supply amount, the PCC combustion air supply amount, the SCC combustion air supply amount, the PCC burner fuel amount and the SCC burner fuel amount are susceptible to frequent changes.

SUMMARY OF THE INVENTION

In order to eliminate these disadvantages, the invention provides a dried sludge melting furnace apparatus in which at least one of the following two controls is executed. In one of the controls, the PCC upper combustion air supply amount and the PCC lower combustion air supply amount are adjusted so as to respectively become a desired PCC upper combustion air supply amount and a desired PCC lower combustion air supply amount which are respectively obtained from an inferred PCC upper combustion air supply amount and an inferred PCC lower combustion air supply amount that are obtained by executing fuzzy inference on the basis of first fuzzy rules held among fuzzy sets each relating to the PCC upper portion temperature, the PCC lower portion temperature, the combustion gas NOX concentration, the combustion gas oxygen concentration, the PCC upper combustion air supply amount and the PCC lower combustion air supply amount. In the other control, the total combustion air supply amount and SCC burner fuel supply amount are adjusted so as to respectively become a desired total combustion air supply amount and a desired SCC burner fuel supply amount which are respectively obtained from an inferred total combustion air supply amount and an inferred SCC burner fuel supply amount that are obtained by executing fuzzy inference on the basis of second fuzzy rules held among fuzzy sets each relating to the combustion gas oxygen concentration, the slag temperature, the total combustion air supply amount and the SCC burner fuel supply amount.

The first means for solving the problems according to the invention is

"a dried sludge melting furnace apparatus in which dried sludge and combustion air are supplied to a primary combustion chamber (PCC), and the dried sludge is converted into slag in the PCC and a secondary combustion chamber (SCC) and then separated from the combustion gas in a slag separation chamber, wherein the apparatus comprises:

(a) a first temperature detector (115) for detecting a temperature $T_{1H}$ of the upper portion of the PCC, and for outputting the detected temperature as a detected PCC upper portion temperature $T_{1H}$*;

(b) a second temperature detector (116) for detecting a temperature $T_{1L}$ of the lower portion of the PCC, and for outputting the detected temperature as a detected PCC lower portion temperature $T_{1L}$*;

(c) a third temperature detector (133) for detecting a temperature $T_3$ of slag guided from the SCC, and for outputting the detected temperature as a detected slag temperature $T_3$*;

(d) a nitrogen oxide (NOX) concentration detector (131) for detecting an NOX concentration $CON_{NOX}$ of the combustion gas, the combustion gas being guided together with slag from the SCC and then separated from the slag, and for outputting the detected value as a detected combustion gas NOX concentration $CON_{NOX}$*;

e) an oxygen concentration detector (132) for detecting the oxygen concentration $CON_{02}$ of the combustion gas, the combustion gas being guided together with slag from the SCC and then separated from the slag, and for outputting the detected value as a detected combustion gas oxygen concentration $CON_{02}$*;

(f) a dried sludge supply amount detector (111D) for detecting a supply amount D of dried sludge to the PCC, and for outputting the detected amount as a detected dried sludge supply amount D*;

(g) a first combustion air supply amount detector (112A) for detecting a supply amount $AIR_{1H}$ of combustion air to the upper portion of the PCC, and for outputting the detected amount as a detected PCC upper combustion air supply amount $AIR_{1H}$*;

(h) a second combustion air supply amount detector (113A) for detecting a supply amount $AIR_{1L}$ of combustion air to the lower portion of the PCC, and for outputting the detected amount as a detected PCC lower combustion air supply amount $A_{1H}$*;

(i) a third combustion air supply amount detector (121E) for detecting the total amount $AIR_{TL}$ of the combustion air supply amounts $AIR_{1H}$ and $AIR_{1L}$ to the PCC and a combustion air supply amount $AIR_2$ to the SCC, and for outputting the detected amount as a detected total combustion air supply amount $AIR_{TL}$*;

(j) a fuel supply amount detector (122B) for detecting the supply amount $F_2$ of fuel to a burner for the SCC, and for outputting the detected amount as a detected SCC burner fuel supply amount $F_2$*;

(k) a temperature correcting device (210) for correcting the detected PCC upper portion temperature $T_{1H}$* and the detected slag temperature $T_3$* in accordance with the detected combustion gas oxygen concentration $CON_{02}$* given from the oxygen concentration detector (132), the detected PCC upper portion temperature $T_{1H}$* given from the first temperature detector (115), the detected slag temperature $T_3$* given from the third temperature detector (133), the detected dried sludge supply amount D* given from the dried sludge supply amount detector (111D), and the detected total combustion air supply amount $AIR_{TL}$* given from the third combustion air supply amount detector (121E), and for outputting the corrected values as a corrected PCC upper portion temperature $T_{1H}$ and a corrected slag temperature $T_3$;

(l) a fuzzy controller (220) comprising:

(i) a first fuzzy inference means (221) for executing fuzzy inference to obtain an inferred PCC upper combustion air supply amount $AIR_{1H}^f$ and an inferred PCC lower combustion air supply amount $AIR_{1L}^f$ on the basis of first fuzzy rules held among a fuzzy set relating to the PCC lower portion temperature $T_{1L}$, a fuzzy set relating to the PCC upper portion temperature $T_{1H}$, a fuzzy set relating to the combustion gas NOX concentration $CON_{NOX}$, a fuzzy set relating to the combustion gas oxygen concentration $CON_{02}$, a fuzzy set relating to the PCC upper combustion air supply amount $AIR_{1H}$ and a fuzzy set relating to the PCC lower combustion air supply amount $AIR_{1L}$, in accordance with the detected PCC lower portion temperature $T_{1L}$*, the corrected PCC upper portion temperature $T_{1H}$**, the detected combustion gas NOX concentration $CON_{NOX}$* and the detected combustion gas oxygen concentration $CON_{02}$*, and for outputting the obtained amounts; and (ii) a second fuzzy inference means (222) for executing fuzzy inference to obtain an inferred total combustion air supply amount $AIR_{TL}^f$ and an inferred SCC burner fuel supply amount $F_2^f$ on the basis of second fuzzy rules held among a fuzzy set relating to the combustion gas oxygen concentration $CON_{02}$, a fuzzy set relating to the slag temperature $T_3$, a fuzzy set relating to the total combustion air supply amount $AIR_{TL}$ and a fuzzy set relating to the SCC burner fuel supply amount $F_2$, in accordance with the detected combustion gas oxygen concentration $CON_{02}$* and the corrected slag temperature $T_3$**, and for outputting the obtained amounts;

(m) a sequence controller (230) for obtaining a target PCC upper combustion air supply amount $AIR_{1H}°$, a target PCC lower combustion air supply amount $AIR_{1L}°$, a target total combustion air supply amount $AIR_{TL}°$ and a target SCC burner fuel supply amount $F_2°$, from the inferred PCC upper combustion air supply amount $AIR_{1H}^f$ and inferred PCC lower combustion air supply amount $AIR_{1L}^f$ given from the first inference means (221) of the fuzzy controller (220), the inferred total combustion air supply amount $AIR_{TL}^f$ and inferred SCC burner fuel supply amount $F_2^f$ given from the second inference means (222) of the fuzzy controller (220), the detected PCC upper combustion air supply amount $AIR_{1H}$*, detected PCC lower combustion air supply amount $AIR_{1L}$* and detected total combustion air supply amount $AIR_{TL}$* given from the first to third combustion air supply amount detectors (112A, 113A, 121E), and the detected SCC burner fuel supply amount $F_2$* given from the fuel supply amount detector (122B), and for outputting the obtained values; and (n) a PID controller (240) for obtaining a PCC upper combustion air supply amount control signal $AIR_{1HC}$, a PCC lower combustion air supply amount control signal $AIR_{1LC}$, a total combustion air supply amount control signal $AIR_{TLC}$ and an SCC burner fuel supply amount control signal $F_{2C}$ so that the PCC upper combustion air supply amount $AIR_{1H}$, the PCC lower combustion air supply amount $AIR_{1L}$ and the total combustion air supply amount $AIR_{TL}$ respectively become the target PCC upper combustion air supply amount $AIR_{1H}°$, the target PCC lower combustion air supply amount $AIR_{1L}°$ and the target total combustion air supply amount $AIR_{TL}°$, and the SCC burner fuel supply amount $F_2$ becomes the target SCC burner fuel supply amount $F_2°$, and for respectively outputting the obtained signals to valve apparatuses (112B, 113B, 121F, 122C)."

The second means for solving the problems according to the invention is

"a dried sludge melting furnace apparatus in which dried sludge and combustion air are supplied to a primary combustion chamber (PCC), and the dried sludge is converted into slag in the PCC and a secondary combustion chamber (SCC) and then separated from the combustion gas in a slag separation chamber, wherein the apparatus comprises:

(a) a first temperature detector (115) for detecting a temperature $T_{1H}$ of the upper portion of the PCC, and for outputting the detected temperature as a detected PCC upper portion temperature $T_{1H}$*;

(b) a second temperature detector (116) for detecting a temperature $T_{1L}$ of the lower portion of the PCC, and for outputting the detected temperature as a detected PCC lower portion temperature $T_{1L}$*;

(c) a nitrogen oxide (NOX) concentration detector (131) for detecting the NOX concentration $CON_{NOX}$ of the combustion gas, the combustion gas being guided together with slag from the SCC and then separated from the slag, and for outputting the detected value as a detected combustion gas NOX concentration $CON_{NOX}$*;

(d) an oxygen concentration detector (132) for detecting the oxygen concentration $CON_{02}$ of the combustion gas, the combustion gas being guided together with slag from the SCC and then separated from the slag, and for outputting the detected value as a detected combustion gas oxygen concentration $CON_{02}$*;

(e) a dried sludge supply amount detector (111D) for detecting a supply amount D of dried sludge to the PCC, and for outputting the detected amount as a detected dried sludge supply amount D*;

(f) a first combustion air supply amount detector (112A) for detecting a supply amount $AIR_{1H}$ of combustion air to the upper portion of the PCC, and for outputting the detected amount as a detected PCC upper combustion air supply amount $AIR_{1H}$*;

(g) a second combustion air supply amount detector (113A) for detecting a supply amount $AIR_{1L}$ of combustion air to the lower portion of the PCC, and for outputting the detected amount as a detected PCC lower combustion air supply amount $AIR_{1L}$*;

(h) a third combustion air supply amount detector (121E) for detecting the total amount $AIR_{TL}$ of the combustion air supply amounts $AIR_{1H}$ and $AIR_{1L}$ to the PCC and the combustion air supply amount $AIR_2$ to the SCC, and for outputting the detected amount as a detected total combustion air supply amount $AIR_{TL}$*;

(i) a fuel supply amount detector (122B) for detecting the supply amount $F_2$ of fuel to a burner for the SCC, and for outputting the detected amount as a detected SCC burner fuel supply amount $F_2$*;

(j) a temperature correcting device (210) for correcting the detected PCC upper portion temperature $T_{1H}$* in accordance with the detected combustion gas oxygen concentration $CON_{02}$* given from the oxygen concentration detector (132), the detected PCC upper portion temperature $T_{1H}$* given from the first temperature detector (115), the detected dried sludge supply amount D* given from the dried sludge supply amount detector (111D), and the detected total combustion air supply amount $AIR_{TL}$* given from the third combustion air supply amount detector (121E), and for outputting the corrected value as a corrected PCC upper portion temperature $T_{1H}$**;

(k) a fuzzy controller (220) comprising a fuzzy inference means (221) for executing fuzzy inference to obtain an inferred PCC upper combustion air supply amount $AIR_{1H}^f$ and an inferred PCC lower combustion air supply amount $AIR_{1L}^f$ on the basis of fuzzy rules held among a fuzzy set relating to the PCC lower portion temperature $T_{1L}$, a fuzzy set relating to the PCC upper portion temperature $T_{1H}$, a fuzzy set relating to the combustion gas NOX concentration $CON_{NOX}$, a fuzzy set relating to the combustion gas oxygen concentration $CON_{02}$, a fuzzy set relating to the PCC upper combustion air supply amount $AIR_{1H}$ and a fuzzy set relating to the PCC lower combustion air supply amount $AIR_{1L}$, in accordance with the detected PCC lower portion temperature $T_{1L}$*, the corrected PCC upper portion temperature $T_{1H}$**, the detected combustion gas NOX concentration $CON_{NOX}$* and the detected combustion gas oxygen concentration $CON_{02}$*, and for outputting the obtained amounts;

(l) a sequence controller (230) for obtaining a target PCC upper combustion air supply amount $AIR_{1H}^{\circ}$ and a target PCC lower combustion air supply amount $AIR_{1L}^{\circ}$, from the inferred PCC upper combustion air supply amount $AIR_{1H}^f$ and inferred PCC lower combustion air supply amount $AIR_{1L}^f$ given from the fuzzy inference means (221) of the fuzzy controller (220), the detected PCC upper combustion air supply amount $AIR_{1H}$*, detected PCC lower combustion air supply amount $AIR_{1L}$* and detected total combustion air supply amount $AIR_{TL}$* given from the first to third combustion air supply amount detectors (112A, 113A, 121E), and the detected SCC burner fuel supply amount $F_2$* given from the fuel supply amount detector (122B), and for outputting the obtained values; and (m) a PID controller (240) for obtaining a PCC upper combustion air supply amount control signal $AIR_{1HC}$ and a PCC lower combustion air supply amount control signal $AIR_{1LC}$ so that the PCC upper combustion air supply amount $AIR_{1H}$ and the PCC lower combustion air supply amount $AIR_{1L}$ respectively become the target PCC upper combustion air supply amount $AIR_{1H}^{\circ}$ and the target PCC lower combustion air supply amount $AIR_{1L}^{\circ}$, and for respectively outputting the obtained signals to first and second valve apparatuses (112B, 113B)."

The third means for solving the problems according to the invention is

"a dried sludge melting furnace apparatus in which dried sludge and combustion air are supplied to a primary combustion chamber (PCC), and the dried sludge is converted into slag in the PCC and a secondary combustion chamber (SCC) and then separated from the combustion gas in a slag separation chamber, wherein the apparatus comprises:

(a) a temperature detector (133) for detecting a temperature $T_3$ of slag guided from the SCC, and for outputting the detected temperature as a detected slag temperature $T_3$*;

(b) an oxygen concentration detector (132) for detecting the oxygen concentration $CON_{02}$ of the combustion gas, the combustion gas being guided together with slag from the SCC and then separated from the slag, and for outputting the detected value as a detected combustion gas oxygen concentration $CON_{02}$*;

(c) a dried sludge supply amount detector (111D) for detecting a supply amount D of dried sludge to the PCC, and for outputting the detected amount as a detected dried sludge supply amount D*;

(d) a combustion air supply amount detector (121E) for detecting the total amount $AIR_{TL}$ of the combustion air supply amounts $AIR_{1H}$ and $AIR_{1L}$ to the PCC and the combustion air supply amount $AIR_2$ to the SCC, and for outputting the detected amount as a detected total combustion air supply amount $AIR_{TL}$*;

(e) a fuel supply amount detector (122B) for detecting the supply amount $F_2$ of fuel to a burner for the SCC, and for outputting the detected amount as a detected SCC burner fuel supply amount $F_2$*;

(f) a temperature correcting device (210) for correcting the detected slag temperature $T_3$* in accordance with the detected combustion gas oxygen concentration $CON_{02}$* given from the oxygen concentration detector (132), the detected slag temperature $T_3$* given from the temperature detector (133), the detected dried sludge supply amount D* given from the dried sludge supply amount detector (111D), and the detected total combustion air supply amount $AIR_{TL}$* given from the combustion air supply amount detector (121E), and for outputting the corrected temperature as a corrected slag temperature $T_3$**;

(g) a fuzzy controller (220) comprising a fuzzy inference means (222) for executing fuzzy inference to obtain an inferred total combustion air supply amount $AIR_{TL}^f$ and an inferred SCC burner fuel supply amount $F_2^f$ on the basis of fuzzy rules held among a fuzzy set relating to the combustion gas oxygen concentration $CON_{02}$, a fuzzy set relating to the slag temperature $T_3$, a fuzzy set relating to the total combustion air supply amount $AIR_{TL}$ and a fuzzy set relating to the SCC burner fuel supply amount $F_2$, in accordance with the detected combustion gas oxygen concentration $CON_{02}$* and the corrected slag temperature $T_3$**, and for outputting the obtained amounts;

(h) a sequence controller (230) for obtaining a target total combustion air supply amount $AIR_{TL}$° and a target SCC burner fuel supply amount $F_2$°, from the inferred total combustion air supply amount $AIR_{TL}^f$ and inferred SCC burner fuel supply amount $F_2^f$ given from the fuzzy inference means (222) of the fuzzy controller (220), the detected total combustion air supply amount $AIR_{TL}$* given from the combustion air supply amount detector (121E), and the detected SCC burner fuel supply amount $F_2$* given from the fuel supply amount detector (122B), and for outputting the obtained values; and (i) a PID controller (240) for obtaining a total combustion air supply amount control signal $AIR_{TLC}$ and an SCC burner fuel supply amount control signal $F_{2C}$ so that the total combustion air supply amount $AIR_{TL}$ becomes the target total upper combustion air supply amount $AIR_{TL}$°, and the SCC burner fuel supply amount $F_2$ becomes the target SCC burner fuel supply amount $F_2$°, and for respectively outputting the obtained signals to first and second valve apparatuses (121F, 122C)."

The fourth means for solving the problems according to the invention is

"a dried sludge melting furnace apparatus in which dried sludge and combustion air are supplied to a primary combustion chamber (PCC), and the dried sludge is converted into slag in the PCC and a secondary combustion chamber (SCC) and then separated from the combustion gas in a slag separation chamber, wherein the apparatus comprises:

(a) a first temperature detector (115) for detecting a temperature $T_{1H}$ of the upper portion of the PCC, and for outputting the detected temperature as a detected PCC upper portion temperature $T_{1H}$*;

(b) a second temperature detector (116) for detecting a temperature $T_{1L}$ of the lower portion of the PCC, and for outputting the detected temperature as a detected PCC lower portion temperature $T_{1L}$*;

(c) a third temperature detector (133) for detecting a temperature $T_3$ of slag guided from the SCC, and for outputting the detected temperature as a detected slag temperature $T_3$*;

(d) a nitrogen oxide (NOX) concentration detector (131) for detecting the NOX concentration $CON_{NOX}$ of the combustion gas, the combustion gas being guided together with slag from the SCC and then separated from the slag, and for outputting the detected value as a detected combustion gas NOX concentration $CON_{NOX}$*;

(e) an oxygen concentration detector (132) for detecting the oxygen concentration $CON_{02}$ of the combustion gas, the combustion gas being guided together with slag from the SCC and then separated from the slag, and for outputting the detected value as a detected combustion gas oxygen concentration $CON_{02}$*;

(f) a dried sludge supply amount detector (111D) for detecting a supply amount D of dried sludge to the PCC, and for outputting the detected amount as a detected dried sludge supply amount D*;

(g) a first combustion air supply amount detector (112A) for detecting a supply amount $AIR_{1H}$ of combustion air to the upper portion of the PCC, and for outputting the detected amount as a detected PCC upper combustion air supply amount $AIR_{1H}$*;

(h) a second combustion air supply amount detector (113A) for detecting a supply amount $AIR_{1L}$ of combustion air to the lower portion of the PCC, and for outputting the detected amount as a detected PCC lower combustion air supply amount $AIR_{1L}$*;

(i) a third combustion air supply amount detector (121E) for detecting the total amount $AIR_{TL}$ of the combustion air supply amounts $AIR_{1H}$ and $AIR_{1L}$ to the PCC and the combustion air supply amount $AIR_2$ to the SCC, and for outputting the detected amount as a detected total combustion air supply amount $AIR_{TL}$*;

(j) a fuel supply amount detector (122B) for detecting the supply amount $F_2$ of fuel to a burner for the SCC, and for outputting the detected amount as a detected SCC burner fuel supply amount $F_2$*;

(k) a fuzzy controller (220) comprising:

(i) a first fuzzy inference means (221) for executing fuzzy inference to obtain an inferred PCC upper combustion air supply amount $AIR_{1H}^f$ and an inferred PCC lower combustion air supply amount $AIR_{1L}^f$ on the basis of first fuzzy rules held among a fuzzy set relating to the PCC lower portion temperature $T_{1L}$, a fuzzy set relating to the PCC upper portion temperature $T_{1H}$, a fuzzy set relating to the combustion gas NOX concentration $CON_{NOX}$, a fuzzy set relating to the combustion gas oxygen concentration $CON_{02}$, a fuzzy set relating to the PCC upper combustion air supply amount $AIR_{1H}$ and a fuzzy set relating to the PCC lower combustion air supply amount $AIR_{1L}$, in accordance with the detected PCC lower portion temperature $T_{1L}$*, the detected PCC upper portion temperature $T_{1H}$*, the detected combustion gas NOX concentration $CON_{NOX}$* and the detected combustion gas oxygen concentration $CON_{02}$*, and for outputting the obtained amounts; and (ii) a second fuzzy inference means (222) for executing fuzzy inference to obtain an inferred total combustion air supply amount $AIR_{TL}^f$ and an inferred SCC burner fuel supply amount $F_2^f$ on the basis of second fuzzy rules held among a fuzzy set relating to the combustion gas oxygen concentration $CON_{02}$, a fuzzy set relating to the slag temperature $T_3$, a fuzzy set relating to the total combustion air supply amount $AIR_{TL}$ and a fuzzy set relating to the SCC burner fuel supply amount $F_2$, in accordance with the detected combustion gas oxygen concentration $CON_{02}$* and the detected slag temperature $T_3$*, and for outputting the obtained amounts;

(l) a sequence controller (230) for obtaining a target PCC upper combustion air supply amount $AIR_{1H}°$, a target PCC lower combustion air supply amount $AIR_{1L}°$, a target total combustion air supply amount $AIR_{TL}°$ and a target SCC burner fuel supply amount $F_2°$, from the inferred PCC upper combustion air supply amount $AIR_{1H}^f$ and inferred PCC lower combustion air supply amount $AIR_{1L}^f$ given from the first inference means (221) of the fuzzy controller (220), the inferred total combustion air supply amount $AIR_{TL}^f$ and inferred SCC burner fuel supply amount $F_2^f$ given from the second inference means (222) of the fuzzy controller (220), the detected PCC upper combustion air supply amount $AIR_{1H}$*, detected PCC lower combustion air supply amount $AIR_{1L}$* and detected total combustion air supply amount $AIR_{TL}$* given from the first to third combustion air supply amount detectors (112A, 113A, 121E), and the detected SCC burner fuel supply amount $F_2$* given from the fuel supply amount detector (122B), and for outputting the obtained values; and (m) a PID controller (240) for obtaining a PCC upper combustion air supply amount control signal $AIR_{1HC}$, a PCC lower combustion air supply amount control signal $AIR_{1LC}$, a total combustion air supply amount control signal $AIR_{TLC}$ and an SCC burner fuel supply amount control signal $F_{2C}$ so that the PCC upper combustion air supply amount $AIR_{1H}$, the PCC lower combustion air supply amount $AIR_{1L}$ and the total combustion air supply amount $AIR_{TL}$ respectively become the target PCC upper combustion air supply amount $AIR_{1H}°$, the target PCC lower combustion air supply amount $AIR_{1L}°$ and the target total combustion air supply amount $AIR_{TL}°$ and the SCC burner fuel supply amount $F_2$ becomes the target SCC burner fuel supply amount $F_2°$, and for respectively outputting the obtained signals to first to fourth valve apparatuses (112B, 113B, 121F, 122C)."

The fifth means for solving the problems according to the invention is

"a dried sludge melting furnace apparatus in which dried sludge and combustion air are supplied to a primary combustion chamber (PCC), and the dried sludge is converted into slag in the PCC and a secondary combustion chamber (SCC) and then separated from the combustion gas in a slag separation chamber, wherein the apparatus comprises:

(a) a first temperature detector (115) for detecting a temperature $T_{1H}$ of the upper portion of the PCC, and for outputting the detected temperature as a detected PCC upper portion temperature $T_{1H}$*;

(b) a second temperature detector (116) for detecting a temperature $T_{1L}$ of the lower portion of the PCC, and for outputting the detected temperature as a detected PCC lower portion temperature $T_{1L}$*;

(c) a nitrogen oxide (NOX) concentration detector (131) for detecting the NOX concentration $CON_{NOX}$ of the combustion gas, the combustion gas being guided together with slag from the SCC and then separated from the slag, and for outputting the detected value as a detected combustion gas NOX concentration $CON_{NOX}$*;

(d) an oxygen concentration detector (132) for detecting the oxygen concentration $CON_{02}$ of the combustion gas, the combustion gas being guided together with slag from the SCC and then separated from the slag, and for outputting the detected value as a detected combustion gas oxygen concentration $CON_{02}$*;

(e) a dried sludge supply amount detector (111D) for detecting a supply amount D of dried sludge to the PCC, and for outputting the detected amount as a detected dried sludge supply amount D*;

(f) a first combustion air supply amount detector (112A) for detecting a supply amount $AIR_{1H}$ of combustion air to the upper portion of the PCC, and for outputting the detected amount as a detected PCC upper combustion air supply amount $AIR_{1H}$*;

(g) a second combustion air supply amount detector (113A) for detecting a supply amount $AIR_{1L}$ of combustion air to the lower portion of the PCC, and for outputting the detected amount as a detected PCC lower combustion air supply amount $AIR_{1L}$*;

(h) a third combustion air supply amount detector (121E) for detecting the total amount $AIR_{TL}$ of the combustion air supply amounts $AIR_{1H}$ and $AIR_{1L}$ to the PCC and the combustion air supply amount $AIR_2$ to the SCC, and for outputting the detected amount as a detected total combustion air supply amount $AIR_{TL}$*;

(i) a fuel supply amount detector (122B) for detecting the supply amount $F_2$ of fuel to a burner for the SCC, and for outputting the detected amount as a detected SCC burner fuel supply amount $F_2$*;

(j) a fuzzy controller (220) comprising a fuzzy inference means (221) for executing fuzzy inference to obtain an inferred PCC upper combustion air supply amount $AIR_{1H}^f$ and an inferred PCC lower combustion air supply amount $AIR_{1L}^f$ on the basis of fuzzy rules held among a fuzzy set relating to the PCC lower portion temperature $T_{1L}$, a fuzzy set relating to the PCC upper portion temperature $T_{1H}$, a fuzzy set relating to the combustion gas NOX concentration $CON_{NOX}$, a fuzzy set relating to the combustion gas oxygen concentration $CON_{02}$, a fuzzy set relating to the PCC upper combustion air supply amount $AIR_{1H}$ and a fuzzy set relating to the PCC lower combustion air supply amount $AIR_{1L}$, in accordance with the detected PCC lower portion temperature $T_{1L}$*, the detected PCC upper portion temperature $T_{1H}$*, the detected combustion gas NOX concentration $CON_{NOX}$* and the detected combustion gas oxygen concentration $CON_{02}$*, and for outputting the obtained amounts;

(k) a sequence controller (230) for obtaining a target PCC upper combustion air supply amount $AIR_{1H}°$ and a target PCC lower combustion air supply amount $AIR_{1L}°$, from the inferred PCC upper combustion air supply amount $AIR_{1H}f$ and inferred PCC lower combustion air supply amount $AIR_{1L}f$ given from the fuzzy inference means (221) of the fuzzy controller (220), the detected PCC upper combustion air supply amount $AIR_{1H}$*, detected PCC lower combustion air supply amount $AIR_{1L}$* and detected total combustion air supply amount $AIR_{TL}$* given from the first to third combustion air supply amount detectors (112A, 113A, 121E), and the detected SCC burner fuel supply amount $F_2$* given from the fuel supply amount detector (122B), and for outputting the obtained values; and (l) a PID controller (240) for obtaining a PCC upper combustion air supply amount control signal $AIR_{1HC}$ and a PCC lower combustion air supply amount control signal $AIR_{1LC}$ so that the PCC upper combustion air supply amount $AIR_{1H}$ and the PCC lower combustion air supply amount $AIR_{1L}$ respectively become the target PCC upper combustion air supply amount $AIR_{1H}°$ and the target PCC lower combustion air supply amount $AIR_{1L}°$, and for respectively outputting the obtained signals to first and second valve apparatuses (112B, 113B)."

The sixth means for solving the problems according to the invention is

"a dried sludge melting furnace apparatus in which dried sludge and combustion air are supplied to a primary combustion chamber (PCC), and the dried sludge is converted into slag in the PCC and a secondary combustion chamber (SCC) and then separated from the combustion gas in a slag separation chamber, wherein the apparatus comprises:

(a) a temperature detector (133) for detecting a temperature $T_3$ of slag guided from the SCC, and for outputting the detected temperature as a detected slag temperature $T_3$*;

(b) an oxygen concentration detector (132) for detecting the oxygen concentration $CON_{02}$ of the combustion gas, the combustion gas being guided together with slag from the SCC and then separated from the slag, and for outputting the detected value as a detected combustion gas oxygen concentration $CON_{02}$*;

(c) a dried sludge supply amount detector (111D) for detecting a supply amount D of dried sludge to the PCC, and for outputting the detected amount as a detected dried sludge supply amount D*;

(d) a combustion air supply amount detector (121E) for detecting the total amount $AIR_{TL}$ of the combustion air supply amounts $AIR_{1H}$ and $AIR_{1L}$ to the PCC and the combustion air supply amount $AIR_2$ to the SCC, and for outputting the detected amount as a detected total combustion air supply amount $AIR_{TL}$*;

(e) a fuel supply amount detector (122B) for detecting the supply amount $F_2$ of fuel to a burner for the SCC, and for outputting the detected amount as a detected SCC burner fuel supply amount $F_2$*;

(f) a fuzzy controller (220) comprising a fuzzy inference means (222) for executing fuzzy inference to obtain an inferred total combustion air supply amount $AIR_{TL}f$ and an inferred SCC burner fuel supply amount $F_2f$ on the basis of fuzzy rules held among a fuzzy set relating to the combustion gas oxygen concentration $CON_{02}$, a fuzzy set relating to the slag temperature $T_3$, a fuzzy set relating to the total combustion air supply amount $AIR_{TL}$ and a fuzzy set relating to the SCC burner fuel supply amount $F_2$, in accordance with the detected combustion gas oxygen concentration $CON_{02}$* and the detected slag temperature $T_3$*, and for outputting the obtained amounts;

(g) a sequence controller (230) for obtaining a target total combustion air supply amount $AIR_{TL}°$ and a target SCC burner fuel supply amount $F_2°$, from the inferred total combustion air supply amount $AIR_{TL}f$ and inferred SCC burner fuel supply amount $F_2f$ given from the fuzzy inference means (222) of the fuzzy controller (220), the detected total combustion air supply amount $AIR_{TL}$* given from the combustion air supply amount detector (121E), and the detected SCC burner fuel supply amount $F_2$* given from the fuel supply amount detector (122B), and for outputting the obtained values; and (h) a PID controller (240) for obtaining a total combustion air supply amount control signal $AIR_{TLC}$ and an SCC burner fuel supply amount control signal $F_{2C}$ so that the total combustion air supply amount $AIR_{TL}$ becomes the target total combustion air supply amount $AIR_{TL}°$ and the SCC burner fuel supply amount $F_2$ becomes the target SCC burner fuel supply amount $F_2°$, and for respectively outputting the obtained signals to first and second valve apparatuses (121F, 122C)."

The first dried sludge melting furnace apparatus of the invention is configured as specified above. Particularly, the first dried sludge melting furnace apparatus obtains: a corrected PCC upper portion temperature $T_{1H}$** in accordance with a detected PCC upper portion temperature $T_{1H}$*, a detected dried sludge supply amount D*, a detected combustion gas oxygen concentration $CON_{02}$* and a detected total combustion air supply amount $AIR_{TL}$*; a corrected slag temperature $T_3$** in accordance with the detected PCC upper portion temperature $T_{1H}$*, a detected slag temperature $T_3$*, the detected dried sludge supply amount D*, the detected combustion gas oxygen concentration $CON_{02}$* and the detected total combustion air supply amount $AIR_{TL}$*; an inferred PCC upper combustion air supply amount $AIR_{1H}f$ and an inferred PCC lower combustion air supply amount $AIR_{1L}f$ by executing fuzzy inference on the basts of first fuzzy rules held among fuzzy sets each relating to a PCC lower portion temperature $T_{1L}$, a PCC upper portion temperature $T_{1H}$, a combustion gas NOX concentration $CON_{NOX}$, a combustion gas oxygen concentration $CON_{02}$, a PCC upper combustion air supply amount $AIR_{1H}$ and a PCC lower combustion air supply amount $AIR_{1L}$, in accordance with a detected PCC lower portion temperature $T_{1L}$*, the corrected PCC upper portion temperature $T_{1H}$**, a detected combustion gas NOX concentration $CON_{NOX}$* and the detected combustion gas oxygen concentration $CON_{02}$*; an inferred total combustion air supply amount $AIR_{TL}f$ and an inferred SCC burner fuel supply amount $F_2f$ by executing fuzzy inference on the basis of second fuzzy rules held among fuzzy sets each relating to the combustion gas oxygen concentration $CON_{02}$, a slag temperature $T_3$, a total combustion air supply amount $AIR_{TL}$ and an SCC burner fuel supply amount $F_2$, in accordance with the detected combustion gas oxygen concentration $CON_{02}$* and the corrected slag temperature $T_3$**; and a target PCC upper combustion air supply amount $AIR_{1H}$°, a target PCC lower combustion air supply amount $AIR_{1L}$°, a target total combustion air supply amount $AIR_{TL}$° and a target SCC burner fuel supply amount $F_2$°, from the inferred PCC upper combustion air supply amount $AIR_{1H}f$, the inferred PCC lower combustion air supply amount $AIR_{1L}f$, the inferred total combustion air supply amount $AIR_{TL}f$, the inferred SCC burner fuel supply amount $F_2f$, the detected PCC upper combustion air supply amount $AIR_{1H}$*, the detected PCC lower combustion air supply amount $AIR_{1L}$*, the detected total combustion air supply amount $AIR_{TL}$*, and a detected SCC burner fuel supply amount $F_2$*. The first dried sludge melting furnace apparatus generates combustion air supply amount control signals $AIR_{1HC}$ and $AIR_{1LC}$, a total combustion air supply amount control signal $AIR_{TLC}$ and an SCC burner fuel supply amount control signal $F_{2C}$ so that the PCC upper combustion air supply amount $AIR_{1H}$, the PCC lower combustion air supply amount $AIR_{1L}$ and the total combustion air supply amount $AIR_{TL}$ respectively become the target PCC upper combustion air supply amount $AIR_{1H}$°, the target PCC lower combustion air supply amount $AIR_{1L}$° and the target total combustion air supply amount $AIR_{TL}$° and the SCC burner fuel supply amount $F_2$ becomes the target SCC burner fuel supply amount $F_2$°. Therefore, the first dried sludge melting furnace apparatus performs the functions of:

(i) automating the control of the burning of dried sludge; and (ii) eliminating the necessity that the operator must always be stationed in a control room, and, consequently, performs the functions of:

(iii) improving the operation accuracy and efficiency; and (iv) preventing the temperature of a combustion chamber from rising, and prolonging the service life.

The second dried sludge melting furnace apparatus of the invention is configured as specified above. Particularly, the second dried sludge melting furnace apparatus obtains: a corrected PCC upper portion temperature $T_{1H}$** in accordance with a detected PCC upper portion temperature $T_{1H}$*, a detected dried sludge supply amount D*, a detected combustion gas oxygen concentration $CON_{02}$* and a detected total combustion air supply amount $AIR_{TL}$*; an inferred PCC upper combustion air supply amount $AIR_{1H}f$ and an inferred PCC lower combustion air supply amount $AIR_{1L}f$ by executing fuzzy inference on the basis of fuzzy rules held among fuzzy sets each relating to a PCC lower portion temperature $T_{1L}$, a PCC upper portion temperature $T_{1H}$, a combustion gas NOX concentration $CON_{NOX}$, a combustion gas oxygen concentration $CON_{02}$, a PCC upper combustion air supply amount $AIR_{1H}$ and a PCC lower combustion air supply amount $AIR_{1L}$, in accordance with a detected PCC lower portion temperature $T_{1L}$*, the corrected PCC upper portion temperature $T_{1H}$**, a detected combustion gas NOX concentration $CON_{NOX}$* and the detected combustion gas oxygen concentration $CON_{02}$*; and a target PCC upper combustion air supply amount $AIR_{1H}$° and a target PCC lower combustion air supply amount $AIR_{1L}$°, from the inferred PCC upper combustion air supply amount $AIR_{1H}f$, the inferred PCC lower combustion air supply amount $AIR_{1L}f$, a detected PCC upper combustion air supply amount $AIR_{1H}$*, a detected PCC lower combustion air supply amount $AIR_{1L}$*, the detected total combustion air supply amount $AIR_{TL}$*, a the detected SCC burner fuel supply amount $F_2$*. The second dried sludge melting furnace apparatus generates combustion air supply amount control signals $AIR_{1HC}$ and $AIR_{1LC}$ so that a PCC upper combustion air supply amount $AIR_{1H}$ and a PCC lower combustion air supply amount $AIR_{1L}$ respectively become the target PCC upper combustion air supply amount $AIR_{1H}$° and the target PCC lower combustion air supply amount $AIR_{1L}$°. Therefore, the second dried sludge melting furnace apparatus similarly performs the above-mentioned functions (i) to (iv).

The third dried sludge melting furnace apparatus of the invention is configured as specified above. Particularly, the third dried sludge melting furnace apparatus obtains: a corrected slag temperature $T_3$** in accordance with a detected PCC upper portion temperature $T_{1H}$*, a detected slag temperature $T_3$*, a detected dried sludge supply amount D*, a detected combustion gas oxygen concentration $CON_{02}$* and a detected total combustion air supply amount $AIR_{TL}$*; an inferred total combustion air supply amount $AIR_{TL}f$ and an inferred SCC burner fuel supply amount $F_2f$ by executing fuzzy inference on the basis of fuzzy rules held among fuzzy sets each relating to a combustion gas oxygen concentration $CON_{02}$, a slag temperature $T_3$, a total combustion air supply amount $AIR_{TL}$ and an SCC burner fuel supply amount $F_2$, in accordance with the detected combustion gas oxygen concentration $CON_{02}$* and the corrected slag temperature $T_3$**; and a target total combustion air supply amount $AIR_{TL}$° and a target SCC burner fuel supply amount $F_2$°, from the inferred total combustion air supply amount $AIR_{TL}f$, the inferred SCC burner fuel supply amount $F_2f$, the detected total combustion air supply amount $AIR_{TL}$*, a the detected SCC burner fuel supply amount $F_2$*. The third dried sludge melting furnace apparatus generates a total combustion air supply amount control signal $AIR_{TLC}$ and an SCC burner fuel supply amount control signal $F_{2C}$ so that a total combustion air supply amount $AIR_{TL}$ and an SCC burner fuel supply amount $F_2$ respectively become the target total combustion air supply amount $AIR_{TL}$° and the target SCC burner fuel supply amount $F_2$°. Therefore, the third dried sludge melting furnace apparatus similarly performs the above-mentioned functions (i) to (iv).

The fourth dried sludge melting furnace apparatus of the invention is configured as specified above. Particularly, the fourth dried sludge melting furnace apparatus obtains: an inferred PCC upper combustion air supply amount $AIR_{1H}f$ and an inferred PCC lower combustion air supply amount $AIR_{1L}f$ by executing fuzzy inference on the basis of first fuzzy rules held among fuzzy sets each relating to a PCC lower portion temperature $T_{1L}$, a PCC upper portion temperature $T_{1H}$, a combustion gas NOX concentration $CON_{NOX}$, a combustion gas oxygen concentration $CON_{02}$, a PCC upper combustion air supply amount $AIR_{1H}$ and a PCC lower combustion air supply amount $AIR_{1L}$, in accordance with a detected PCC lower portion temperature $T_{1L}$*, a detected PCC upper portion temperature $T_{1H}$*, a detected combustion gas NOX concentration $CON_{NOX}$* and a detected combustion gas oxygen concentration $CON_{02}$*;

an inferred total combustion air supply amount $AIR_{TL}^f$ and an inferred SCC burner fuel supply amount $F_2^f$ by executing fuzzy inference on the basis of second fuzzy rules held among fuzzy sets each relating to the combustion gas oxygen concentration $CON_{02}$, a slag temperature $T_3$, a total combustion air supply amount $AIR_{TL}$ and an SCC burner fuel supply amount $F_2$, in accordance with the detected combustion gas oxygen concentration $CON_{02}$* and a detected slag temperature $T_3$*; and a target PCC upper combustion air supply amount $AIR_{1H}°$, a target PCC lower combustion air supply amount $AIR_{1L}°$, a target total combustion air supply amount $AIR_{TL}°$ and a target SCC burner fuel supply amount $F_2°$, from the inferred PCC upper combustion air supply amount $AIR_{1H}^f$, the inferred PCC lower combustion air supply amount $AIR_{1L}^f$, the inferred total combustion air supply amount $AIR_{TL}^f$, the inferred SCC burner fuel supply amount $F_2^f$, the detected PCC upper combustion air supply amount $AIR_{1H}$*, the detected PCC lower combustion air supply amount $AIR_{1L}$*, a detected total combustion air supply amount $AIR_{TL}$*, and a detected SCC burner fuel supply amount $F_2$*. The fourth dried sludge melting furnace apparatus generates combustion air supply amount control signals $AIR_{1HC}$ and $AIR_{1LC}$, a total combustion air supply amount control signal $AIR_{TLC}$ and an SCC burner fuel supply amount control signal $F_{2C}$ so that the PCC upper combustion air supply amount $AIR_{1H}$, the PCC lower combustion air supply amount $AIR_{1L}$, the total combustion air supply amount $AIR_{TL}$ and the supply amount $F_2$ of fuel respectively become the target PCC upper combustion air supply amount $AIR_{1H}°$, the target PCC lower combustion air supply amount $AIR_{1L}°$, the target total combustion air supply amount $AIR_{TL}°$ and the target SCC burner fuel supply amount $F_2°$. Therefore, the fourth dried sludge melting furnace apparatus similarly performs the above-mentioned functions (i) to (iv).

The fifth dried sludge melting furnace apparatus of the invention is configured as specified above. Particularly, the fifth dried sludge melting furnace apparatus obtains: an inferred PCC upper combustion air supply amount $AIR_{1H}^f$ and an inferred PCC lower combustion air supply amount $AIR_{1L}^f$ by executing fuzzy inference on the basis of fuzzy rules held among fuzzy sets each relating to a PCC lower portion temperature $T_{1L}$, a PCC upper portion temperature $T_{1H}$, a combustion gas NOX concentration $CON_{NOX}$, a combustion gas oxygen concentration $CON_{02}$, a PCC upper combustion air supply amount $AIR_{1H}$ and a PCC lower combustion air supply amount $AIR_{1L}$, in accordance with a detected PCC lower portion temperature $T_{1L}$*, a detected PCC upper portion temperature $T_{1H}$*, a detected combustion gas NOX concentration $CON_{NOX}$* and a detected combustion gas oxygen concentration $CON_{02}$*; and a target PCC upper combustion air supply amount $AIR_{1H}°$ and a target PCC lower combustion air supply amount $AIR_{1L}°$, from the inferred PCC upper combustion air supply amount $AIR_{1H}$*, the inferred PCC lower combustion air supply amount $AIR_{1L}^f$, a detected PCC upper combustion air supply amount $AIR_{1H}$*, a detected PCC lower combustion air supply amount $AIR_{1L}$*, a detected total combustion air supply amount $AIR_{TL}$* and a detected SCC burner fuel supply amount $F_2$*. The fifth dried sludge melting furnace apparatus generates combustion air supply amount control signals $AIR_{1HC}$ and $AIR_{1LC}$ so that the PCC upper combustion air supply amount $AIR_{1H}$ and the PCC lower combustion air supply amount $AIR_{1L}$ respectively become the target PCC upper combustion air supply amount $AIR_{1H}°$ and the target PCC lower combustion air supply amount $AIR_{1L}°$. Therefore, the fifth dried sludge melting furnace apparatus similarly performs the above-mentioned functions (i) to (iv).

The sixth dried sludge melting furnace apparatus of the invention is configured as specified above. Particularly, the sixth dried sludge melting furnace apparatus obtains: an inferred total combustion air supply amount $AIR_{TL}^f$ and an inferred SCC burner fuel supply amount $F_2^f$ by executing fuzzy inference on the basis of fuzzy rules held among fuzzy sets each relating to a combustion gas oxygen concentration $CON_{02}$, a slag temperature $T_3$, a total combustion air supply amount $AIR_{TL}$ and an SCC burner fuel supply amount $F_2$, in accordance with a detected combustion gas oxygen concentration $CON_{02}$* and a detected slag temperature $T_3$*; and a target total combustion air supply amount $AIR_{TL}°$ and a target SCC burner fuel supply amount $F_2°$, from the inferred total combustion air supply amount $AIR_{TL}^f$, the inferred SCC burner fuel supply amount $F_2^f$, a detected total combustion air supply amount $AIR_{TL}$* and a detected SCC burner fuel supply amount $F_2$*. The sixth dried sludge melting furnace apparatus, and generates a total combustion air supply amount control signal $AIR_{TLC}$ and an SCC burner fuel supply amount control signal $F_{2C}$ so that the total combustion air supply amount $AIR_{TL}$ and the SCC burner fuel supply amount $F_2$ respectively become the target total combustion air supply amount $AIR_{TL}°$ and the target SCC burner fuel supply amount $F_2°$. Therefore, the sixth dried sludge melting furnace apparatus similarly performs the above-mentioned functions (i) to (iv).

DETAILED DESCRIPTION OF THE INVENTION

Figure 1:
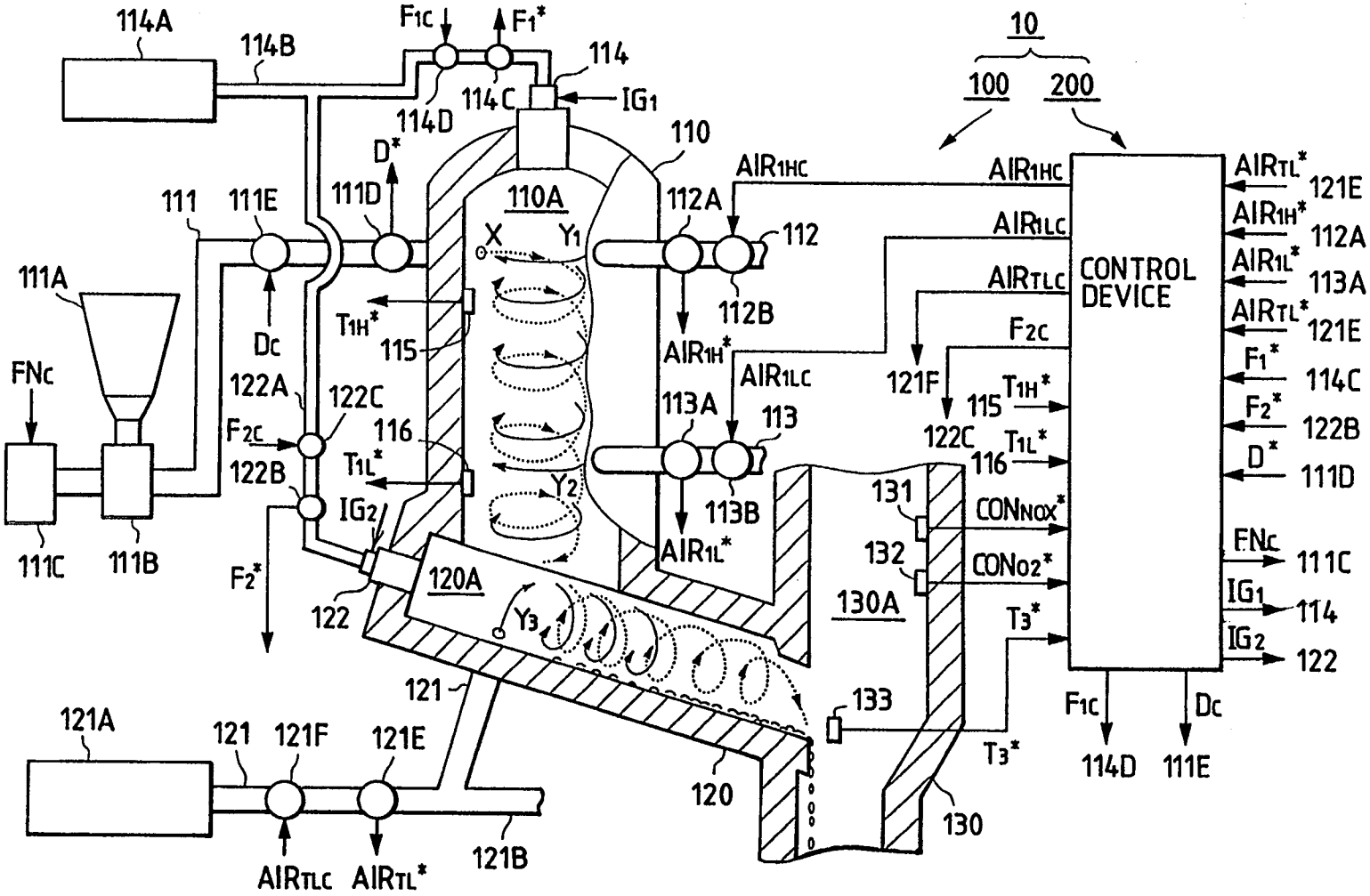
FIG. 1 is a diagram commonly illustrating first to sixth embodiments of the dried sludge melting furnace apparatus of the invention, and particularly showing a configuration which comprises a dried sludge melting furnace 100 including a primary combustion furnace 110, a secondary combustion furnace 120 and a slag separation furnace 130, and a controller 200 for performing the operation control of the dried sludge melting furnace 100.
Figures 2, 3, 4:
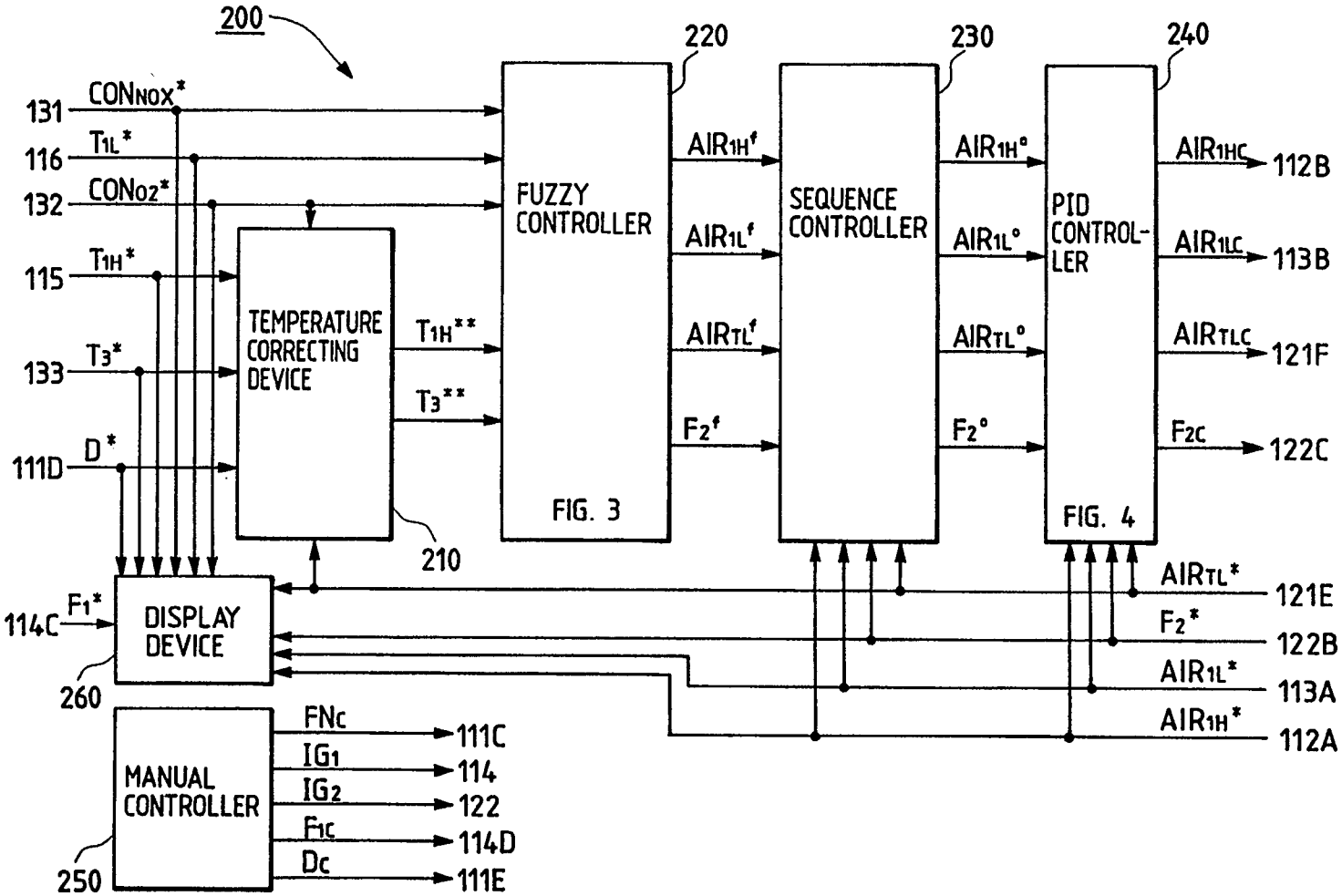
FIG. 2 is a block diagram illustrating one portion of the first embodiment of FIG. 1 on an enlarged scale, and particularly showing the controller 200 in detail.
FIG. 3 is a block diagram illustrating one portion of the block diagram of FIG. 2 on an enlarged scale, and particularly showing in detail a fuzzy controller 220 included in the controller 200.
FIG. 4 is a block diagram commonly illustrating on an enlarged scale one portion of the block diagram of FIG. 2 and one portion of the block diagram of FIG. 23, and particularly showing in detail a PID controller 240 included in the controller 200.
Figure 3:
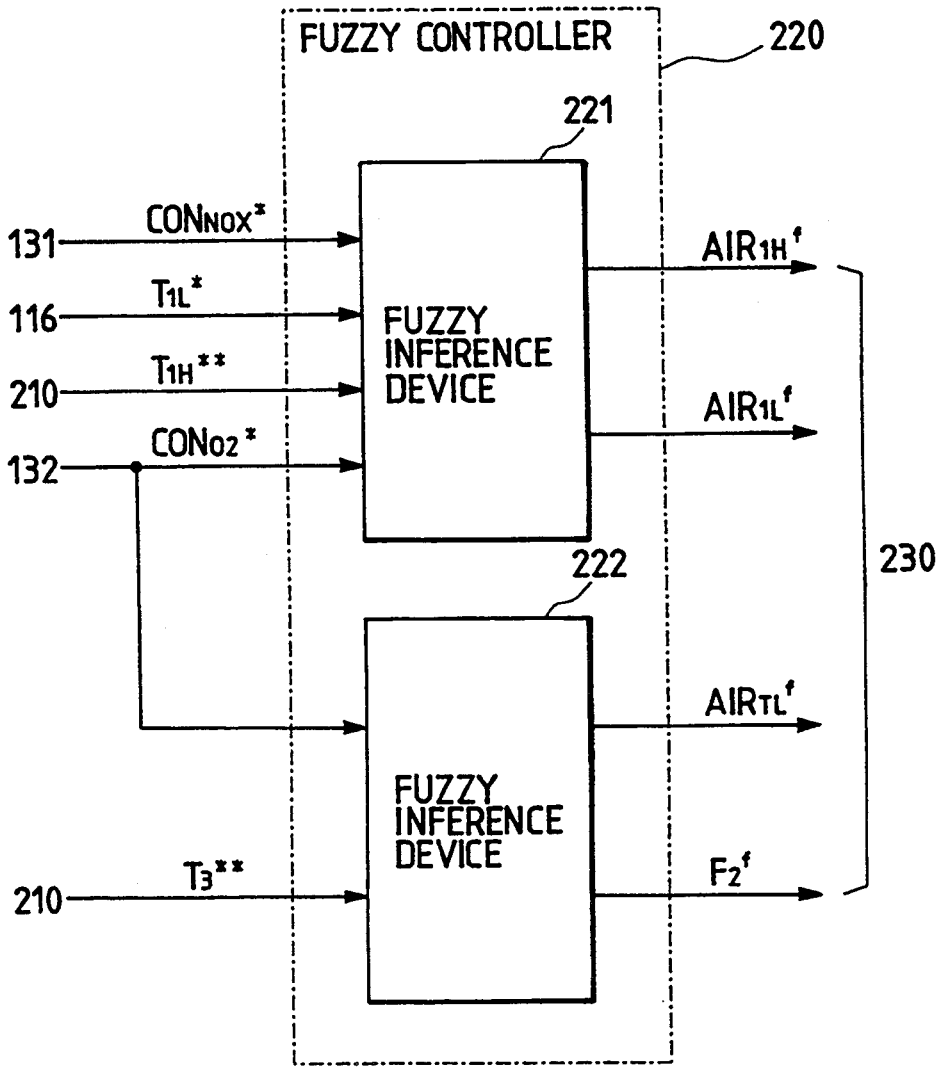
Figure 4:
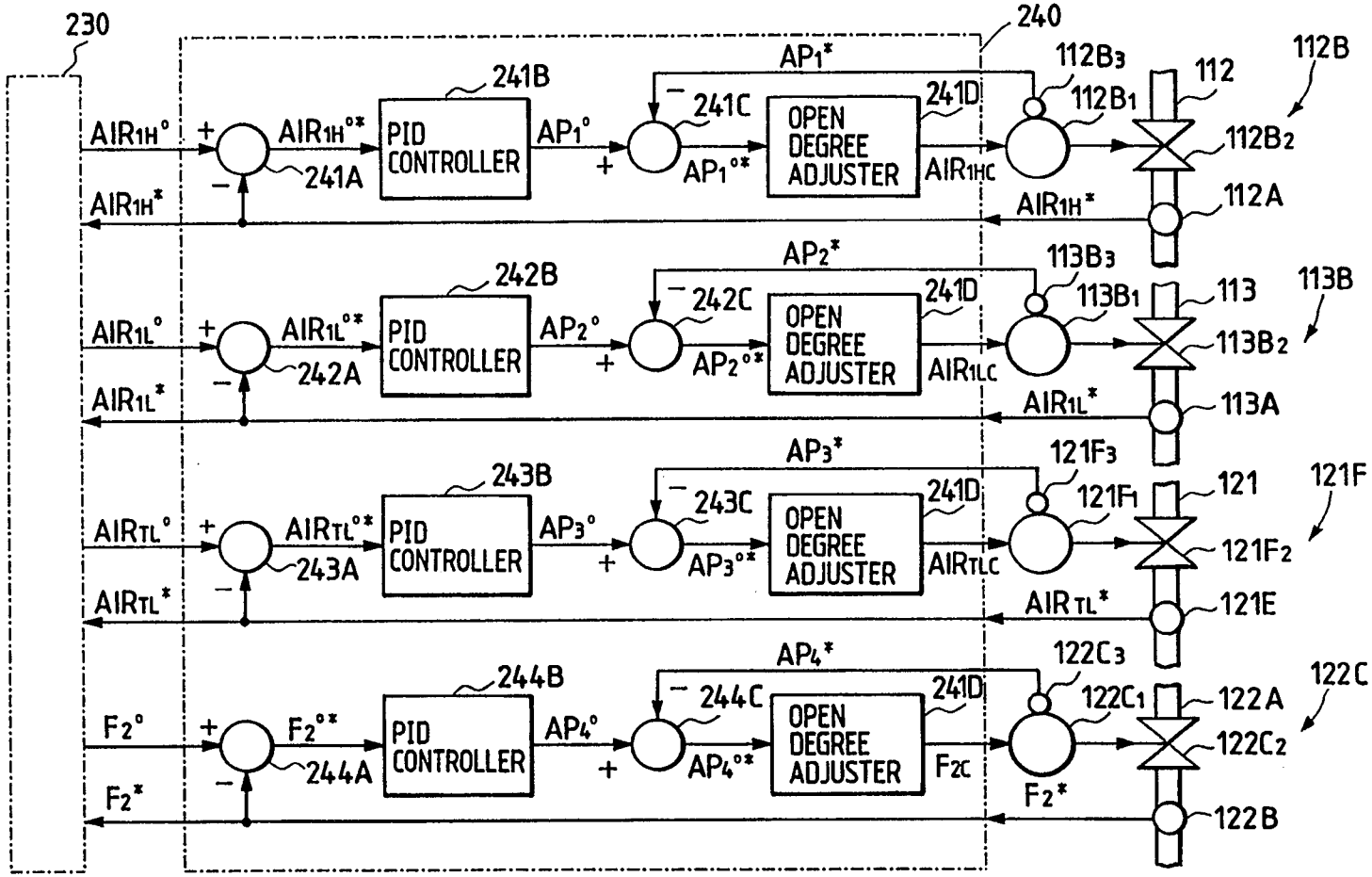

Hereinafter, the dried sludge melting furnace apparatus of the invention will be specifically described by illustrating its preferred embodiments with reference to the accompanying drawings.

However, it is to be understood that the following embodiments are intended to facilitate or expedite the understanding of the invention and are not to be construed to limit the scope of the invention.

In other words, components disclosed in the following description of the embodiments include all modifications and equivalents which are in the spirit and scope of the invention.

Configuration of the First Embodiment

First, referring to FIGS. 1 to 4, the configuration of the first embodiment of the dried sludge melting furnace apparatus of the invention will be described in detail.

The reference numeral 10 designates a dried sludge melting furnace according to the invention which comprises a dried sludge melting furnace 100 and a controller 200 for performing the operation control of the dried sludge melting furnace 100.

The dried sludge melting furnace 100 comprises a primary combustion furnace 110, a secondary combustion furnace 120 and a slag separation furnace 130. The primary combustion furnace 110 comprises therein a PCC 110A which has a circular, elliptic or polygonal section in a plane crossing the central axis, and which elongates in the vertical direction. In the primary combustion furnace 110, a portion of dried sludge is burned to be converted into ash and combustion gas, and the combustion heat generated in this burning causes a portion of unburnt dried sludge and the ash to be melted and converted into slag. The secondary combustion furnace 120 comprises therein an SCC 120A which has one end located lander the primary combustion furnace 110 so as to communicate with the lower portion of the PCC 110A, and which has a circular, elliptic or polygonal section in a plane crossing the central axis that is inclined in the direction from the one end to the other end. In the secondary combustion furnace 120, a portion of unburnt dried sludge guided from the PCC 110A is burned to be converted into ash and combustion gas, and the combustion heat generated in this burning and the combustion heat of the combustion gas guided from the PCC 110A cause the ash and the remaining portion of the unburnt dried sludge to be melted and converted into slag. The slag separation furnace 130 comprises therein a slag separation chamber 130A the lower portion of which opens in the other end of the secondary combustion furnace 120 to communicate therewith. In the slag separation furnace 130, the combustion gas and slag guided from the SCC 120A are separated from each other. The slag separation furnace 130 is communicated at its lower portion with a slag treating apparatus (not shown) and at its upper portion with a combustion gas treating apparatus (not shown).

The primary combustion furnace 110 further comprises a dried sludge supply pipe 111 which opens in the upper portion of the PCC 110A, and from which dried sludge and combustion air are introduced into the PCC 110A along a line parallel to a line that is in a section crossing the central axis and passes through the center of the section, so that a swirling flow is formed in the PCC 110A. To the other end of the dried sludge supply pipe 111, connected is an air blower 111C which supplies combustion air to a mixer 111B so that dried sludge supplied from a dried sludge hopper 111A is transported toward the PCC 110A. A dried sludge supply amount detector 111D which detects the supply amount D of dried sludge (referred to as "dried sludge supply amount") to the PCC 110A and which outputs the detected amount as a detected dried sludge supply amount D* is disposed in the vicinity of the opening (i.e., the one end) of the pipe 111 to the PCC 110A. A valve apparatus 111E for adjusting the degree of opening or closing of the dried sludge supply pipe 111 is disposed in the upper stream of the dried sludge supply amount detector 111D (i.e., in the side of the air blower 111C).

The primary combustion furnace 110 further comprises a combustion air supply pipe 112 which opens in the combustion space of the primary combustion furnace 110 or upper portion of the PCC 110A, which transports combustion air supplied to the PCC 110A from a combustion air supply 121A via a combustion air supply pipe 121 (described later) and a combustion air supply pipe 121B branched therefrom, and which introduces the combustion air into the PCC 110A along a line parallel to a line that is in a section crossing the central axis and passes through the center of the section, so that a swirling flow is formed in the PCC 110A. A combustion air supply amount detector 112A which detects the supply amount $AIR_{1H}$ of combustion air to the upper portion of the PCC 110A (referred to as "PCC upper combustion air supply amount") and which outputs the detected amount as a detected PCC upper combustion air supply amount $AIR_{1H}$* is disposed in the combustion air supply pipe 112. A valve apparatus 112B for adjusting the degree of opening or closing (i.e., open degree) of the combustion air supply pipe 112 to control the supply amount of combustion air (i.e., PCC upper combustion air supply amount) $AIR_{1H}$ to the upper portion of the PCC 110A is disposed in the upper stream of the combustion air supply amount detector 112A (i.e., in the side of the combustion air supply 121A). The valve apparatus 112B comprises a drive motor $112B_1$, and a control valve $112B_2$ which is inserted in the combustion air supply pipe 112 and which is operated by the drive motor $112B_1$, and an open degree detector $112B_3$ which is attached to the drive motor $112B_1$, which detects the opening position (defining the open degree) $AP_1$ of the control valve $112B_2$, and which outputs the detected value as a detected open degree $AP_1$*.

The primary combustion furnace 110 further comprises a combustion air supply pipe 113 which opens in the lower portion of the PCC 110A of the primary combustion furnace 110, which transports combustion air supplied to the PCC 110A from the combustion air supply 121A via the combustion air supply pipe 121 and the combustion air supply pipe 121B branched therefrom, and which introduces the combustion air into the PCC 110A along a line parallel to a line that is in a section crossing the central axis and passes through the center of the section, so that a swirling flow is formed in the PCC 110A. A combustion air supply amount detector 113A which detects the supply amount $AIR_{1L}$ of combustion air to the lower portion of the PCC 110A (referred to as "PCC lower combustion air supply amount") and which outputs the detected amount as a detected PCC lower combustion air supply amount $AIR_{1L}$* is disposed in the combustion air supply pipe 113. A valve apparatus 113B for adjusting the degree of opening or closing (i.e., open degree) of the combustion air supply pipe 113 to control the supply amount of combustion air (i.e., PCC lower combustion air supply amount) $AIR_{1L}$ to the lower portion of the PCC 110A is disposed in the upper stream of the combustion air supply amount detector 113A (i.e., in the side of the combustion air supply 121A). The valve apparatus 113B comprises a drive motor $113B_1$, and a control valve $113B_2$ which is inserted in the combustion air supply pipe 113 and which is operated by the drive motor $113B_1$, and an open degree detector $113B_3$ which is attached to the drive motor $113B_1$, which detects the opening position (defining the open degree) $AP_2$ of the control valve $113B_2$, and which outputs the detected value as a detected open degree $AP_2$*.

The primary combustion furnace 110 further comprises a PCC burner 114, a PCC upper portion temperature detector 115 and a PCC lower portion temperature detector 116. The PCC burner 114 is disposed at the top of the PCC 110A of the primary combustion furnace 110, communicated with a fuel tank 114A via a fuel supply pipe 114B, and used for raising the ambient temperature of the PCC 110A so that appropriate fuel and a portion of dried sludge burn to form slag. The PCC upper portion temperature detector 115 is disposed in the upper portion of the PCC 110A of the primary combustion furnace 110, detects the temperature $T_{1H}$ of the upper portion of the PCC 110A (referred to as "PCC upper portion temperature"), and outputs the detected temperature as a detected PCC upper portion temperature $T_{1H}$*. The PCC lower portion temperature detector 116 is disposed in the lower portion of the PCC 110A of the primary combustion furnace 110, detects the temperature $T_{1L}$ of the lower portion of the PCC 110A (referred to as "PCC lower portion temperature"), and outputs the detected temperature as a detected PCC lower portion temperature $T_{1L}$*. A fuel supply amount detector 114C which detects the supply amount of fuel $F_1$ to the PCC burner 114 (referred to as "PCC burner fuel supply amount) and which outputs the detected amount as a detected PCC burner fuel supply amount $F_1$* is disposed in the fuel supply pipe 114B and in the vicinity of the connection to the PCC burner 114. A valve apparatus 114D for adjusting the degree of opening or closing (i.e., open degree) of the fuel supply pipe 114B is disposed in the upper stream of the fuel supply amount detector 114C (i.e., in the side of the fuel tank 114A).

The secondary combustion furnace 120 comprises a combustion air supply pipe 121 one end of which opens in at least one portion of the SCC 120A, the other end of which is communicated with the combustion air supply 121A, and from which combustion air is introduced into the SCC 120A along a line parallel to a line that is in a section crossing the central axis and passes through the center of the section, so that a swirling flow is formed in the SCC 120A. A combustion air supply amount detector 121E which detects the total supply amount of combustion air $AIR_{TL}$ (referred to as "total combustion air supply amount") to the PCC 110A and SCC 120A from the combustion air supply 121A via the combustion air supply pipes 112 and 113, and 121, and which outputs the detected amount as the detected total combustion air supply amount $AIR_{TL}$* is disposed in the combustion air supply pipe 121 between the combustion air supply 121A and the valve apparatuses 112B and 113B. A valve apparatus 121F for adjusting the degree of opening or closing (i.e., open degree) of the combustion air supply pipe 121 to control the total supply amount of combustion air (i.e., total combustion air supply amount) $AIR_{TL}$ to the PCC 110A and SCC 120A is disposed in the upper stream of the combustion air supply amount detector 121E (i.e., in the side of the combustion air supply 121A). The valve apparatus 121F comprises a drive motor $121F_1$, and a control valve $121F_2$ which is inserted in the combustion air supply pipe 121 and which is operated by the drive motor $121F_1$, and an open degree detector $121F_3$ which is attached to the drive motor $121F_1$, which detects the opening position (defining the open degree) $AP_3$ of the control valve $121F_2$, and which outputs the detected value as a detected open degree $AP_3$*.

The secondary combustion furnace 120 further comprises an SCC burner 122. The SCC burner 122 is disposed at one end of the SCC 120A, communicated with the fuel tank 114A or the fuel supply pipe 114B via a fuel supply pipe 122A, and which is used for raising the ambient temperature of the SCC 120A so that a portion of unburnt dried sludge guided from the PCC 110A is burned to be converted into ash and combustion gas, and that the combustion heat generated in this burning causes the ash and the remaining portion of the unburnt dried sludge to be melted and converted into slag. A fuel supply amount detector 122B which detects the supply amount $F_2$ of fuel to the SCC burner 122 (referred to as "SCC burner fuel supply amount) and which outputs the detected amount as a detected SCC burner fuel supply amount $F_2$* is disposed in the fuel supply pipe 122A and in the vicinity of the connection to the SCC burner 122. A valve apparatus 122C for adjusting the degree of opening or closing (i.e., open degree) of the fuel supply pipe 122A is disposed in the upper stream of the fuel supply amount detector 122B (i.e., in the side of the fuel tank 114A). The valve apparatus 122C comprises a drive motor $122C_1$, and a control valve $122C_2$ which is inserted in the fuel supply pipe 122A and which is operated by the drive motor $122C_1$, and an open degree detector $122C_3$ which is attached to the drive motor $122C_1$, which detects the opening position (defining the open degree) $AP_4$ of the control valve $122C_2$, and which outputs the detected value as a detected open degree $AP_4$*.

The slag separation furnace 130 comprises an NOX concentration detector 131, an oxygen concentration detector 132 and a slag temperature detector 133. The NOX concentration detector 131 is disposed at the top of the slag separation chamber 130A (i.e., in a combustion gas guide passage), detects the NOX concentration of the combustion gas (referred to as "combustion gas NOX concentration") $CON_{NOX}$, and outputs the detected value as a detected combustion gas NOX concentration $CON_{NOX}$*. The oxygen concentration detector 132 is disposed at the top of the slag separation chamber 130A (i.e., in a combustion gas guide passage), detects the oxygen concentration of the combustion gas (referred to as "combustion gas oxygen concentration") $CON_{02}$, and outputs the detected value as a detected combustion gas oxygen concentration $CON_{02}$*. The slag temperature detector 133 is disposed in the lower portion of the slag separation chamber 130A (i.e., in the vicinity of the connection to the SCC 120A), detects the temperature $T_3$ of slag (referred to as "slag temperature") guided from the SCC 120A, and outputs the detected value as a detected slag temperature $T_3$*.

The controller 200 comprises a temperature correcting device 210 having first to fifth inputs which are respectively connected to the outputs of the PCC upper portion temperature detector 115, slag temperature detector 133, dried sludge supply amount detector 111D, combustion air supply amount detector 121E and oxygen concentration detector 132. The temperature correcting device 210 obtains a correction value (referred to as "corrected PCC upper portion temperature") $T_{1H}$** of the PCC upper temperature $T_{1H}$ (i.e., the detected PCC upper portion temperature $T_{1H}$*) detected by the PCC upper portion temperature detector 115, and also a correction value (referred to as "corrected slag temperature") $T_3$** of the slag temperature $T_3$ (i.e., the detected slag temperature $T_3$*) detected by the slag temperature detector 133 which is disposed in the slag separation chamber 130A, and outputs these corrected values.

The controller 200 further comprises a fuzzy controller 220 having first and second inputs which are respectively connected to first and second outputs of the temperature correcting device 210, and also having third to fifth inputs which are respectively connected to the outputs of the NOX concentration detector 131, oxygen concentration detector 132 and PCC lower portion temperature detector 116. The fuzzy controller 220 executes fuzzy inference on the basis of fuzzy rules held among fuzzy sets, a fuzzy set A relating to the PCC lower portion temperature $T_{1L}$, a fuzzy set B relating to the PCC upper portion temperature $T_{1H}$, a fuzzy set C relating to the combustion gas NOX concentration $CON_{NOX}$, a fuzzy set D relating to the combustion gas oxygen concentration $CON_{02}$, a fuzzy set E relating to the PCC upper combustion air supply amount $AIR_{1H}$, a fuzzy set F relating to the PCC lower combustion air supply amount $AIR_{1L}$, a fuzzy set G relating to the slag temperature $T_3$, a fuzzy set H relating to the SCC burner fuel supply amount $F_2$ and a fuzzy set I relating to the total combustion air supply amount $AIR_{TL}$. As a result of the fuzzy inference, the fuzzy controller 220 obtains the PCC upper combustion air supply amount $AIR_{1H}$, the PCC lower combustion air supply amount $AIR_{1L}$, the total combustion air supply amount $AIR_{TL}$ and the SCC burner fuel supply amount $F_2$, and outputs these amounts from first to fourth outputs as an inferred PCC upper combustion air supply amount $AIR_{1H}^f$, an inferred PCC lower combustion air supply amount $AIR_{1L}^f$, an inferred total combustion air supply amount $AIR_{TL}^f$ and an inferred SCC burner fuel supply amount $F_2^f$.

The fuzzy controller 220 comprises a fuzzy inference device 221 and another fuzzy inference device 222. The fuzzy inference device 221 has first to fourth inputs which are respectively connected to the output of the NOX concentration detector 131, the output of the PCC lower portion temperature detector 116, the first output of the temperature correcting device 210 and the output of the oxygen concentration detector 132. The fuzzy inference device 221 executes fuzzy inference on the basis of first fuzzy rules held among the fuzzy set A relating to the PCC lower portion temperature $T_{1L}$, the fuzzy set B relating to the PCC upper portion temperature $T_{1H}$, the fuzzy set C relating to the combustion gas NOX concentration $CON_{NOX}$, the fuzzy set D relating to the combustion gas oxygen concentration $CON_{02}$, the fuzzy set E relating to the PCC upper combustion air supply amount $AIR_{1H}$ and the fuzzy set F relating to the PCC lower combustion air supply amount $AIR_{1L}$. As a result of the fuzzy inference, in accordance with the detected PCC lower portion temperature $T_{1L}$*, the corrected PCC upper portion temperature $T_{1H}$**, the detected combustion gas NOX concentration $CON_{NOX}$* and the detected combustion gas oxygen concentration $CON_{02}$*, the fuzzy inference device 221 obtains the PCC upper combustion air supply amount $AIR_{1H}$ and the PCC lower combustion air supply amount $AIR_{1L}$, and outputs these obtained amounts from first and second outputs as the inferred PCC upper combustion air supply amount $AIR_{1H}^f$ and the inferred PCC lower combustion air supply amount $AIR_{1L}^f$. The other fuzzy inference device 222 has first and second inputs which are respectively connected to the output of the oxygen concentration detector 132 and the second output of the temperature correcting device 210. The other fuzzy inference device 222 executes fuzzy inference on the basis of a second fuzzy rule held among the fuzzy set D relating to the combustion gas oxygen concentration $CON_{O2}$, the fuzzy set G relating to the slag temperature $T_3$, the fuzzy set H relating to the SCC burner fuel supply amount $F_2$ and the fuzzy set I relating to the total combustion air supply amount $AIR_{TL}$. As a result of the fuzzy inference, in accordance with the corrected slag temperature $T_3$** and the detected combustion gas oxygen concentration $CON_{O2}$*, the other fuzzy inference device 222 obtains the total combustion air supply amount $AIR_{TL}$ and the SCC burner fuel supply amount $F_2$, and outputs these amounts from first and second outputs as the inferred total combustion air supply amount $AIR_{TL}^f$ and the inferred SCC burner fuel supply amount $F_2^f$.

The controller 200 further comprises a sequence controller 230 having first to fourth inputs which are respectively connected to the first to fourth outputs of the fuzzy controller 220 (i.e., the first and second outputs of the fuzzy inference device 221 and the first and second outputs of the fuzzy inference device 222), and fifth to eighth inputs which are respectively connected to the outputs of the combustion air supply amount detectors 112A, 113A and 121E and fuel supply amount detector 122B. The sequence controller 230 obtains a target PCC upper combustion air supply amount $AIR_{1H}^o$, a target PCC lower combustion air supply amount $AIR_{1L}^o$, a target total combustion air supply amount $AIR_{TL}^o$ and a target SCC burner fuel supply amount $F_2^o$, on the basis of the inferred PCC upper combustion air supply amount $AIR_{1H}^f$, the inferred PCC lower combustion air supply amount $AIR_{1L}^f$, the inferred total combustion air supply amount $AIR_{TL}^f$, the inferred SCC burner fuel supply amount $F_2f$, the detected PCC upper combustion air supply amount $AIR_{1H}$*, the detected PCC lower combustion air supply amount $AIR_{1L}$*, the detected total combustion air supply amount $AIR_{TL}$* and the detected SCC burner fuel supply amount $F_2$*. These obtained values are output from first to fourth outputs.

The controller 200 further comprises a PID controller 240 having first to fourth inputs which are respectively connected to the first to fourth outputs of the sequence controller 230, and also fifth to eighth inputs which are respectively connected to the outputs of the combustion air supply amount detectors 112A, 113A and 121E and fuel supply amount detector 122B for the SCC. The PID controller 240 also has first to fourth outputs which are respectively connected to the control terminals of the valve apparatuses 112B, 113B, 121F and 122C. The PID controller 240 generates a PCC upper combustion air supply amount control signal $AIR_{1HC}$, a PCC lower combustion air supply amount control signal $AIR_{1LC}$, a total combustion air supply amount control signal $AIR_{TLC}$ and an SCC burner fuel supply amount control signal $F_{2C}$ which are used for controlling the valve apparatuses 112B, 113B, 121F and 122C so as to attain the target PCC upper combustion air supply amount $AIR_{1H}^o$, the target PCC lower combustion air supply amount $AIR_{1L}^o$, the target total combustion air supply amount $AIR_{TL}^o$ and the target SCC burner fuel supply amount $F_2^o$. These control signals are output from the first to fourth outputs.

The PID controller 240 comprises a comparator 241A, a PID controller 241B, a comparator 241C and an open degree adjustor 241D. The comparator 241A has a noninverting input which is connected to the first output of the sequence controller 230, o and an inverting input which is connected to an output of the combustion air supply amount detector 112A. The comparator 241A obtains the difference (referred to as "controlled PCC upper combustion air supply amount") $AIR_{1H}^{o*}$ between the target PCC upper combustion air supply amount $AIR_{1H}^o$ and the detected PCC upper combustion air supply amount $AIR_{1H}$*. The PID controller 241B has an input connected to an output of the comparator 241A, and calculates an open degree (referred to as "target open degree") $AP_1^o$ of the valve apparatus 112B which corresponds to the controlled PCC upper combustion air supply amount $AIR_{1H}^{o*}$. The comparator 241C has a noninverting input which is connected to an output of the PID controller 241B, and an inverting input which is connected to an output of the open degree detector $112B_3$ of the valve apparatus 112B. The comparator 241C obtains the difference (referred to a "controlled open degree") $AP_1^{o*}$ between the target open degree $AP_1^o$ of the valve apparatus 112B and the detected open degree $AP_1$*. The open degree adjustor 241D has an input connected to an output of the comparator 241C, and an output connected to the control terminal of the drive motor $112B_1$ for the valve apparatus 112B. The open degree adjustor 241D generates the PCC upper combustion air supply amount control signal $AIR_{1HC}$ which corresponds to the controlled open degree $AP_1^{o*}$ and which is given to the drive motor $112B_1$ for the valve apparatus 112B.

Moreover, the PID controller 240 comprises a comparator 42A, a PID controller 242B, a comparator 242C and an open degree adjustor 242D. The comparator 242A has a noninverting input which is connected to the second output of the sequence controller 230, and an inverting input which is connected to an output of the combustion air supply amount detector 113A. The comparator 242A obtains the difference (referred to as "controlled PCC lower combustion air supply amount") $AIR_{1L}^{o*}$ between the target PCC lower combustion air supply amount $AIR_{1L}^o$ and the detected PCC lower combustion air supply amount $AIR_{1L}$*. The PID controller 242B has an input connected to an output of the comparator 242A, and calculates an open degree (referred to as "target open degree") $AP_2^o$ of the valve apparatus 113B which corresponds to the controlled PCC lower combustion air supply amount $AIR_{1L}^{o*}$. The comparator 242C has a noninverting input which is connected to an output of the PID controller 242B, and an inverting input which is connected to an output of the open degree detector $113B_3$ for the valve apparatus 113B. The comparator 242C obtains the difference (referred to as "controlled open degree") $AP_2^{o*}$ between the target open degree $AP_2^o$ of the valve apparatus 113B and the detected open degree $AP_2$*. The open degree adjustor 242D has an input connected to an output of the comparator 242C, and an output connected to the control terminal of the drive motor $113B_1$ for the valve apparatus 113B. The open degree adjustor 242D generates the PCC lower combustion air supply amount control signal $AIR_{1LC}$ which corresponds to the controlled open degree $AP_2^{o*}$ and which is given to the drive motor $113B_1$ for the valve apparatus 113B.

Moreover, the PID controller 240 comprises a comparator 243A, a PID controller 243B, a comparator 243C and an open degree adjustor 243D. The comparator 243A has a noninverting input which is connected to the third output of the sequence controller 230, and an inverting input which is connected to an output of the combustion air supply amount detector 121E. The comparator 243A obtains the difference (referred to as "controlled total combustion air supply amount") $AIR_{TL}^{o*}$ between the target total combustion air supply amount $AIR_{TL}^o$ and the detected total combustion air supply amount $AIR_{TL}$*. The PID controller 243B has an input connected to an output of the comparator 243A, and calculates an open degree (referred to as "target open degree") $AP_3^o$ of the valve apparatus 121F which corresponds to the controlled total combustion air supply amount $AIR_{TL}^{o*}$. The comparator 243C has a noninverting input which is connected to an output of the PID controller 243B, and an inverting input which is connected to an output of the open degree detector $121F_3$ for the valve apparatus 121F. The comparator 243A obtains the difference (referred to as "controlled open degree") $AP_3^{o*}$ between the target open degree $AP_3^o$ of the valve apparatus 121F and the detected open degree $AP_3$*. The open degree adjustor 243D has an input connected to an output of the comparator 243C, and an output connected to the control terminal of the drive motor $121F_1$ for the valve apparatus 121F. The open degree adjustor 243D generates the total combustion air supply amount control signal $AIR_{TLC}$ which corresponds to the controlled open degree $AP_3^{o*}$ and which is given to the drive motor $121F_l$ for the valve apparatus 121F.

Furthermore, the PID controller 240 comprises a comparator 244A, a PID controller 244B, a comparator 244C and an open degree adjustor 244D. The comparator 244A has a noninverting input which is connected to the fourth output of the sequence controller 230, and an inverting input which is connected to an output of the fuel supply amount detector 122B. The comparator 244A obtains the difference (referred to as "controlled SCC burner fuel supply amount") $F_2^{\circ *}$ between the target SCC burner fuel supply amount $F_2^{\circ}$ and the detected SCC burner fuel supply amount $F_2$*. The PID controller 244B has an input connected to an output of the comparator 244A, and calculates an open degree (referred to as "target open degree") $AP_4°$ of the valve apparatus 122C which corresponds to the controlled SCC burner fuel supply amount $F_2°$*. The comparator 244C has a noninverting input which is connected to an output of the PID controller 244B, and an inverting input which is connected to an output of the open degree detector $122C_3$ for the valve apparatus 122C. The comparator 244C obtains the difference (referred to as "controlled open degree") $AP_4°$* between the target open degree $AP_4°$ of the valve apparatus 122C and the detected open degree $AP_4$*. The open degree adjustor 244D has an input connected to an output of the comparator 244C, and an output connected to the control terminal of the drive motor $122C_1$ for the valve apparatus 122C. The open degree adjustor 244D generates the SCC burner fuel supply amount control signal $F_{2c}$ which corresponds to the controlled open degree $AP_4°$* and which is given to the drive motor $122C_1$ for the valve apparatus 122C.

The controller 200 further comprises a manual controller 250 and a display device 260. The manual controller 250 has first to fifth outputs which are respectively connected to the control terminals of the valve apparatuses 111E and 114D, air blower 111C, PCC burner 114 and SCC burner 122. When manually operated by the operator, the manual controller 250 generates a dried sludge supply amount control signal $D_C$ which is given to the valve apparatus 111E so that the dried sludge supply amount D for the PCC 110A is adequately adjusted, and a PCC burner fuel supply amount control signal $F_{1c}$ which is supplied to the valve apparatus t14D so that the PCC burner fuel supply amount $F_l$ for the PCC burner 114 is adequately adjusted, and gives a control signal $FN_c$ for activating the air blower 111C thereto, an ignition control signal $IG_1$ for igniting the PCC burner 114 thereto, and an ignition control signal $IG_2$ for igniting the SCC burner 122 thereto. The display device 260 has an input which is connected to at least one of the outputs of the dried sludge supply amount detector 111D, combustion air supply amount detectors 112A, 113A and 121E, fuel supply amount detectors 114C and 122B, PCC upper portion temperature detector 115, PCC lower portion temperature detector 116, NOX concentration detector 131, oxygen concentration detector 132 and slag temperature detector 133. The display device 260 displays at least one of the detected dried sludge supply amount D*, detected PCC upper combustion air supply amount $AIR_{1H}$*, detected PCC lower combustion air supply amount $AIR_{1L}$*, detected total combustion air supply amount $AIR_{TL}$*, detected PCC burner fuel supply amount $F_1$*, detected SCC burner fuel supply amount $F_2$*, detected PCC upper portion temperature $T_{1H}$*, detected PCC lower portion temperature $T_{1L}$*, detected combustion gas NOX concentration $CON_{NOX}$*, detected combustion gas oxygen concentration $CON_{02}$* and detected slag temperature $T_3$*.

Function of the First Embodiment

Next, referring to FIGS. 1 to 16, the function of the first embodiment of the dried sludge melting furnace of the invention will be described in detail.

Burning or melting of dried sludge

In the controller 200, in response to a manual operation conducted by the operator, the manual controller 250 generates the PCC burner fuel supply amount control signal $F_{1C}$ and the ignition control signal $IG_1$, and supplies them respectively to the valve apparatus 114D and the PCC burner 114. This causes an appropriate amount of fuel to be supplied from the fuel tank 114A to the PCC burner 114 via the fuel supply pipe 114B, the valve apparatus 114D and the PCC burner fuel supply amount detector 114C, and therefore the PCC burner 114 is ignited so that the ambient temperature of the PCC 110A is raised to a temperature necessary for burning or melting dried sludge. More specifically, the PCC upper portion temperature $T_{1H}$ detected by the PCC upper portion temperature detector 115 (i.e., the detected PCC upper portion temperature $T_{1H}$*) is made higher than about 1,100° C. in the view point of preventing a resultant material of the burning or melting of dried sludge from sticking to the inner wall of the PCC 110A to hinder the continuation of the swirling flow, and made lower than about 1,400° C. in the view point of sufficiently preventing the inner wall of the PCC 110A from being damaged. Preferably, the temperature is made about 1,200° to 1,300 ° C. The PCC lower portion temperature $T_{1L}$ detected by the PCC lower portion temperature detector 116 (i.e., the detected PCC lower portion temperature $T_{1L}$*) is made higher than about 1,100° C. in the view point of preventing a resultant material of the burning or melting of dried sludge from sticking to the inner wall of the PCC 110A to hinder the continuation of the swirling flow, and made lower than about 1,400° C. in the view point of sufficiently preventing the inner wall of the PCC 110A from being damaged. Both the PCC upper portion temperature $T_{1H}$ detected by the PCC upper portion temperature detector 115 and the PCC lower portion temperature $T_{1L}$ detected by the PCC lower portion temperature detector 116 (i.e., the detected PCC upper portion temperature $T_{1H}$* and the detected PCC lower portion temperature $T_{1L}$*) are sent to the controller 200. Similarly, the value of the PCC burner fuel supply amount $F_1$ detected by the PCC burner fuel supply amount detector 114C (i.e., the detected PCC burner fuel supply amount $F_1$*) is sent to the controller 200.

Then, in the controller 200, in response to a manual operation conducted by the operator, the manual controller 250 generates the dried sludge supply amount control signal $D_C$ and the control signal $FN_C$, and supplies them respectively to the valve apparatus 111E and the air blower 111C. This causes the degree of opening or closing of the valve apparatus 111E to be adequately adjusted, and the air blower 111C to start to operate. Therefore, dried sludge held in the dried sludge hopper 111A is mixed by the mixer 111B with combustion air supplied from the air blower 111C. Then the mixture is supplied to the valve apparatus 111E via the dried sludge supply pipe 111, and further supplied in a suitable amount to the upper portion of the PCC 110A via the dried sludge supply amount detector 111D as shown by broken line arrow X. The dried sludge supply amount detector 111D detects the supply amount of dried sludge (i.e., the dried sludge supply amount D) to the PCC 110A, and sends it as the detected dried sludge supply amount D* to the controller 200.

At this time, in the controller 200, the PID controller 240 gives the PCC upper combustion air supply amount control signal $AIR_{1HC}$ to the valve apparatus 112B, the PCC lower combustion air supply amount control signal $AIR_{1LC}$ to the valve apparatus 113B, and the total combustion air supply amount control signal $AIR_{TLC}$ to the valve apparatus 121F, thereby adequately adjusting the degrees of opening or closing of the valve apparatuses 112B, 113B and 121F. As shown by solid line arrows $Y_1$ and $Y_2$, therefore, combustion air is adequately supplied toward the upper and lower portions of the PCC 110A via the comubustion air supply pipes 121, 12lB, 112 and 113 and the combustion air supply amount detectors 112A, 113A and 121E. All the value of the PCC upper combustion air supply amount $AIR_{1H}$ detected by the combustion air supply amount detector 112A (i.e., the detected PCC upper combustion air supply amount $AIR_{1H}$*), the value of the PCC lower combustion air supply amount $AIR_{1L}$ detected by the combustion air supply amount detector 113A (i.e., the detected PCC lower combustion air supply amount $AIR_{1L}$*), and the value of the total combustion air supply amount $AIR_{TL}$ detected by the combustion air supply amount detector 121E (i.e., the detected total combustion air supply amount $AIR_{TL}$*) are sent to the controller 200.

In the PCC 110A, the supply of dried sludge from the dried sludge supply pipe 111 and that of combustion air from the con%bustion air supply pipes 112 and 113 cause the dried sludge and conmbustion air to form a swirling flow.

In the PCC 110A, as described above, the ambient temperature is kept within the temperature range necessary for burning or melting of dried sludge, and a sufficient amount of combustion air is supplied. Therefore, a portion of dried sludge falling with the swirling flow is burned to be converted into ash and conmbustion gas. A portion of unburnt dried sludge and the ash are melted and converted into slag by the combustion heat generated in this burning and the heat of the atmosphere, and then further fall down with the swirling flow.

The unburnt dried sludge, ash or slag, combustion gas and combustion air fall with the swirling flow into the lower portion of the PCC 110A, and are then guided to the vicinity of one end of the SCC 120A while maintaining the swirling flow.

Since the PID controller 240 gives the total combustion air supply amount control signal $AIR_{TLC}$ to the valve apparatus 121F as described above, in the SCC 120A, the degree of opening or closing of the valve apparatus 121F is adequately adjusted so that combustion air is supplied to the SCC 120A via the combustion air supply pipe 121. Accordingly, in the SCC 120A, the swirling flow guided from the PCC 110A is maintained so as to be further guided toward the slag separation chamber 130A.

Since the PID controller 240 gives the SCC burner fuel supply amount control signal $F_{2C}$ to the valve apparatus 122C and the manual controller 250 generates the ignition control signal $IG_2$ and gives it to the SCC burner 122, in the SCC 120A, an appropriate amount of fuel is supplied from the fuel tank 114A to the SCC burner 122 via the fuel supply pipes 114B and 122A, the valve apparatus 122C and the fuel supply amount detector 122B, so that the SCC burner 122 is ignited to raise the ambient temperature of the SCC 120A to a temperature necessary for burning or melting of dried sludge. More specifically, the ambient temperature of the SCC 120A is made higher than about 1,100° C. in the view point of preventing a resultant material of the burning or melting of dried sludge from sticking to the inner wall of the SCC 120A to hinder the continuation of the swirling flow, and made lower than about 1,400° C. in the view point of sufficiently preventing the inner wall of the SCC 120A from being damaged. This causes a portion of unburnt dried sludge guided with the swirling flow from the PCC 110A to be burned to be converted into ash and combustion gas. The remaining portion of the unburnt dried sludge and the ash are melted and converted into slag by the combustion heat generated in this burning and the heat of the atmosphere, and then further fall onto the bottom of the SCC 120A. Then the slag flows down toward the slag separation chamber 130A by gravity, or is guided with the swirling flow toward the chamber 130A. The value of the SCC burner fuel supply amount $F_C$ detected by the fuel supply amount detector 122B (i.e., the detected SCC burner fuel supply amount $F_C$*) is similarly given to the controller 200.

The slag falls or is guided with the swirling flow to the other end of the SCC 120A, and then guided into the slag separation chamber 130A. Thereafter, the slag is further guided with free fall toward the succeeding slag treating apparatus (not shown).

The combustion gas is guided with the swirling flow to the other end of the SCC 120A, and then guided into the slag separation chamber 130A. Thereafter, the combustion gas is moved to the upper portion of the slag separation chamber 130A and further guided toward the succeeding combustion gas treating apparatus (not shown).

In the slag separation chamber 130A, the NOX concentration detector 131 detects the concentration of nitrogen oxides in the combustion gas (i.e., the combustion gas NOX concentration $CON_{NOX}$), and outputs it as the detected combustion gas NOX concentration $CON_{NOX}$* to the controller 200.

In the slag separation chamber 130A, the oxygen concentration detector 132 detects the concentration of oxygen in the combustion gas (i.e., the combustion gas oxygen concentration $CON_{02}$), and outputs it as the detected combustion gas oxygen concentration $CON_{02}$* to the controller 200.

In the slag separation chamber 130A, moreover, the temperature of the slag supplied from the SCC 120A to the slag separation chamber 130A (i.e., the slag temperature $T_3$) is detected by the slag temperature detector 133, and outputs it as the detected slag temperature $T_3$* toward the controller 200.

Correction of the detected PCC upper portion temperature $T_{1H}$* and the detected slag temperature $T_3$*

The temperature correcting device 210 of the controller 200 corrects the detected value of the PCC upper portion temperature $T_{1H}$ (i.e., the detected PCC upper portion temperature $T_{1H}$*) sent from the PCC upper portion temperature detector 115, according to Ex. 1 or Ex. 4, and on the basis of the detected value of the PCC upper portion temperature $T_{1H}$ (i.e., the detected PCC upper portion temperature Thd 1H*) sent from the PCC upper portion temperature detector 115, the detected value of the dried sludge supply amount D (i.e., the detected dried sludge supply amount D*) sent from the dried sludge supply amount detector 111D, the detected value of the combustion gas oxygen concentration $CON_{02}$ (i.e., the detected combustion gas oxygen concentration $CON_{02}$*) sent from the oxygen concentration detector 132, and the detected value of the total combustion air supply amount $AIR_{TL}$ (i.e., the detected total combustion air supply amount $AIR_{TL}$*) sent from the combustion air supply amount detector 121E. The value is given as the corrected PCC upper portion temperature $T_{1H}^{}$ to the fuzzy inference device 221 of the fuzzy controller 220**.

[Ex. 1]

$$T_{1H}^{**}=T_{1H}^{*}+\Delta T$$

In Ex. 1, $\Delta T$ is a correction amount for the detected PCC upper portion temperature $T_{1H}^{*}$, and can be expressed by Ex. 2 using the slag pouring point $T_s$ and appropriate temperature correction coefficients a and b. The temperature correction coefficients a and b may be adequately determined on the basis of data displayed on the display device 260 and manually set to the temperature correcting device 210, or may be adequately determined in the temperature correcting device 210 on the basis of at least one of the detected PCC upper portion temperature $T_{1H}^{*}$, the detected slag temperature $T_3^{*}$, the detected dried sludge supply amount $D^{*}$, the detected combustion gas oxygen concentration $CON_{02}^{*}$ and the detected total combustion air supply amount $AIR_{TL}^{*}$ which are given to the temperature correcting device 210. Alternatively, the coefficients a and b may be suitably calculated by a temperature correction coefficient setting device (not shown) and then given to the temperature correcting device 210.

[Ex. 2]

$$\Delta T=a(T_s-b)$$

Using the detected combustion gas oxygen concentration $CON_{02}^{*}$, the detected total combustion air supply amount $AIR_{TL}^{*}$ the detected dried sludge supply amount $D^{*}$ and the water content W of dried sludge, the slag pouring point $T_s$ of Ex. 2 can be expressed by Ex. 3 as follows:

[Ex. 3]

$$T_s=1490-(21-CON_{02}^{*})\times AIR_{TL}^{*}\times 69\times 100/\{D^{*}(100-W)\times 21\}$$

Therefore, Ex. 1 can be modified as Ex. 4.

[Ex. 4]

$$T_{1H}^{**}=T_{1H}^{*}+a[1490-(21-CON_{02}^{*})\times AIR_{TL}^{*}\times 69\times 100/\{D^{*}(100-W)\times 21-b\}]$$

The temperature correcting device 210 of the controller 200 corrects the detected value of the slag temperature $T_3$ (i.e., the detected slag temperature $T_3^{*}$) sent from the slag temperature detector 133, according to Ex. 5 or Ex. 8, and on the basis of the detected value of the slag temperature $T_3$(i.e., the detected slag temperature $T_3^{*}$) sent from the slag temperature detector 133, the detected value of the dried sludge supply amount D (i.e., the detected dried sludge supply amount $D^{*}$) sent from the dried sludge supply amount detector 111D, the detected value of the combustion gas oxygen concentration $CON_{02}$ (i.e., the detected combustion gas oxygen concentration $CON_{02}^{*}$) sent from the oxygen concentration detector 132, and the detected value of the total combustion air supply amount $AIR_{TL}$ (i.e., the detected total combustion air supply amount $AIR_{TL}^{*}$) sent from the combustion air supply amount detector 121E. The value is given as the corrected slag temperature $T_3^{}$ to the fuzzy inference device 222 of the fuzzy controller 220**.

[Ex. 5]

$$T_3^{**}=T_3^{*}+\Delta T_{SL}$$

In Ex. 5, $T_{SL}$ is a correction amount for the detected slag temperature $T_3^{*}$, and can be expressed by Ex. 6 using the slag pouring point $T_s$ and appropriate temperature correction coefficients c and d. The temperature correction coefficients c and d may be adequately determined on the basis of data displayed on the display device 260 and manually set to the temperature correcting device 210, or may be adequately determined in the temperature correcting device 210 on the basis of at least one oi the detected PCC upper portion temperature $T_{1H}^{*}$, the detected slag temperature $T_3^{*}$, the detected dried sludge supply amount $D^{*}$, the detected combustion gas oxygen concentration $CON_{02}^{*}$ and the detected total combustion air supply amount $AIR_{TL}^{*}$ which are given to the temperature correcting device 210. Alternatively, the coefficients c and d may be suitably calculated by the temperature correction coefficient setting device (not shown) and then given to the temperature correcting device 210.

[Ex. 6]

$$\Delta T_{SL}=C(T_s-d)$$

Using the detected combustion gas oxygen concentration $CON_{02}^{*}$, the detected total combustion air supply amount $AIR_{TL}^{*}$ the detected dried sludge supply amount $D^{*}$ and the water content W of dried sludge, the slag pouring point $T_s$ of Ex. 6 can be expressed by Ex. 7 as follows:

[Ex. 7]

$$T_s=1490-(21-CON_{02}^{*})\times AIR_{TL}\times 69\times 100/\{D^{*}(100-W)\times 21\}$$

Therefore, Ex. 5 can be modified as Ex. 8.

[Ex. 8]

$$T_3^{}=T_3^{}+C[1490-(21-CON_{02}^{*})\times AIR_{TL}^{*}\times 69\times 100/\{D^{*}(100-W)\times 21-d\}]$$

Fuzzy inference

The fuzzy controller 220 of the controller 200 executes fuzzy inference as follows.

In accordance with the detected PCC lower portion temperature $T_{1L}^{*}$, the corrected PCC upper portion temperature $T_{1H}^{**}$, the detected combustion gas NOX concentration $CON_{NOX}^{*}$ and the detected combustion gas oxygen concentration $CON_{02}^{*}$, the fuzzy inference device 221 firstly executes the fuzzy inference to obtain the PCC upper combustion air supply amount $AIR_{1H}$ and the PCC lower combustion air supply amount $AIR_{1L}$, on the basis of fuzzy rules $f_{01}$ to $f_{30}$ shown in Table 1 below and held among the fuzzy set A relating to the PCC lower portion temperature $T_{1L}$, the fuzzy set B relating to the PCC upper portion temperature $T_{1H}$, the fuzzy set C relating to the combustion gas NOX concentration $CON_{NOX}$, the fuzzy set D relating to the combustion gas oxygen concentration $CON_{02}$, the fuzzy set E relating to the PCC upper combustion air supply amount $AIR_{1H}$ and the fuzzy set F relating to the PCC lower combustion air supply amount $AIR_{1L}$. These obtained amounts are given to the sequence controller 230 as the inferred PCC upper combustion air supply amount $AIR_{1H}^{f}$ and the inferred PCC lower combustion air supply amount $AIR_{1L}^{f}$, respectively.

[TABLE 1]

| FUZZY RULE | ANTECEDENT $T_{1L}$ | $T_{1H}$ | $CON_{NOX}$ | $CON_{O2}$ | CONSEQUENT $AIR_{1H}$ | $AIR_{1L}$ |
|---|---|---|---|---|---|---|
| $f_{01}$ | — | $NL_B$ | $ZR_C$ | — | $PS_E$ | $NS_F$ |
| $f_{02}$ | — | $NL_B$ | $PS_C$ | — | $PS_E$ | $NS_F$ |
| $f_{03}$ | — | $NL_B$ | $PM_C$ | — | $PS_E$ | $NS_F$ |
| $f_{04}$ | — | $NL_B$ | $PL_C$ | — | $PS_E$ | $NL_F$ |
| $f_{05}$ | — | $NS_B$ | — | — | $PS_E$ | $NS_F$ |
| $f_{06}$ | $ZR_A$ | $ZR_B$ | $ZR_C$ | — | $ZR_E$ | $ZR_F$ |
| $f_{07}$ | $PS_A$ | $ZR_B$ | $ZR_C$ | — | $ZR_E$ | $ZR_F$ |
| $f_{08}$ | $PL_A$ | $ZR_B$ | $ZR_C$ | — | $NS_E$ | $ZR_F$ |
| $f_{09}$ | $ZR_A$ | $ZR_B$ | $PS_C$ | — | $ZR_E$ | $NS_F$ |
| $f_{10}$ | $PS_A$ | $ZR_B$ | $PS_C$ | — | $ZR_E$ | $NS_F$ |
| $f_{11}$ | $PL_A$ | $ZR_B$ | $PS_C$ | — | $NS_E$ | $ZR_F$ |
| $f_{12}$ | — | $ZR_B$ | $PM_C$ | — | $NS_E$ | $ZR_F$ |
| $f_{13}$ | — | $ZR_B$ | $PL_C$ | — | $NS_E$ | $ZR_F$ |
| $f_{14}$ | $ZR_A$ | $PS_B$ | $ZR_C$ | — | $ZR_E$ | $ZR_F$ |
| $f_{15}$ | $PS_A$ | $PS_B$ | $ZR_C$ | — | $ZR_E$ | $ZR_F$ |
| $f_{16}$ | $PL_A$ | $PS_B$ | $ZR_C$ | — | $NS_E$ | $PS_F$ |
| $f_{17}$ | — | $PS_B$ | $PS_C$ | — | $NS_E$ | $ZR_F$ |
| $f_{18}$ | $ZR_A$ | $PS_B$ | $PM_C$ | — | $NS_E$ | $ZR_F$ |
| $f_{19}$ | $PS_A$ | $PS_B$ | $PM_C$ | — | $NS_E$ | $ZR_F$ |
| $f_{20}$ | $PL_A$ | $PS_B$ | $PM_C$ | — | $NL_E$ | $PS_F$ |
| $f_{21}$ | $ZR_A$ | $PS_B$ | $PL_C$ | — | $NS_E$ | $ZR_F$ |
| $f_{22}$ | $PS_A$ | $PS_B$ | $PL_C$ | — | $NS_E$ | $ZR_F$ |
| $f_{23}$ | $PL_A$ | $PS_B$ | $PL_C$ | — | $NL_E$ | $PS_F$ |
| $f_{24}$ | $ZR_A$ | $PL_B$ | — | — | $NS_E$ | $ZR_F$ |
| $f_{25}$ | $PS_A$ | $PL_B$ | $ZR_C$ | — | $NS_E$ | $ZR_F$ |
| $f_{26}$ | $PL_A$ | $PL_B$ | — | — | $NL_E$ | $PS_F$ |
| $f_{27}$ | $PS_A$ | $PL_B$ | $PS_C$ | — | $NS_E$ | $ZR_F$ |
| $f_{28}$ | $PS_A$ | $PL_B$ | $PM_C$ | — | $NL_E$ | $PS_F$ |
| $f_{29}$ | $PS_A$ | $PL_B$ | $PL_C$ | — | $NL_E$ | $PS_F$ |
| $f_{30}$ | — | — | — | $NL_D$ | — | $PS_F$ |

Antecedent

PCC lower portion temperature $T_{1L}$

PCC upper portion temperature $T_{1H}$

Combustion gas NOX concentration $CON_{NOX}$

Combustion gas oxygen concentration $CON_{02}$

Consequent

PCC upper conmbustion air supply amount $AIR_{1H}$

PCC lower combustion air supply amount $AIR_{1L}$

In accordance with the corrected slag temperature $T_3$** and the detected combustion gas oxygen concentration $CON_{02}$*, the fuzzy inference device 222 executes fuzzy inference to obtain the SCC burner fuel supply amount $F_2$ and the total combustion air supply amount $AIR_{TL}$, on the basis of fuzzy rules $g_1$ to $g_9$ which are shown in Table 2 below and held among the fuzzy set G relating to the slag temperature $T_3$, the fuzzy set D relating to the combustion gas oxygen concentration $CON_{02}$, the fuzzy set H relating to the SCC burner fuel supply amount $F_2$ and the fuzzy set I relating to the total combustion air supply amount $AIR_{TL}$. These obtained amounts are given to the sequence controller 230 as the inferred SCC burner fuel supply amount $F_2^f$ and the inferred total combustion air supply amount $AIR_{TL}^f$, respectively.

[TABLE 2]

| FUZZY RULE | ANTECEDENT $T_3$ | $CON_{O2}$ | CONSEQUENT $F_2$ | $AIR_{TL}$ |
|---|---|---|---|---|
| $g_1$ | $NL_G$ | — | $PL_H$ | — |
| $g_2$ | $NS_G$ | — | $PS_H$ | — |
| $g_3$ | $ZR_G$ | — | $ZR_H$ | — |
| $g_4$ | $PS_G$ | — | $NS_H$ | — |
| $g_5$ | — | $NL_D$ | — | $PL_I$ |
| $g_6$ | — | $NS_D$ | — | $PS_I$ |
| $g_7$ | — | $ZR_D$ | — | $ZR_I$ |
| $g_8$ | — | $PS_D$ | — | $NS_I$ |
| $g_9$ | — | $PL_D$ | — | $NL_I$ |

Combustion gas oxygen concentration $CON_{02}$

Consequent

SCC burner fuel supply amount $F_2$

Total combustion air supply amount $AIR_{TL}$

Figure 5A:
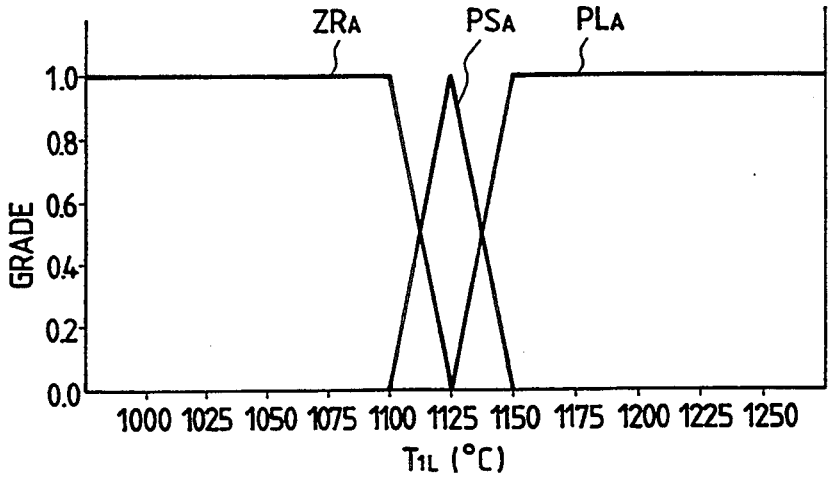
FIGS. 5A and 5A show graphs showing exemplified membership functions belonging to fuzzy sets which are used in fuzzy inference in the fuzzy controller 220 included in the controller 200 in accordance with the invention.
Figure 5B:
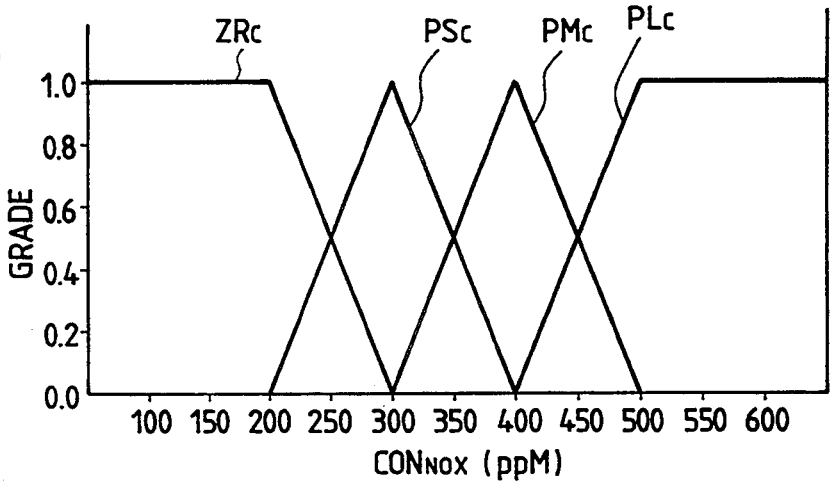
Figure 6A:
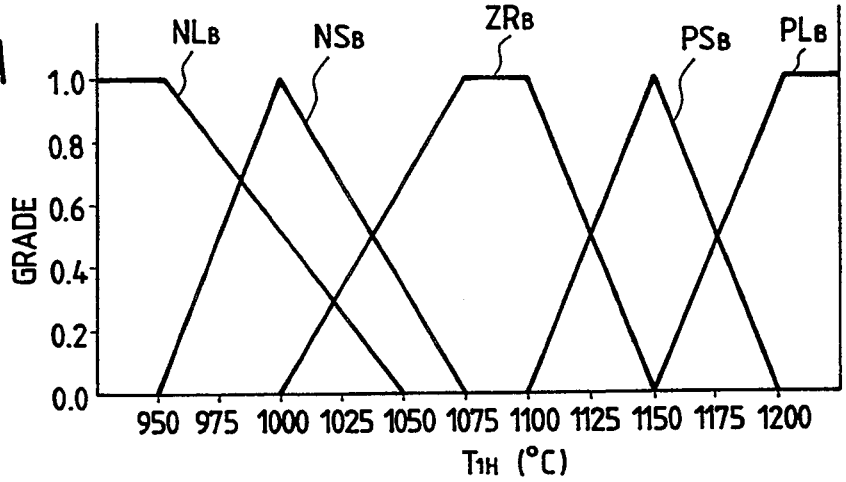
FIGS. 6A and 6B show graphs showing exemplified membership functions belonging to fuzzy sets which are used in fuzzy inference in the fuzzy controller 220 included in the controller 200 in accordance with the invention.
Figure 7A:
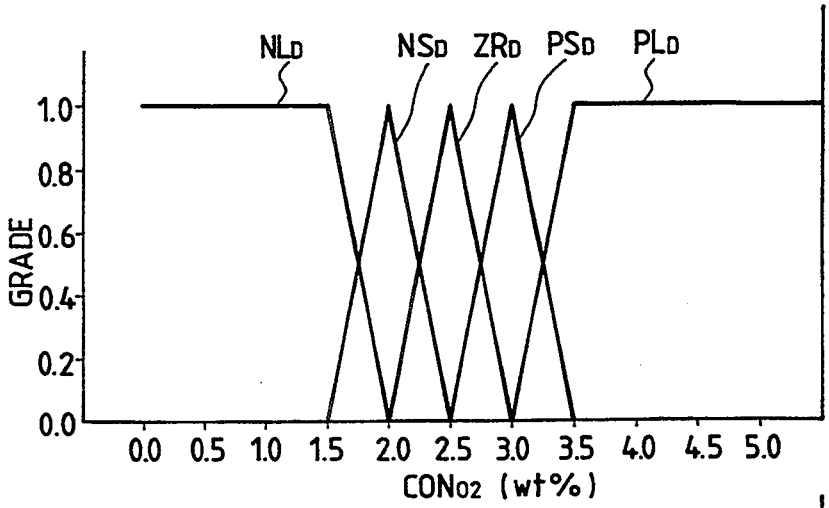
FIGS. 7A–7C show graphs showing exemplified membership functions belonging to fuzzy sets which are used in fuzzy inference in the fuzzy controller 220 included in the controller 200 in accordance with the invention.

When the detected PCC lower portion temperature $T_{1L}$* is 1,107° C., the corrected PCC upper portion temperature $T_{1H}$** is 1,210° C., the detected combustion gas NOX concentration $CON_{NOX}$* is 290 ppm and the detected combustion gas oxygen concentration $CON_{02}$* is 3.4 wt %, for example, the fuzzy inference device 221 obtains the grade of membership functions $ZR_A$, $PS_A$ and $PL_A$ of the fuzzy set A relating to the PCC lower portion temperature $T_{1L}$ and shown in FIG. 5A, the grade of membership functions $NL_B$, $NS_B$, $ZR_B$, $PS_B$ and $PL_B$ of the fuzzy set B relating to the PCC upper portion temperature $T_{1H}$ and shown in FIG. 6A, the grade of membership functions ZRc, PSc, PMc and PLc of the fuzzy set C relating to the combustion gas NOX concentration $CON_{NOX}$ and shown in FIG. 5B, and the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, as shown in FIGS. 9A to 9D and Table 3.

[TABLE 3]

| FUZZY RULE | ANTECEDENT $T_{1L}$ | | $T_{1H}$ | | $CON_{NOX}$ | | $CON_{O2}$ | |
|---|---|---|---|---|---|---|---|---|
| $f_{01}$ | — | — | $NL_B$ | 0.0 | $ZR_C$ | 0.09 | — | — |
| $f_{02}$ | — | — | $NL_B$ | 0.0 | $PS_C$ | 0.91 | — | — |
| $f_{03}$ | — | — | $NL_B$ | 0.0 | $PM_C$ | 0.0 | — | — |
| $f_{04}$ | — | — | $NL_B$ | 0.0 | $PL_C$ | 0.0 | — | — |
| $f_{05}$ | — | — | $NS_B$ | 0.0 | — | — | — | — |
| $f_{06}$ | $ZR_A$ | 0.68 | $ZR_B$ | 0.0 | $ZR_C$ | 0.09 | — | — |
| $f_{07}$ | $PS_A$ | 0.32 | $ZR_B$ | 0.0 | $ZR_C$ | 0.09 | — | — |
| $f_{08}$ | $PL_A$ | 0.0 | $ZR_B$ | 0.0 | $ZR_C$ | 0.09 | — | — |
| $f_{09}$ | $ZR_A$ | 0.68 | $ZR_B$ | 0.0 | $PS_C$ | 0.91 | — | — |
| $f_{10}$ | $PS_A$ | 0.32 | $ZR_B$ | 0.0 | $PS_C$ | 0.91 | — | — |
| $f_{11}$ | $PL_A$ | 0.0 | $ZR_B$ | 0.0 | $PS_C$ | 0.91 | — | — |
| $f_{12}$ | — | — | $ZR_B$ | 0.0 | $PM_C$ | 0.0 | — | — |
| $f_{13}$ | — | — | $ZR_B$ | 0.0 | $PL_C$ | 0.0 | — | — |
| $f_{14}$ | $ZR_A$ | 0.68 | $PS_B$ | 0.0 | $ZR_C$ | 0.09 | — | — |
| $f_{15}$ | $PS_A$ | 0.32 | $PS_B$ | 0.0 | $ZR_C$ | 0.09 | — | — |
| $f_{16}$ | $PL_A$ | 0.0 | $PS_B$ | 0.0 | $ZR_C$ | 0.09 | — | — |
| $f_{17}$ | — | — | $PS_B$ | 0.0 | $PS_C$ | 0.91 | — | — |
| $f_{18}$ | $ZR_A$ | 0.68 | $PS_B$ | 0.0 | $PM_C$ | 0.0 | — | — |
| $f_{19}$ | $PS_A$ | 0.32 | $PS_B$ | 0.0 | $PM_C$ | 0.0 | — | — |
| $f_{20}$ | $PL_A$ | 0.0 | $PS_B$ | 0.0 | $PM_C$ | 0.0 | — | — |
| $f_{21}$ | $ZR_A$ | 0.68 | $PS_B$ | 0.0 | $PL_C$ | 0.0 | — | — |
| $f_{22}$ | $PS_A$ | 0.32 | $PS_B$ | 0.0 | $PL_C$ | 0.0 | — | — |
| $f_{23}$ | $PL_A$ | 0.0 | $PS_B$ | 0.0 | $PL_C$ | 0.0 | — | — |
| $f_{24}$ | $ZR_A$ | 0.68 | $PL_B$ | 1.0 | — | — | — | — |
| $f_{25}$ | $PS_A$ | 0.32 | $PL_B$ | 1.0 | $ZR_C$ | 0.09 | — | — |
| $f_{26}$ | $PL_A$ | 0.0 | $PL_B$ | 1.0 | — | — | — | — |
| $f_{27}$ | $PS_A$ | 0.32 | $PL_B$ | 1.0 | $PS_C$ | 0.91 | — | — |
| $f_{28}$ | $PS_A$ | 0.32 | $PL_B$ | 1.0 | $PM_C$ | 0.0 | — | — |
| $f_{29}$ | $PS_A$ | 0.32 | $PL_B$ | 1.0 | $PL_C$ | 0.0 | — | — |
| $f_{30}$ | — | — | — | — | — | — | $NL_D$ | 0.0 |

Antecedent

PCC lower portion temperature $T_{1L}$

PCC upper portion temperature $T_{1H}$

Combustion gas NOX concentration $CON_{NOX}$

Combustion gas oxygen concentration $CON_{02}$

Note: The values in the table indicate compatibilities (grades).

With respect to each of the fuzzy rules $f_{01}$ to $f_{30}$, the fuzzy inference device 221 then compares the grade of membership functions $ZR_A$, $PS_A$ and $PL_A$ of the fuzzy set A relating to the PCC lower portion temperature $T_{1L}$ and shown in FIG. 5A the grade of membership functions $NL_B$, $NS_B$, $ZR_B$, $PS_B$ and $PL_B$ of the fuzzy set B relating to the PCC upper portion temperature $T_{1H}$ and shown in FIG. 6A, the grade of membership functions $ZR_C$, $PS_C$, $PM_C$ and $PL_C$ of the fuzzy set C relating to the combustion gas NOX concentration $CON_{NOX}$ and shown in FIG. 5B, and the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, with each other in FIGS. 9A to 9D and Table 3. The minimum one among them is set as shown in Table 4 as the grade of membership functions $NL_E$, $NS_E$, $ZR_E$, $PS_E$ and $PL_E$ of the fuzzy set E relating to the PCC upper combustion air supply amount $AIR_{1H}$ and shown in FIG. 7B, and also as the grade of membership functions $NL_F$, $NS_F$, $ZR_F$, $PS_F$ and $PL_F$ of the fuzzy set F relating to the PCC lower combustion air supply amount $AIR_{1L}$ and shown in FIG. 7C.

| FUZZY RULE | CONSEQUENT | | | |
|---|---|---|---|---|
| | $AIR_{1H}$ | | $AIR_{1L}$ | |
| $f_{01}$ | $PS_E$ | 0.0 | $NS_F$ | 0.0 |
| $f_{02}$ | $PS_E$ | 0.0 | $NS_F$ | 0.0 |
| $f_{03}$ | $PS_E$ | 0.0 | $NS_F$ | 0.0 |
| $f_{04}$ | $PS_E$ | 0.0 | $NL_F$ | 0.0 |
| $f_{05}$ | $PS_E$ | 0.0 | $NS_F$ | 0.0 |
| $f_{06}$ | $ZR_E$ | 0.0 | $ZR_F$ | 0.0 |
| $f_{07}$ | $ZR_E$ | 0.0 | $ZR_F$ | 0.0 |
| $f_{08}$ | $NS_E$ | 0.0 | $ZR_F$ | 0.0 |
| $f_{09}$ | $ZR_E$ | 0.0 | $NS_F$ | 0.0 |
| $f_{10}$ | $ZR_E$ | 0.0 | $NS_F$ | 0.0 |
| $f_{11}$ | $NS_E$ | 0.0 | $ZR_F$ | 0.0 |
| $f_{12}$ | $NS_E$ | 0.0 | $ZR_F$ | 0.0 |
| $f_{13}$ | $NS_E$ | 0.0 | $ZR_F$ | 0.0 |
| $f_{14}$ | $ZR_E$ | 0.0 | $ZR_F$ | 0.0 |
| $f_{15}$ | $ZR_E$ | 0.0 | $ZR_F$ | 0.0 |
| $f_{16}$ | $NS_E$ | 0.0 | $PS_F$ | 0.0 |
| $f_{17}$ | $NS_E$ | 0.0 | $ZR_F$ | 0.0 |
| $f_{18}$ | $NS_E$ | 0.0 | $ZR_F$ | 0.0 |
| $f_{19}$ | $NS_E$ | 0.0 | $ZR_F$ | 0.0 |
| $f_{20}$ | $NL_E$ | 0.0 | $PS_F$ | 0.0 |
| $f_{21}$ | $NS_E$ | 0.0 | $ZR_F$ | 0.0 |
| $f_{22}$ | $NS_E$ | 0.0 | $ZR_F$ | 0.0 |
| $f_{23}$ | $NL_E$ | 0.0 | $PS_F$ | 0.0 |
| $f_{24}$ | $NS_E$ | 0.68 | $ZR_F$ | 0.68 |
| $f_{25}$ | $NS_E$ | 0.09 | $ZR_F$ | 0.09 |
| $f_{26}$ | $NL_E$ | 0.0 | $PS_F$ | 0.0 |
| $f_{27}$ | $NS_E$ | 0.32 | $ZR_F$ | 0.32 |
| $f_{28}$ | $NL_E$ | 0.0 | $PS_F$ | 0.0 |
| $f_{29}$ | $NL_E$ | 0.0 | $PS_F$ | 0.0 |
| $f_{30}$ | — | — | $PS_F$ | 0.0 |

Consequent

PCC upper combustion air supply amount $AIR_{1H}$

PCC lower combustion air supply amount $AIR_{1L}$

Note: The values in the table indicate compatibilities (grades).

Figure 7B:
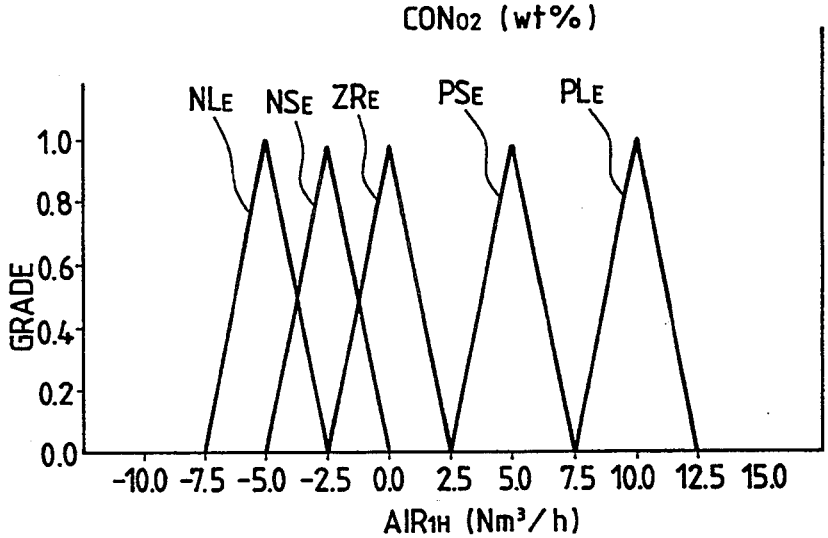
Figure 10A:
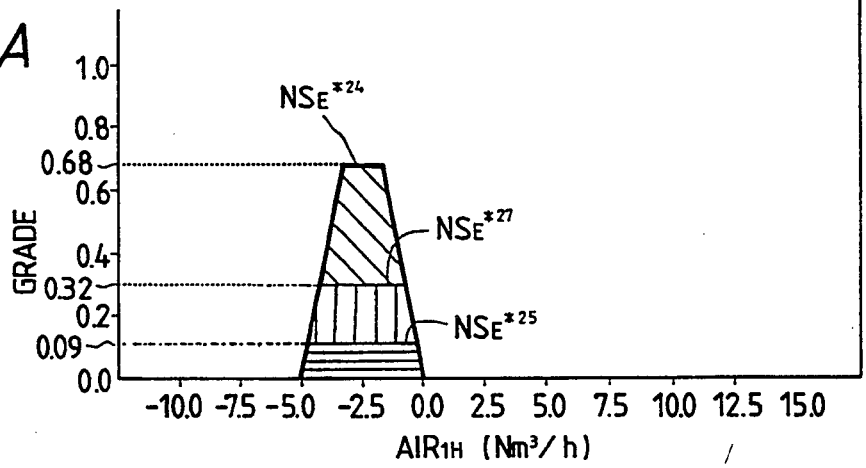
FIGS. 10A and 10B show graphs showing an example of fuzzy inference which is performed in the fuzzy inference device 222 of the fuzzy controller 220 included in the controller 200 in accordance with the invention.

With respect to the fuzzy rules $f_{01}$ to $f_{30}$, the fuzzy inference device 221 modifies the membership functions $NL_E$, $NS_E$, $ZR_E$, $PS_E$ and $PL_E$ of the fuzzy set E relating to the PCC upper combustion air supply amount $AIR_{1H}$ and shown in FIG. 7B to stepladder-like or trapezoidal membership functions $NS_E^{*24}$, $NS_E^{*25}$ and $NS_E^{*27}$ which are cut at the grade positions indicated in Table 4 (see FIG. 10A). In FIG. 10A, cases where the grade is 0.0 are not shown.

The fuzzy inference device 221 calculates the center of gravity of the hatched area enclosed by the stepladder-like membership functions $NS_E^{*24}$, $NS_E^{*25}$ and $NS_E^{*27}$ which have been produced in the above-mentioned process, as shown in FIG. 10A, and outputs its abscissa of $-2.5$ $Nm^3/h$ to the sequence controller 230 as the inferred PCC upper combustion air supply amount (in this case, the corrected value for the current value) $AIR_{1H}^f$.

Figure 7C:
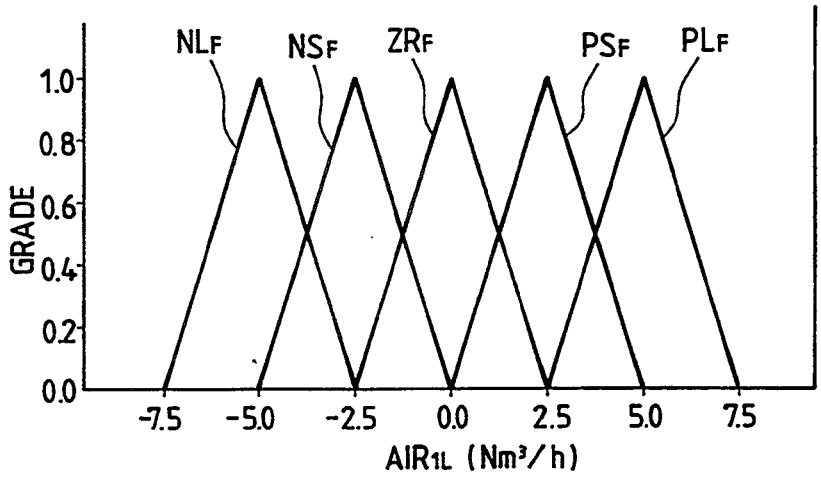
Figure 10B:
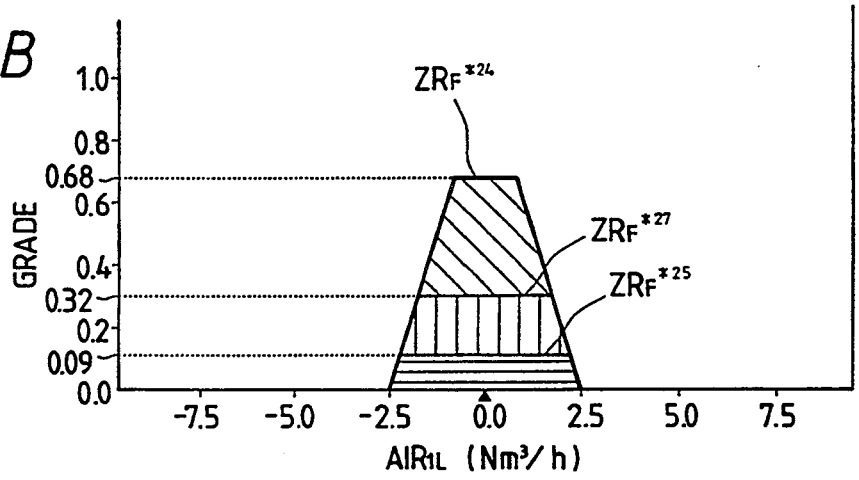

With respect to the fuzzy rules $f_{01}$ to $f_{30}$, the fuzzy inference device 221 further modifies the membership functions $NL_F$, $NS_F$, $ZR_F$, $PS_F$ and $PL_F$ of the fuzzy set F relating to the PCC lower combustion air supply amount $AIR_{1L}$ and shown in FIG. 7C to stepladder-like membership functions $ZR_F^{*24}$, $ZR_F^{*25}$ and $ZR_F^{*27}$ which are cut at the grade positions indicated in Table 4 (see FIG. 10B). In FIG. 10B, cases where the grade is 0.0 are not shown.

The fuzzy inference device 221 calculates the center of gravity of the hatched area enclosed by the stepladder-like membership functions $ZR_F^{*24}$, $ZR_F^{*25}$ and $ZR_F^{*27}$ which have been produced in the above-mentioned process, as shown in FIG. 10B, and outputs its abscissa of 0.0 $Nm^3/h$ to the sequence controller 230 as the inferred PCC lower combustion air supply amount (in this case, the corrected value for the current value) $AIR_{1L}^f$.

Figure 6B:
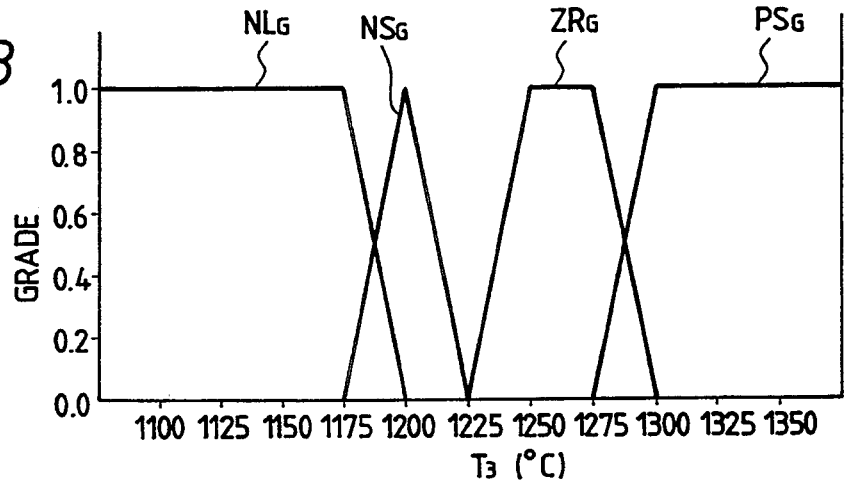
Figure 11A:
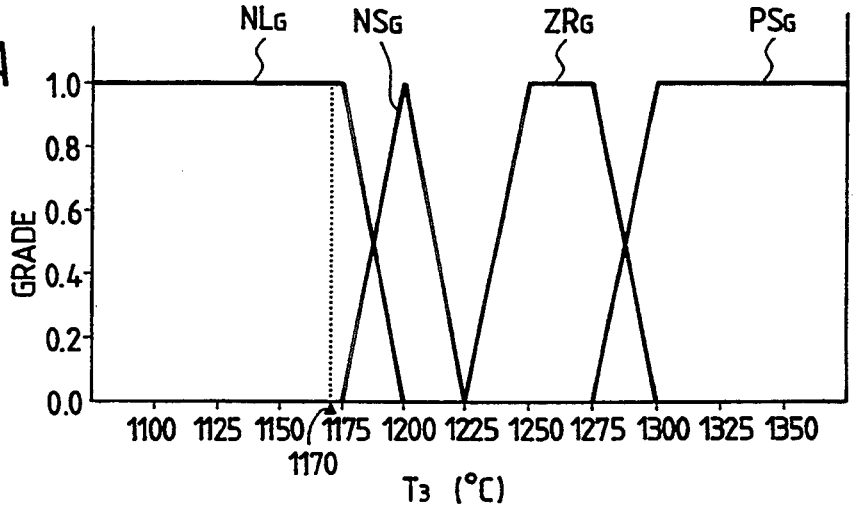
FIGS. 11A and 11B show graphs showing an example of fuzzy inference which is performed in the fuzzy inference device 222 of the fuzzy controller 220 included in the controller 200 in accordance with the invention.
Figure 11B:
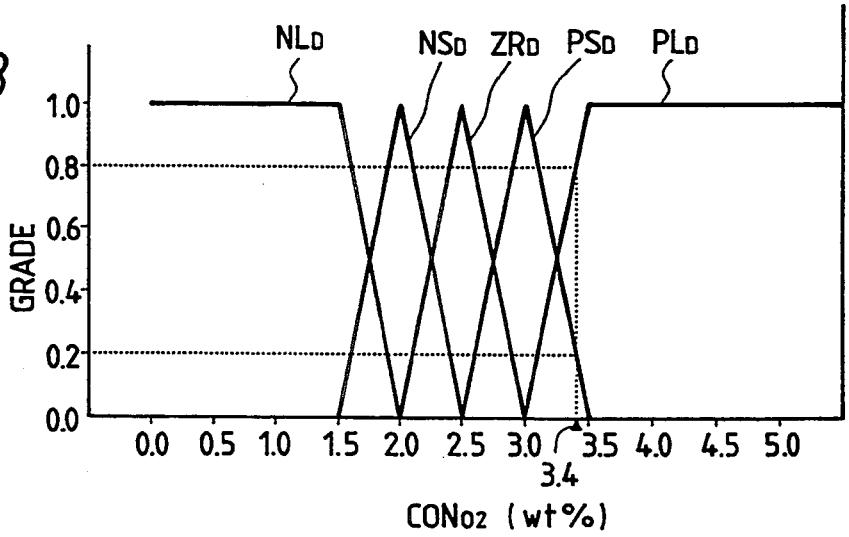

When the corrected slag temperature $T_3$** is 1,170 C and the detected combustion gas oxygen concentration $CON_{02}$* is 3.4 wt. %, for example, the fuzzy inference device 222 obtains the grade of membership functions $NL_G$, $NS_G$, $ZR_G$ and $PS_G$ of the fuzzy set G relating to the slag temperature $T_3$ and shown in FIG. 6B, and the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, as shown in FIGS. 11A and 11B and Table 5.

[TABLE 5]

| FUZZY RULE | ANTECEDENT | | | | CONSEQUENT | | | |
|---|---|---|---|---|---|---|---|---|
| | $T_3$ | | $CON_{02}$ | | $F_2$ | | $AIR_{TL}$ | |
| $g_1$ | $NL_G$ | 1.0 | — | — | $PL_H$ | 1.0 | $NS_I$ | — |
| $g_2$ | $NS_G$ | 0.0 | — | — | $PS_H$ | 0.0 | $ZR_I$ | — |
| $g_3$ | $ZR_G$ | 0.0 | — | — | $ZR_H$ | 0.0 | $ZR_I$ | — |
| $g_4$ | $PS_G$ | 0.0 | — | — | $NS_H$ | 0.0 | $ZR_I$ | — |
| $g_5$ | — | — | $NL_D$ | 0.0 | — | — | $PL_I$ | 0.0 |
| $g_6$ | — | — | $NS_D$ | 0.0 | — | — | $PS_I$ | 0.0 |
| $g_7$ | — | — | $ZR_D$ | 0.0 | — | — | $ZR_I$ | 0.0 |
| $g_8$ | — | — | $PS_D$ | 0.2 | — | — | $NS_I$ | 0.2 |
| $g_9$ | — | — | $PL_D$ | 0.8 | — | — | $NL_I$ | 0.8 |

Antecedent

Slag temperature $T_3$

Combustion gas oxygen concentration $CON_{02}$

Consequent

SCC burner fuel supply amount $F_2$

Total combustion air supply amount $AIR_{TL}$

With respect to each of the fuzzy rules $g_1$ to $g_9$, the fuzzy inference device 222 then compares the grade of membership functions $NL_G$, $NS_G$, $ZR_G$ and $PS_G$ of the fuzzy set G relating to the slag temperature $T_3$ and shown in FIG. 6B with the grade of membership functions $NL_D$, $NS_D$, $ZR_D$, $PS_D$ and $PL_D$ of the fuzzy set D relating to the combustion gas oxygen concentration $CON_{02}$ and shown in FIG. 7B, in FIGS. 11A and 11B and Table 5. The minimum one of them is set as shown in Table 5 as the grade of membership functions $NL_H$, $NS_H$, $ZR_H$, $PS_H$ and $PL_H$ of the fuzzy set H relating to the fuzzy set H relating to the SCC burner fuel supply amount $F_2$ and shown in FIG. 8A, and as the grade of membership functions $NL_I$, $NS_I$, $ZR_I$, $PS_I$ and $PL_I$ of the fuzzy set I relating to the total combustion air supply amount $AIR_{TL}$ and shown in FIG. 8B.

Figure 8A:
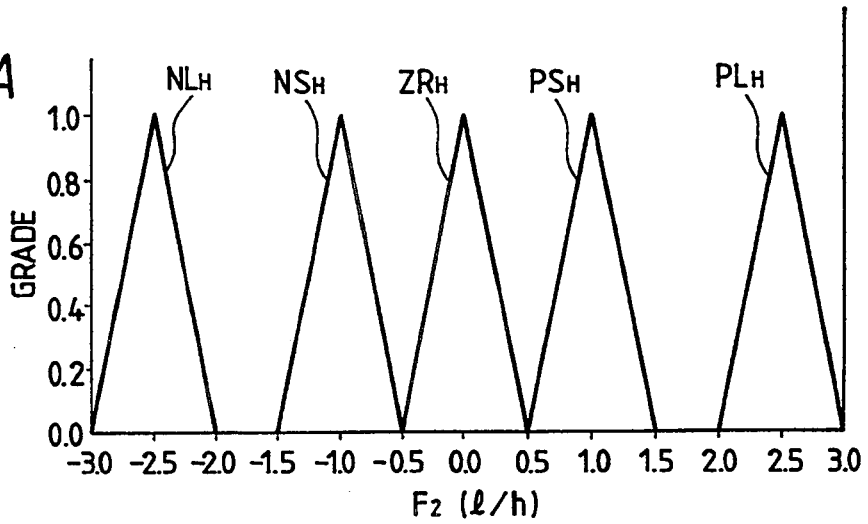
FIGS. 8A and 8B show graphs showing exemplified membership functions belonging to fuzzy sets which are used in fuzzy inference performed in the fuzzy controller 220 included in the controller 200 in accordance with the invention.
Figure 12A:
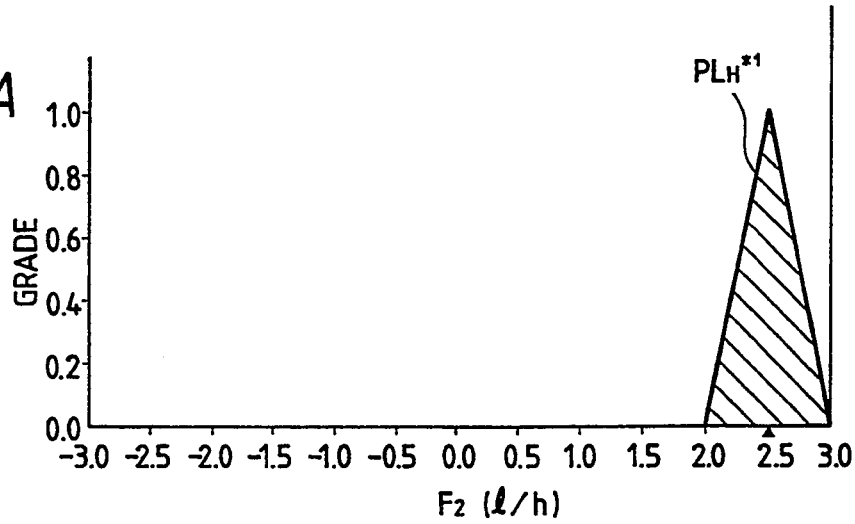
FIGS. 12A and 12B show graphs showing an example of fuzzy inference which is performed in the fuzzy inference device 222 of the fuzzy controller 220 included in the controller 200 in accordance with the invention.

With respect to the fuzzy rules $g_1$ to $g_9$, the fuzzy inference device 222 modifies the membership functions $NL_H$, $NS_H$, $ZR_H$, $PS_H$ and $PL_H$ of the fuzzy set H relating to the SCC burner fuel supply amount $F_2$ and shown in FIG. 8A to a stepladder-like (in this case, triangular) membership function $PL_H^{*1}$ which is cut at the grade position indicated in Table 5 (see FIG. 12A). In FIG. 12A, cases where the grade is 0.0 are not shown.

The fuzzy inference device 222 calculates the center of gravity of the hatched area enclosed by the stepladder-like membership function $PL_H^{*1}$ which has been produced in the above-mentioned process, as shown in FIG. 12A, and outputs its abscissa of 2.5 liter/h to the sequence controller 230 as the inferred SCC combustion fuel supply amount (in this case, the corrected value for the current value) $F_2^f$.

Figure 8B:
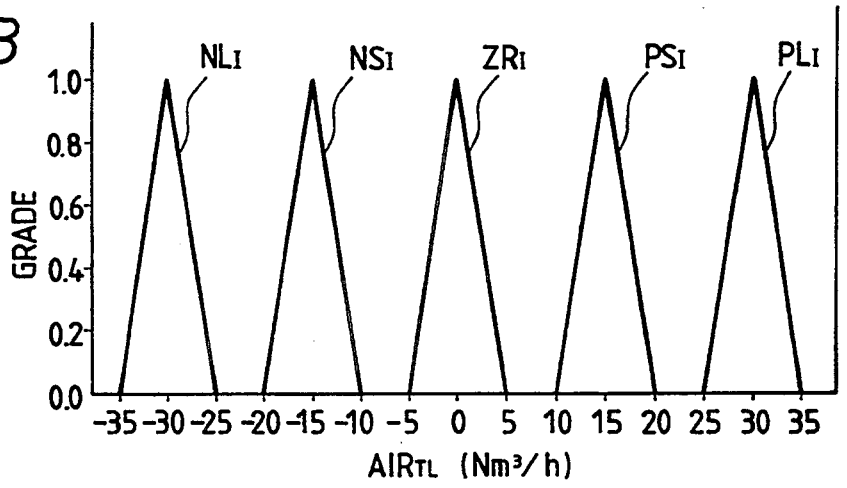
Figure 9A:
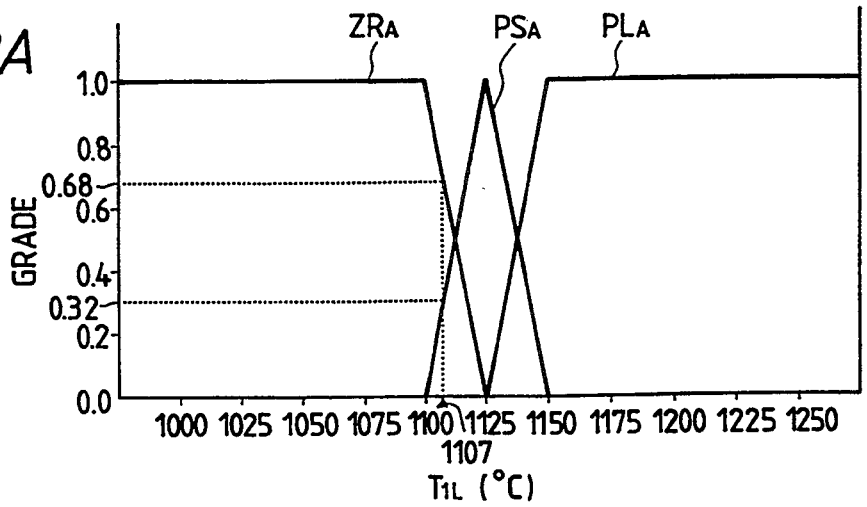
FIGS. 9A–9D show graphs showing an example of fuzzy inference which is performed in a fuzzy inference device 221 of the fuzzy controller 220 included in the controller 200 in accordance with the invention.
Figure 9B:
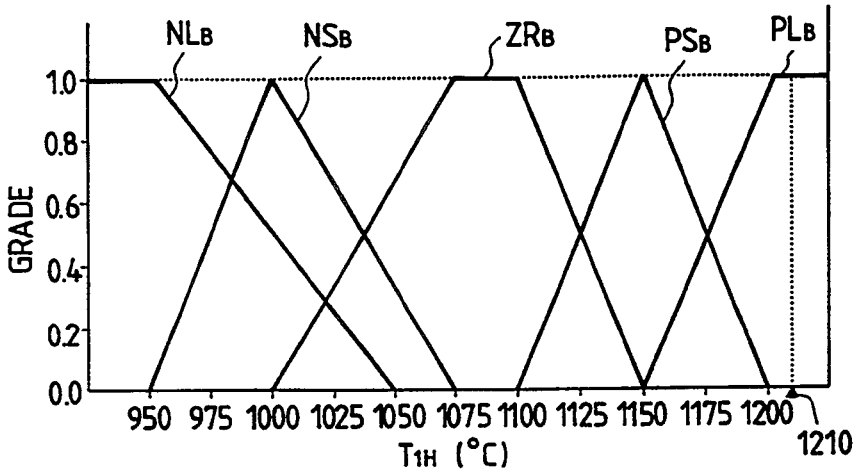
Figure 9C:
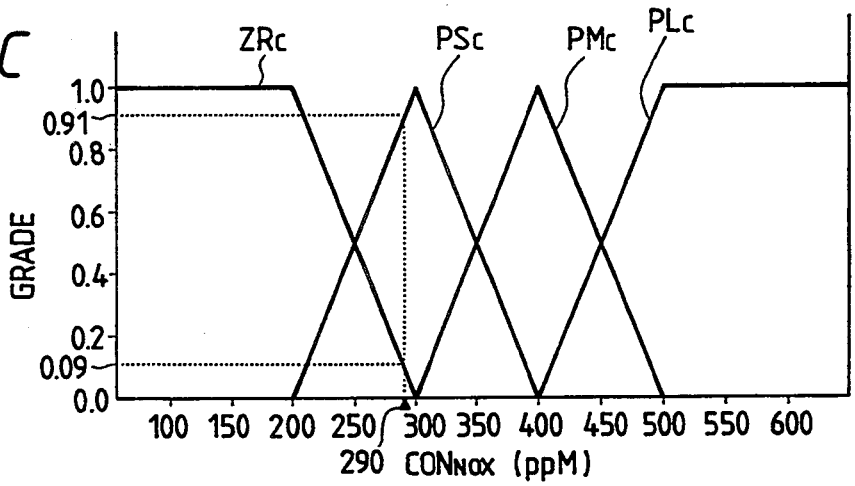
Figure 9D:
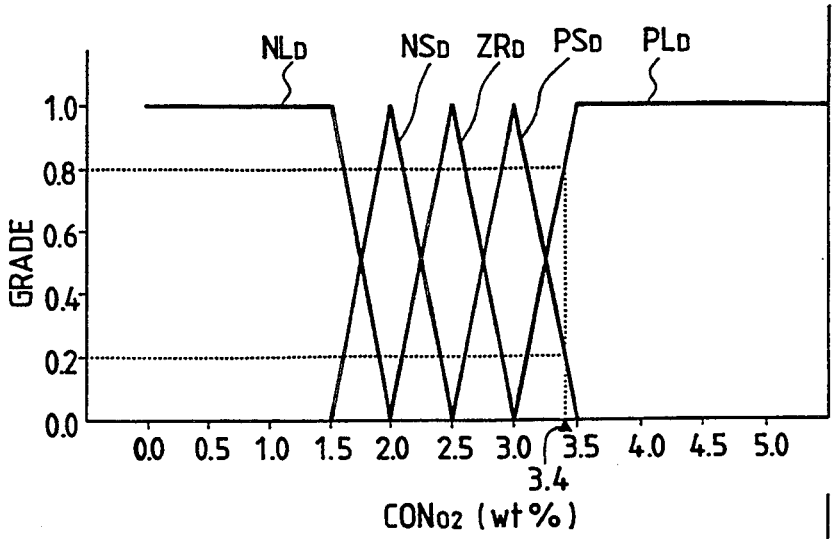
Figure 12B:
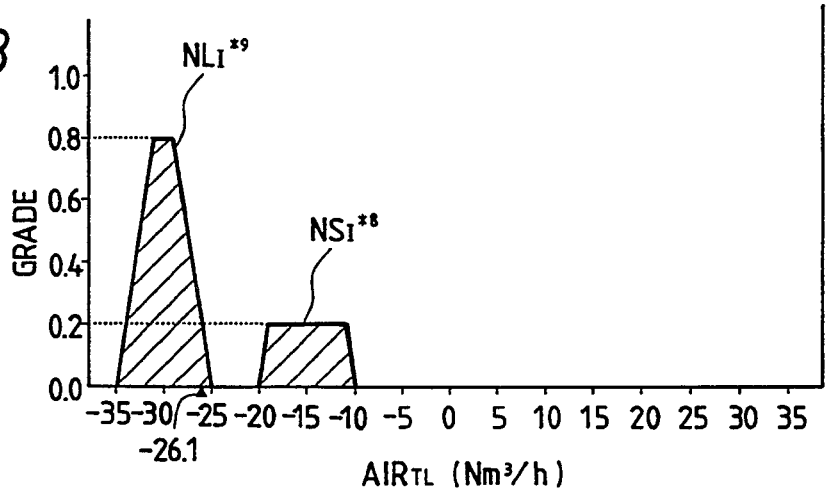

With respect to the fuzzy rules $g_1$ to $g_9$, the fuzzy inference device 222 further modifies the membership functions $NL_I$, $NS_I$, $ZR_I$, $PS_I$ and $PL_I$ of the fuzzy set I relating to the total combustion air supply amount $AIR_{TL}$ and shown in FIG. 8B to stepladder-like membership functions $NS_I^{*8}$ and $NL_I^{*9}$ which are cut at the grade positions indicated in Table 5 (see FIG. 12B). In FIG. 12B, cases where the grade is 0.0 are not shown.

The fuzzy inference device 222 calculates the center of gravity of the hatched area enclosed by the stepladder-like membership functions $NS_I^{*8}$ and $NL_I^{*9}$ which have been produced in the above-mentioned process, as shown in FIG. 12B, and outputs its abscissa of −26.1 $Nm^3/h$ to the sequence controller 230 as the inferred total combustion air supply amount (in this case, the corrected value for the current value) $AIR_{TL}^f$.

In the fuzzy inference performed in the fuzzy inference device 221, fuzzy rules $h_{01}$ to $h_{16}$ shown in Table 6 may be employed instead of the fuzzy rules $f_{01}$ to $f_{30}$ shown in Table 1. When the fuzzy rules $h_{01}$ to $h_{16}$ are employed, the fuzzy inference device 221 performs the fuzzy inference in the same manner as described above, and therefore, for the sake of convenience, its detail description is omitted.

[TABLE 6]

| FUZZY | ANTECEDENT | | | | CONSEQUENT | |
|---|---|---|---|---|---|---|
| RULE | $T_{1L}$ | $T_{1H}$ | $CON_{NOX}$ | $CON_{O2}$ | $AIR_{1H}$ | $AIR_{1L}$ |
| $h_{01}$ | $ZR_A$ | $NL_B$ | $ZR_C$ | — | $PS_E$ | $NS_F$ |
| $h_{02}$ | $PS_A$ | $NL_B$ | $ZR_C$ | — | $PS_E$ | $NS_F$ |
| $h_{03}$ | $PL_A$ | $NL_B$ | $ZR_C$ | — | $PS_E$ | $NS_F$ |
| $h_{04}$ | $ZR_A$ | $PL_B$ | $ZR_C$ | — | $NS_E$ | $ZR_F$ |
| $h_{05}$ | $PS_A$ | $PL_B$ | $ZR_C$ | — | $NS_E$ | $ZR_F$ |
| $h_{06}$ | $PL_A$ | $PL_B$ | $ZR_C$ | — | $NL_E$ | $PS_F$ |
| $h_{07}$ | $ZR_A$ | $PL_B$ | $PS_C$ | — | $NS_E$ | $ZR_F$ |
| $h_{08}$ | $PS_A$ | $PL_B$ | $PS_C$ | — | $NS_E$ | $ZR_F$ |
| $h_{09}$ | $PL_A$ | $PL_B$ | $PS_C$ | — | $NL_E$ | $PS_F$ |
| $h_{10}$ | $ZR_A$ | $PL_B$ | $PM_C$ | — | $NS_E$ | $ZR_F$ |
| $h_{11}$ | $PS_A$ | $PL_B$ | $PM_C$ | — | $NL_E$ | $PS_F$ |
| $h_{12}$ | $PL_A$ | $PL_B$ | $PM_C$ | — | $NL_E$ | $PS_F$ |
| $h_{13}$ | $ZR_A$ | $PL_B$ | $PL_C$ | — | $NS_E$ | $ZR_F$ |
| $h_{14}$ | $PS_A$ | $PL_B$ | $PL_C$ | — | $NL_E$ | $PS_F$ |
| $h_{15}$ | $PL_A$ | $PL_B$ | $PL_C$ | — | $NL_E$ | $PS_F$ |
| $h_{16}$ | — | — | — | $NL_D$ | — | $PS_F$ |

Antecedent

PCC lower portion temperature $T_{1L}$

PCC upper portion temperature $T_{1H}$

Combustion gas NOX concentration $CON_{NOX}$

Combustion gas oxygen concentration $CON_{02}$

Consequent

PCC upper combustion air supply amount $AIR_{1H}$

PCC lower combustion air supply amount $AIR_{1L}$

Sequence control

The sequence controller 230 obtains mean values in a desired time period of the inferred PCC upper combustion air supply amount $AIR_{1H}^f$, the inferred PCC lower combustion air supply amount $AIR_{1L}^f$, the inferred SCC combustion fuel supply amount $F_2^f$ and the inferred total combustion air supply amount $AIR_{TL}^f$, in accordance with the inferred PCC upper combustion air supply amount $AIR_{1H}^f$ and inferred PCC lower combustion air supply amount $AIR_{1L}^f$ given from the fuzzy inference device 221 of the fuzzy controller 220, the inferred SCC burner fuel supply amount $F_2^f$ and inferred total combustion air supply amount $AIR_{TL}^f$ given from the fuzzy inference device 222 of the fuzzy controller 220, the detected total combustion air supply amount $AIR_{TL}^*$ given from the combustion air supply amount detector 121E, the detected PCC upper combustion air supply amount $AIR_{1H}^*$ given from the combustion air supply detector 112A, the detected PCC lower combustion air supply amount $AIR_{1L}^*$ given from the combustion air supply amount detector 113A and the detected SCC burner fuel supply amount $F_2^*$ given from the fuel supply amount detector 122B. The obtained values are respectively output to the PID controller 240 as the target PCC upper combustion air supply amount $AIR_{1H}^\circ$, the target PCC lower combustion air supply amount $AIR_{1L}^\circ$, the target total combustion air supply amount $AIR_{TL}^\circ$ and the target SCC burner fuel supply amount $F_2^\circ$.

PID control

The PID controller 240 generates the following control signals as described below: the PCC upper combustion air supply amount control signal $AIR_{1HC}$ in order to change the PCC upper combustion air supply amount $AIR_{1H}$; the PCC lower combustion air supply amount control signal $AIR_{1LC}$ in order to adjust the PCC lower combustion air supply amount $AIR_{1L}$; the total combustion air supply amount control signal $AIR_{TLC}$ in order to adjust the total combustion air supply amount $AIR_{TL}$; and the SCC burner fuel supply amount control signal $F_{2C}$ in order to adjust the SCC burner fuel supply amount signal $F_2$, in accordance with the target PCC upper combustion air supply amount $AIR_{1H}^\circ$, target PCC lower combustion air supply amount $AIR_{1L}^\circ$, target total combustion air supply amount $AIR_{TL}^\circ$ and target SCC burner fuel supply amount $F_2^\circ$ given from the sequence controller 230, the detected total combustion air supply amount $AIR_{TL}^*$ given from the combustion air supply amount detector 121E, the detected PCC upper combustion air supply amount $AIR_{1H}^*$ given from the combustion air supply amount detector 112A, the detected PCC lower combustion air supply amount $AIR_{1L}^*$ given from the combustion air supply amount detector 113A, and the detected SCC burner fuel supply amount $F_2^*$ given from the fuel supply amount detector 122B. The PID controller 240 gives the generated signals to the valve apparatuses 112B, 113B, 121F and 122C, respectively.

In the PID controller 240, firstly, the comparator 241A compares the target PCC upper combustion air supply amount $AIR_{1B}^\circ$ given from the sequence controller 230 with the detected PCC upper combustion air supply amount $AIR_{1H}^*$ given from the combustion air supply amount detector 112A. The result of the comparison, or a correcting value $AIR_{1H}^{\circ *}$ of the PCC upper combustion air supply amount $AIR_{1H}$ is given to the PID controller 241B. In the PID controller 241B, an appropriate calculation corresponding to the correcting value $AIR_{1H}^{\circ *}$ of the PCC upper combustion air supply amount $AIR_{1H}$ is executed to obtain a correcting open degree $AP_1^\circ$ of the valve apparatus 112B. The comparator 241C compares the correcting open degree $AP_1^\circ$ with the detected open degree $AP_1^*$ given from the open degree detector $112B_3$ of the valve apparatus 112B. The result of the comparison is given to the open degree adjustor 241D as a changing open degree $AP_1°*$ of the control valve $112B_2$ of the valve apparatus 112B. The open degree adjustor 241D generates the PCC upper combustion air supply amount control signal $AIR_{1HC}$ in accordance with the changing open degree $AP_1°*$ and gives it to the drive motor $112B_1$ for the valve apparatus 112B. In response to this, the drive motor $112B_1$ suitably changes the open degree of the control valve $112B_2$ so as to change the PCC upper combustion air supply amount $AIR_{1H}$ supplied to the upper portion of the PCC 110A, to a suitable value.

In the PID controller 240, then, the comparator 242A compares the target PCC lower combustion air supply amount $AIR_{1L}°$ given from the sequence controller 230 with the detected PCC lower combustion air supply amount $AIR_{1L}*$ given from the combustion air supply amount detector 113A. The result of the comparison, or a correcting value $AIR_{1L}°*$ of the PCC lower combustion air supply amount $AIR_{1L}$ is given to the PID controller 242B. In the PID controller 242B, an appropriate calculation corresponding to the correcting value $AIR_{1L}°*$ of the PCC lower combustion air supply amount $AIR_{1L}$ is executed to obtain a correcting open degree $AP_2°$ of the valve apparatus 113B. The comparator 242C compares the correcting open degree $AP_2°$ with the detected open degree $AP_2*$ given from the open degree detector $113B_3$ of the valve apparatus 113B. The result of the comparison is given to the open degree adjustor 242D as a changing open degree $AP_2°*$ of the control valve $113B_2$ of the valve apparatus 113B. The open degree adjustor 242D generates the PCC lower combustion air supply amount control signal $AIR_{1LC}$ in accordance with the changing open degree $AP_2°*$ and gives it to the drive motor $113B_1$ for the valve apparatus 113B. In response to this, the drive motor $113B_1$ suitably changes the open degree of the control valve $113B_2$ so as to change the PCC lower combustion air supply amount $AIR_{1L}$ supplied to the lower portion of the PCC 110A, to a suitable value.

In the PID controller 240, moreover, the comparator 243A compares the target total combustion air supply amount $AIR_{TL}°$ given from the sequence controller 230 with the detected total combustion air supply amount $AIR_{TL}*$ given from the combustion air supply amount detector 121E. The result of the comparison, or a correcting value $AIR_{TL}°*$ of the total combustion air supply amount $AIR_{TL}$ is given to the PID controller 243B. In the PID controller 243B, an appropriate calculation corresponding to the correcting value $AIR_{TL}°*$ of the total combustion air supply amount $AIR_{TL}$ is executed to obtain a correcting open degree $AP_3°$ of the valve apparatus 121F. The comparator 243C compares the correcting open degree $AP_3°$ with the detected open degree $AP_3*$ given from the open degree detector $121F_3$ of the valve apparatus 121F. The result of the comparison is given to the open degree adjustor 243D as a changing open degree $AP_3°*$ of the control valve $121F_2$ of the valve apparatus 121F. The open degree adjustor 243D generates the total combustion air supply amount control signal $AIR_{TLC}$ in accordance with the changing open degree $AP_3°*$ and gives it to the drive motor $121F_1$ for the valve apparatus 121F. In response to this, the drive motor $121F_1$ suitably changes the open degree of the control valve $121F_2$ so as to change the total combustion air supply amount $AIR_{TL}$ supplied to the PCC 110A and SCC 120A, to a suitable value.

In the PID controller 240, furthermore, the comparator 244A compares the target SCC burner fuel supply amount $F_2°$ given from the sequence controller 230 with the detected SCC burner fuel supply amount $F_2*$ given from the burner fuel supply amount detector 122B. The result of the comparison, or a correcting value $F_2°*$ of the SCC burner fuel supply amount $F_2$ is given to the PID controller 244B. In the PID controller 244B, an appropriate calculation corresponding to the correcting value $F_2°*$ of the SCC burner fuel supply amount $F_2$ is executed to obtain a correcting open degree $AP_4°$ of the valve apparatus 122C. The comparator 244C compares the correcting open degree $AP_4°$ with the detected open degree $AP_4*$ given from the open degree detector $122C_3$ of the valve apparatus 122C. The result of the comparison is given to the open degree adjustor 244D as a changing open degree $AP_4°*$ of the control valve $122C_2$ of the valve apparatus 122C. The open degree adjustor 244D generates the SCC burner fuel supply amount control signal $F_{2C}$ in accordance with the changing open degree $AP_4°*$ and gives it to the drive motor $122C_1$ for the valve apparatus 122C. In response to this, the drive motor $122C_1$ suitably changes the open degree of the control valve $122C_2$ so as to change the SCC burner fuel supply amount $F_2$ supplied to the SCC burner 122, to a suitable value.

Specific example of the control

Figure 13:
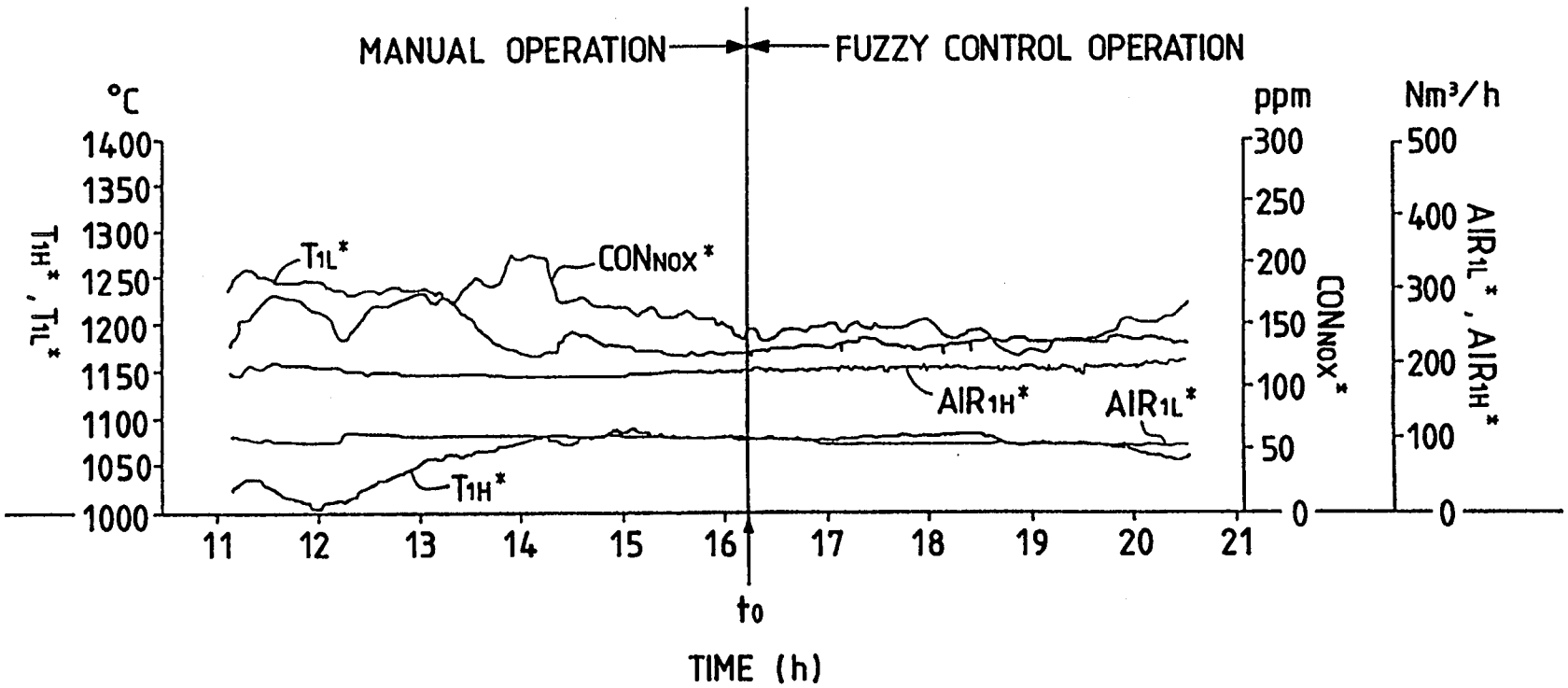
FIG. 13 shows a graph specifically illustrating the operation of the first embodiment of FIG. 1, and particularly showing effects which are given on a detected PCC upper portion temperature $T_{1H}$*, detected PCC lower portion temperature $T_{1L}$*, detected PCC upper combustion air supply amount $AIR_{1H}$*, detected PCC lower combustion air supply amount $AIR_{1L}$* and detected combustion gas NOX concentration $CON_{NOX}$* when the manner of operation is changed at time $t_0$ from a conventional manual operation to a fuzzy control operation according to the invention.
Figure 14:
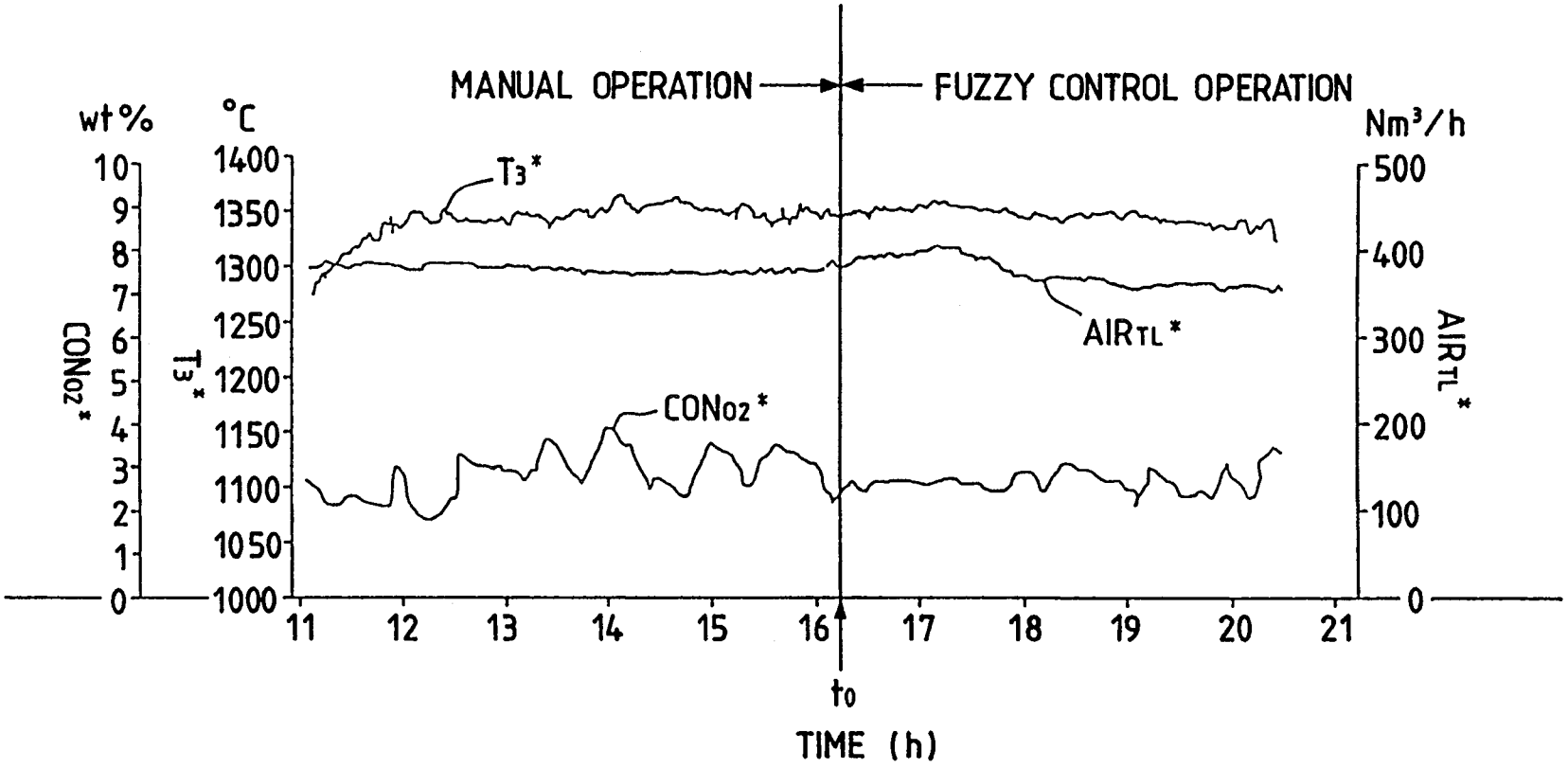
FIG. 14 shows a graph specifically illustrating the operation of the first embodiment of FIG. 1, and particularly showing effects which are given on a detected slag temperature $T_3$*, detected combustion gas oxygen concentration $CON_{02}$* and detected total combustion air supply amount $AIR_{TL}$* when the manner of operation is changed at time $t_0$ from a conventional manual operation to a fuzzy control operation according to the invention.
Figure 15:
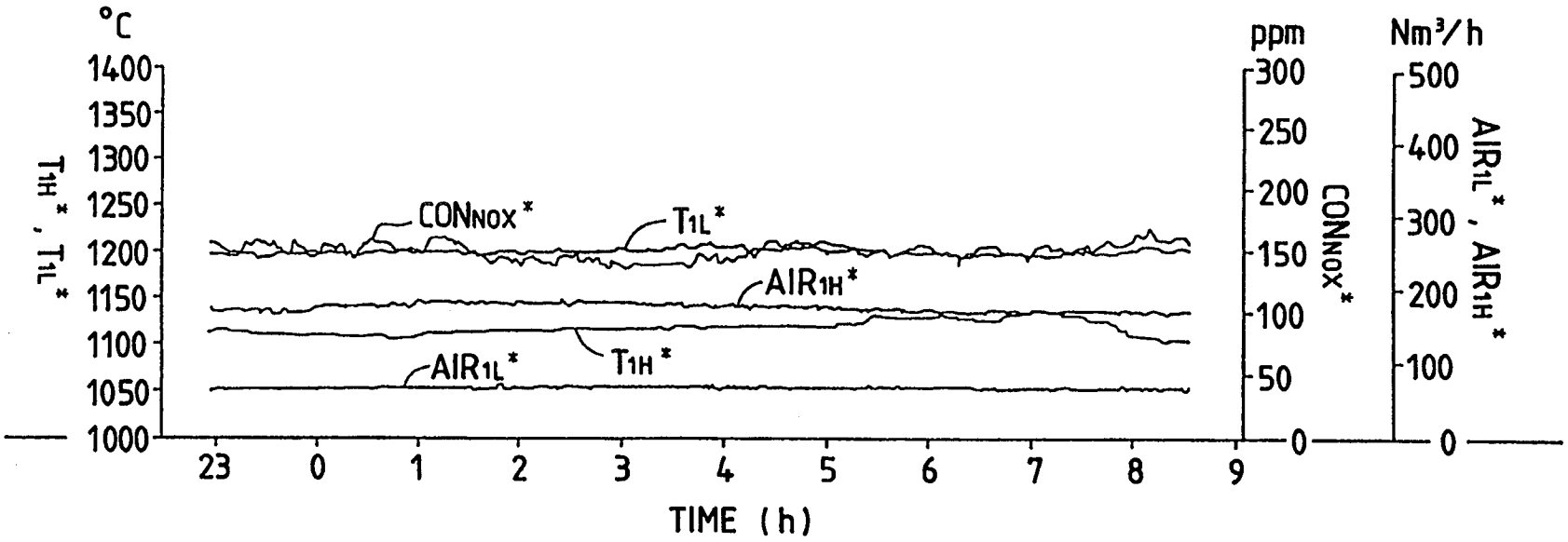
FIG. 15 shows a graph specifically illustrating the operation of the first embodiment of FIG. 1, and particularly showing the correlation between the detected PCC upper portion temperature $T_{1H}$*, detected PCC lower portion temperature $T_{1L}$*, detected PCC upper combustion air supply amount $AIR_{1L}$*, detected PCC lower combustion air supply amount $AIR_{1L}$* and detected combustion gas NOX concentration $CON_{NOX}$* which correlation is obtained when the fuzzy control operation according to the invention is continued after that of FIGS. 13 and 14.
Figure 16:
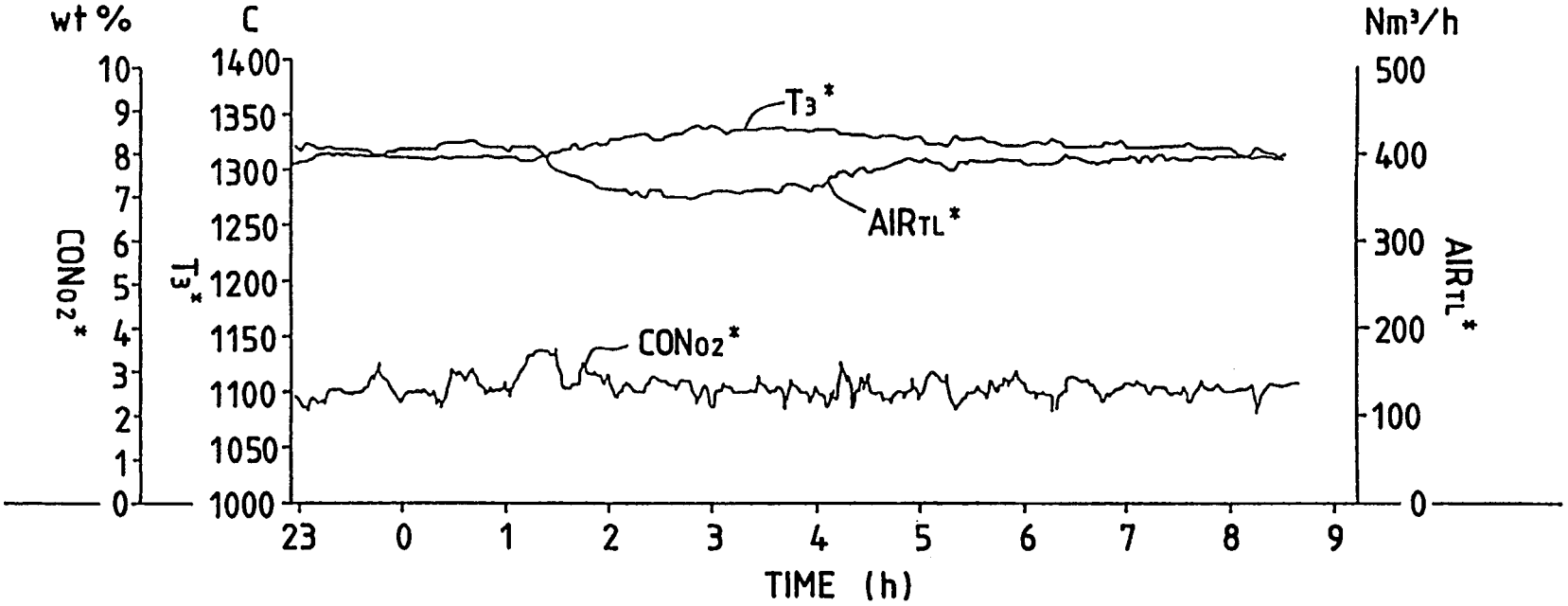
FIG. 16 shows a graph specifically illustrating the operation of the first embodiment of FIG. 1, and particularly showing the correlation between detected total combustion air supply amount $AIR_{TL}$*, detected slag temperature $T_3$* and detected combustion gas oxygen concentration $CON_{02}$* which correlation is obtained when the fuzzy control operation according to the invention is continued after that of FIGS. 13 and 14.
Figures 17, 18, 19:
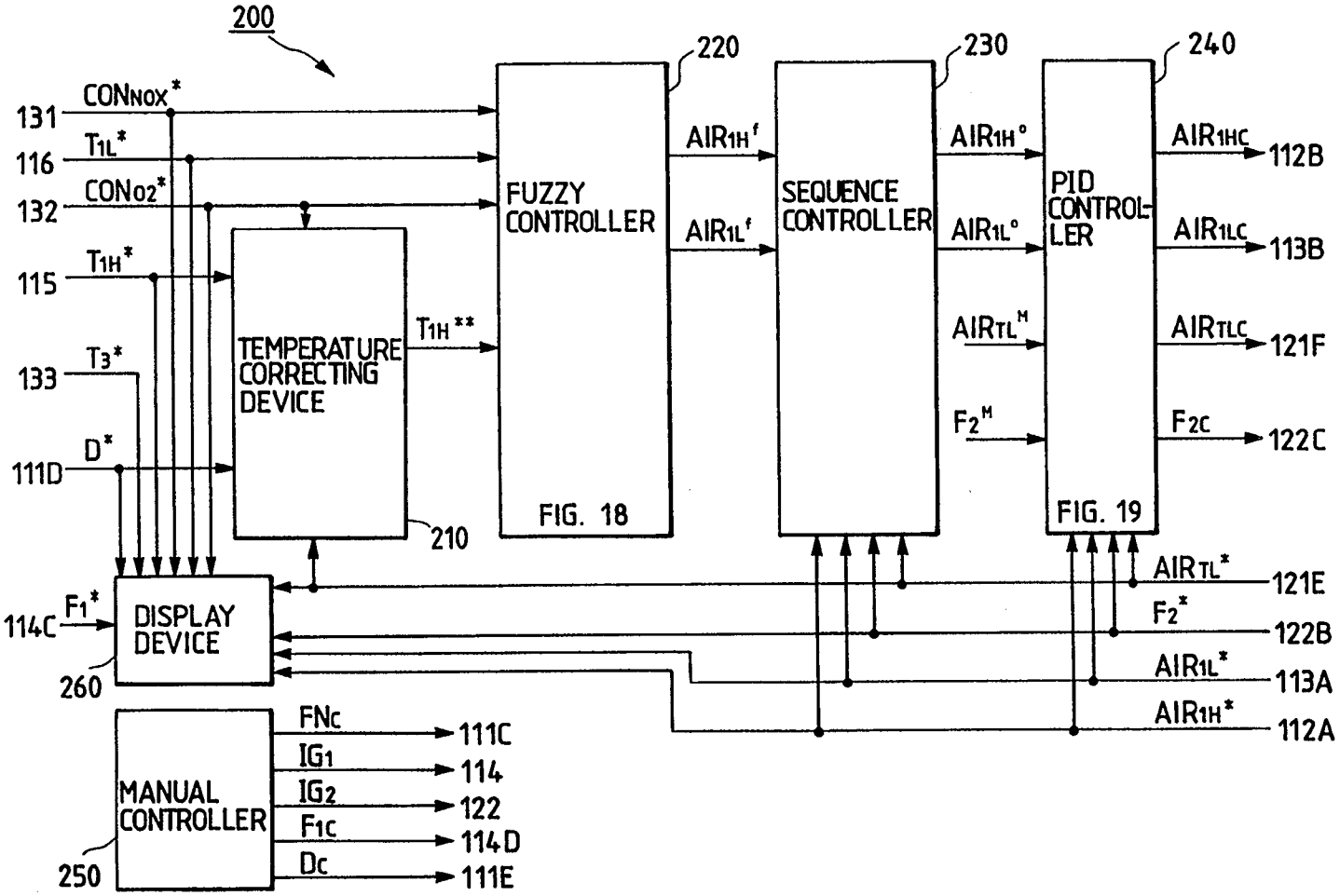
FIG. 17 is a block diagram illustrating one portion of the second embodiment of FIG. 1 on an enlarged scale, and particularly showing the controller 200 in detail.
FIG. 18 is a block diagram illustrating one portion of the block diagram of FIG. 17 on an enlarged scale, and particularly showing in detail the fuzzy controller 220 included in the controller 200.
FIG. 19 is a block diagram commonly illustrating on an enlarged scale one portion of the block diagram of FIG. 17 and one portion of the block diagram of FIG. 32, and particularly showing in detail the PID controller 240 included in the controller 200.
Figure 18:
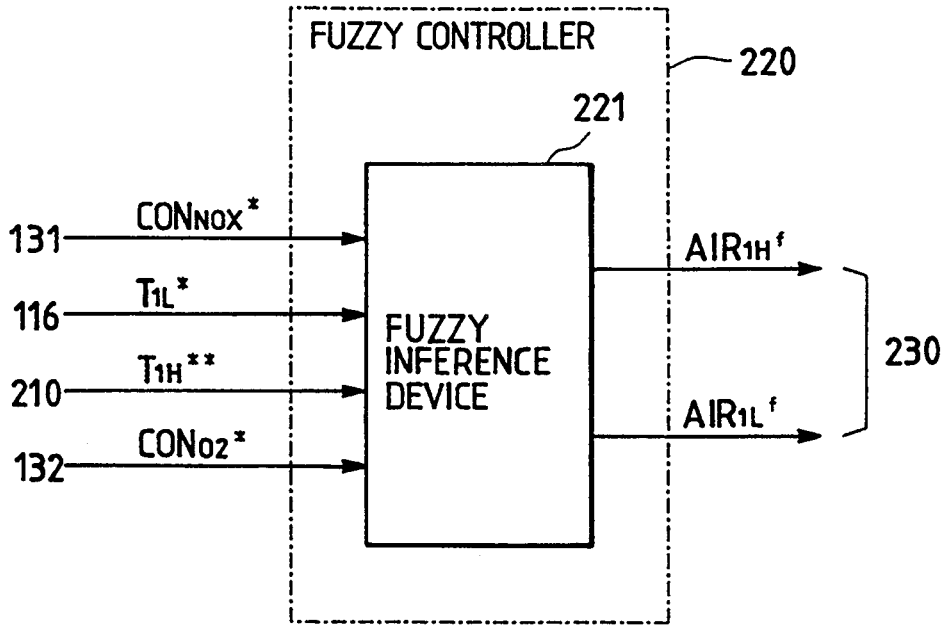
Figure 21:
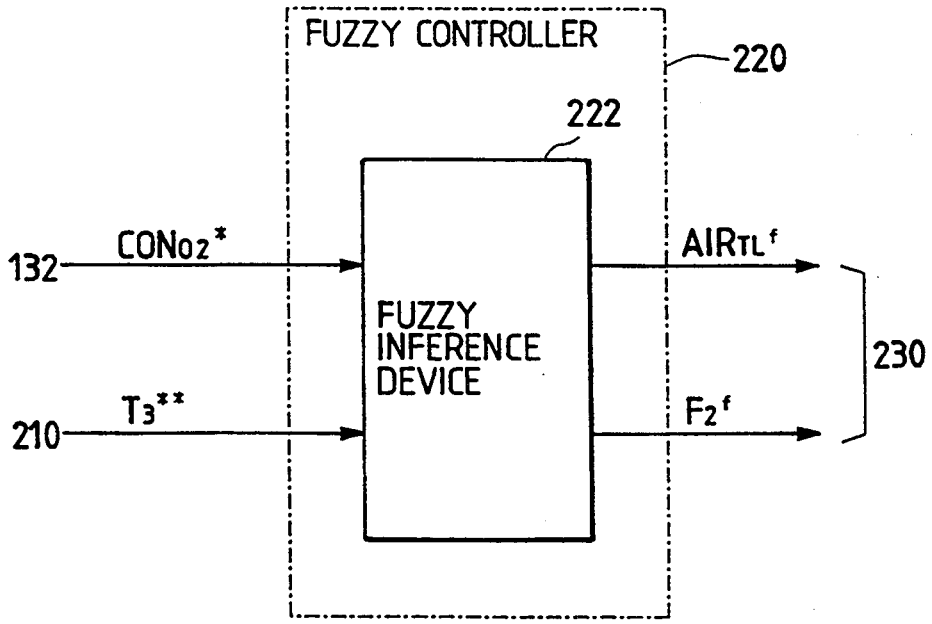
FIG. 21 is a block diagram illustrating one portion of the block diagram of FIG. 20 on an enlarged scale, and particularly showing in detail the fuzzy controller 220 included in the controller 200.
Figure 19:
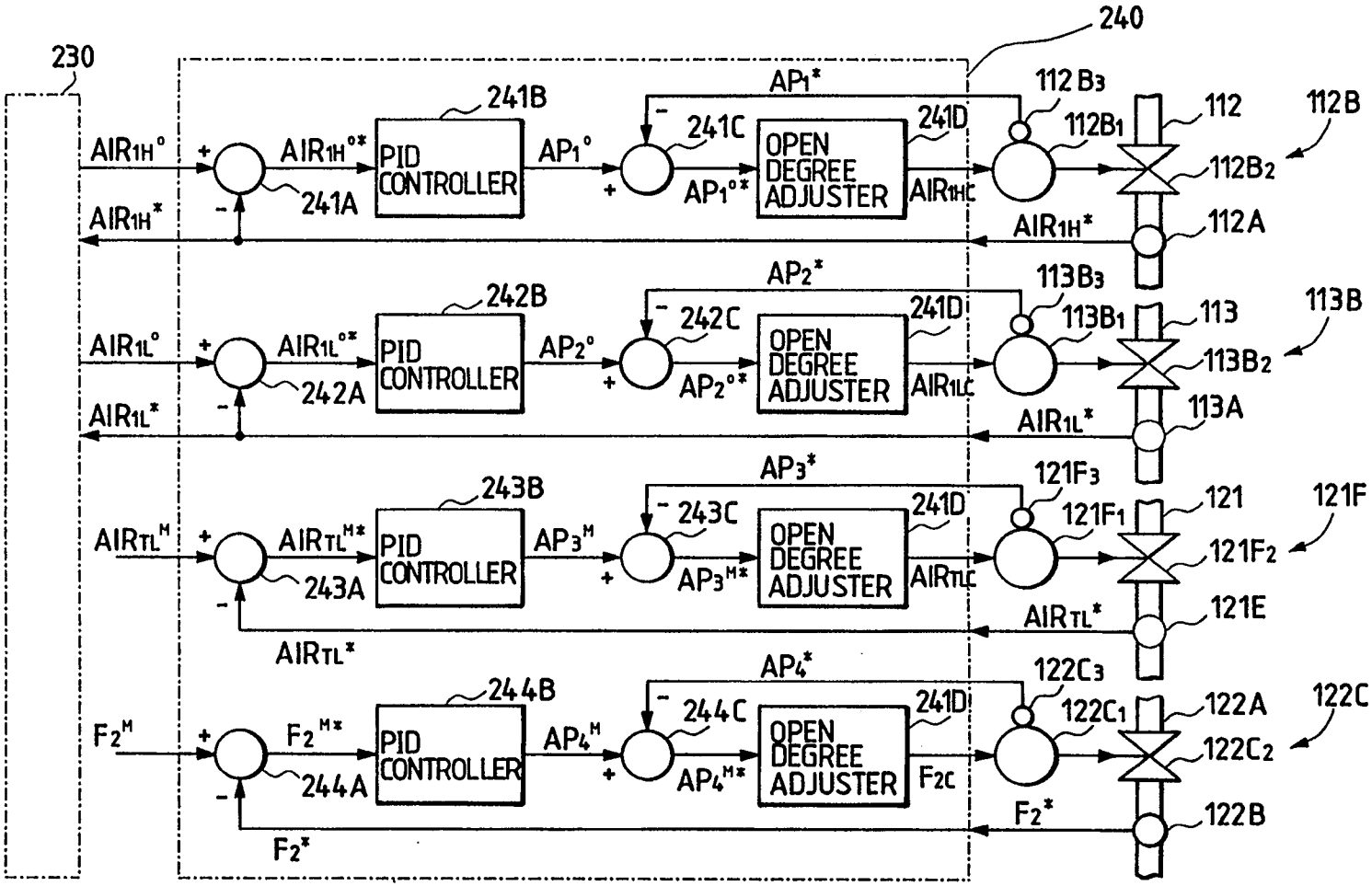
Figures 20, 21, 22:
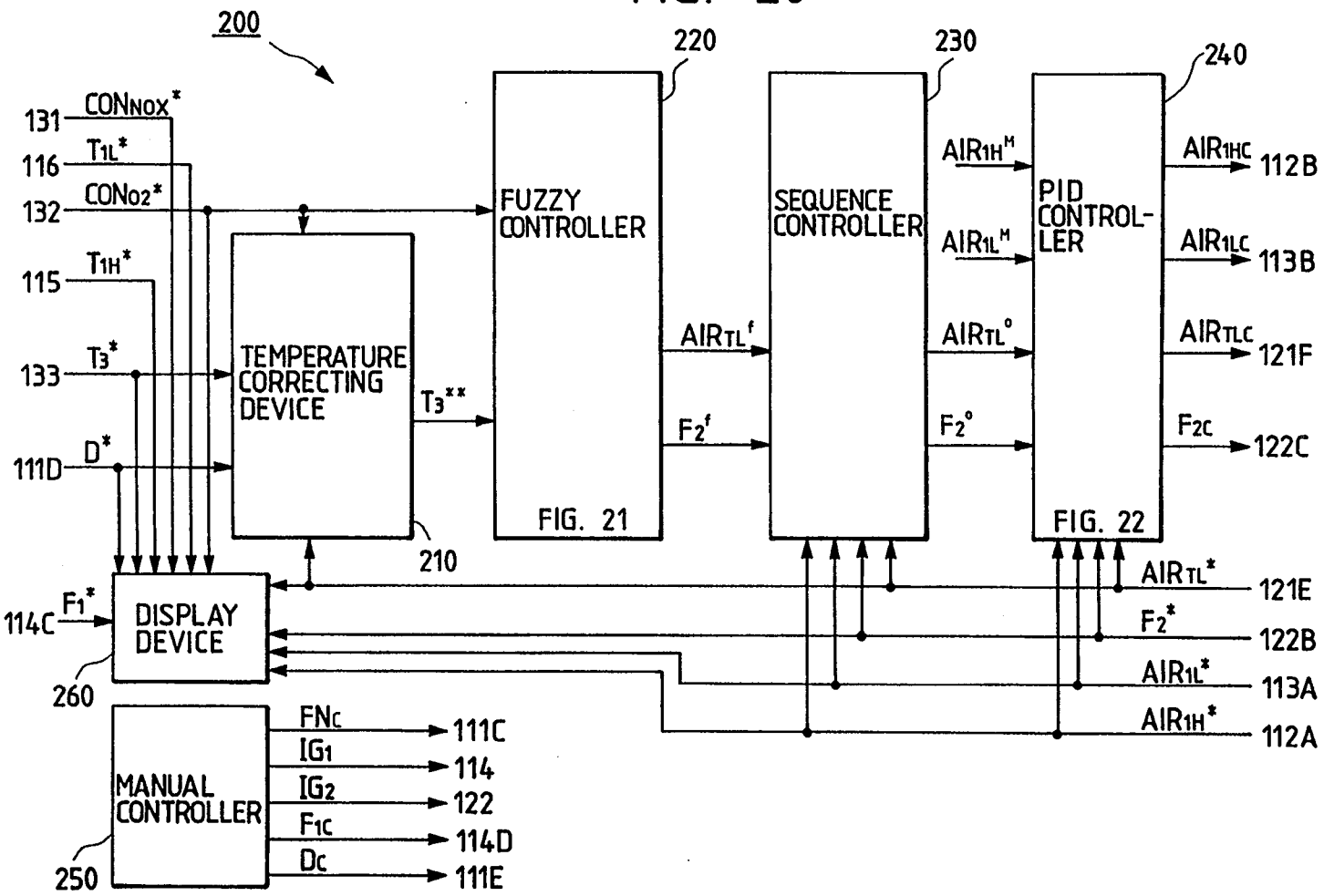
FIG. 20 is a block diagram illustrating one portion of the third embodiment of FIG. 1 on an enlarged scale, and particularly showing the controller 200 in detail.
FIG. 22 is a block diagram commonly illustrating on an enlarged scale one portion of the block diagram of FIG. 20 and one portion of the block diagram of FIG. 34, and particularly showing in detail the PID controller 240 included in the controller 200.
Figure 22:
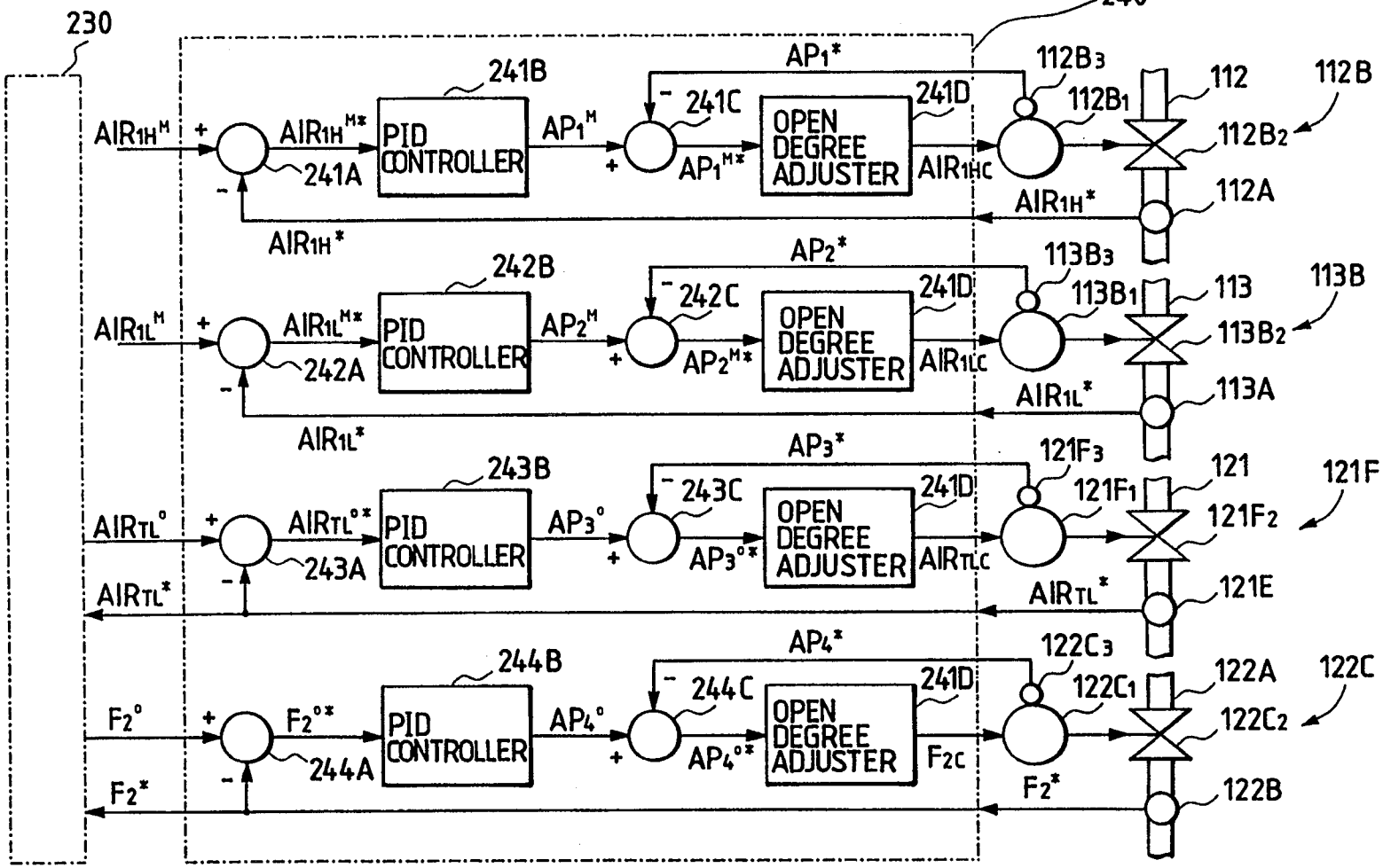
Figure 23:
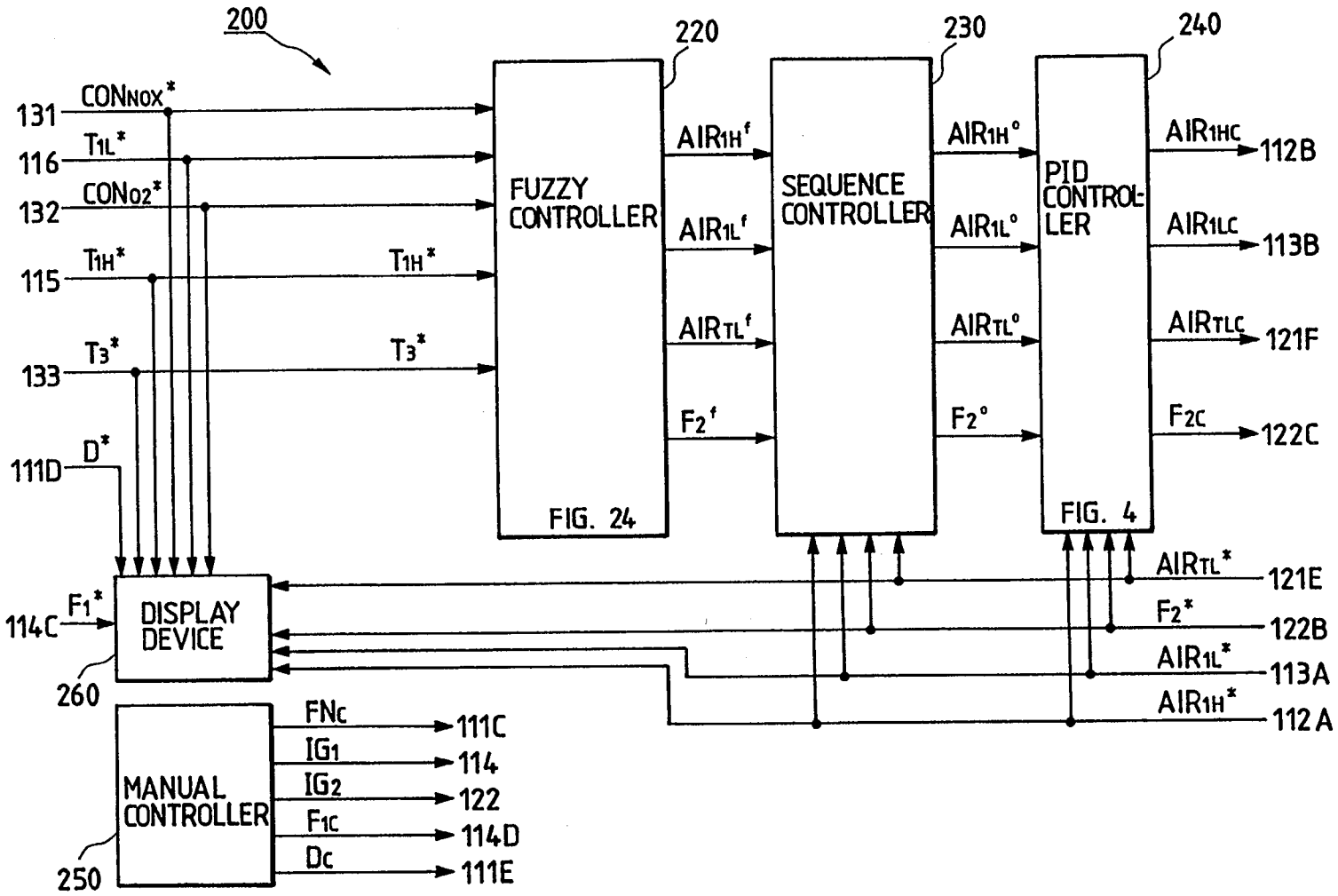
FIG. 23 is a block diagram illustrating one portion of the fourth embodiment of FIG. 1 on an enlarged scale, and particularly showing the controller 200 in detail.
Figure 24:
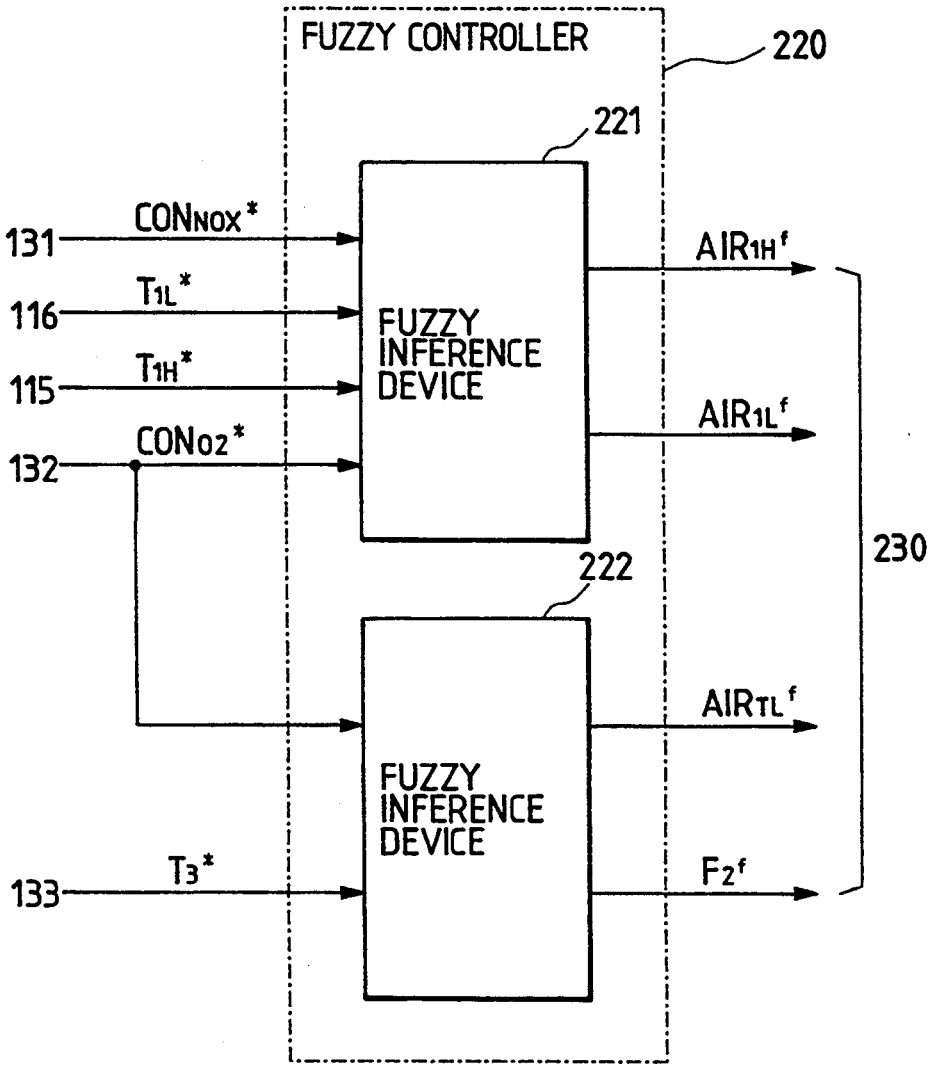
FIG. 24 is a block diagram illustrating one portion of the block diagram of FIG. 23 on an enlarged scale, and particularly showing in detail the fuzzy controller 220 included in the controller 200.

According to the first embodiment of the dried sludge melting furnace apparatus of the invention, when the manner of operation is changed at time $t_0$ from a conventional manual operation to a fuzzy control operation according to the invention, the detected PCC upper portion temperature $T_{1H}*$, the detected PCC lower portion temperature $T_{1L}*$, the detected PCC upper combustion air supply amount $AIR_{1H}*$, the detected PCC lower combustion air supply amount $AIR_{1L}*$ and the detected combustion gas NOX concentration $CON_{NOX}*$ were stabilized as shown in FIG. 13 and maintained as shown in FIG. 15. Moreover, the detected slag temperature $T_3*$, the detected combustion gas oxygen concentration $CON_{02}*$ and the detected total combustion air supply amount $AIR_{TL}*$ were stabilized as shown in FIG. 14 and maintained as shown in FIG. 16.

Configuration of the Second Embodiment

Then, referring to FIGS. 1, and 17 to 19, the configuration of the second embodiment of the dried sludge melting furnace apparatus of the invention will be described in detail. In order to simplify description, description duplicated with that of the first embodiment in conjunction with FIGS. 1 to 4 is omitted as much as possible by designating components corresponding to those of the first embodiment with the same reference numerals.

The controller 200 comprises a temperature correcting device 210 having first to fourth inputs which are respectively connected to the outputs of the PCC upper portion temperature detector 115, dried sludge supply amount detector $111_D$, combustion air supply amount detector 121E and oxygen concentration detector 132. The temperature correcting device 210 obtains a correction value (referred to as "corrected PCC upper portion temperature") $T_{1H}**$ of the PCC upper portion temperature $T_{1H}$ (i.e., the detected PCC upper portion temperature $T_{1H}*$) detected by the PCC upper portion temperature detector 115, and outputs the obtained values.

The control 200 further comprises a fuzzy controller 220 having a first input which is connected to an output of the temperature correcting device 210, and also having second to fourth inputs which are respectively connected to the outputs of the NOX concentration detector 131, oxygen concentration detector 132 and PCC lower portion temperature detector 116. The fuzzy controller 220 executes fuzzy inference on the basis of fuzzy rules held among fuzzy sets, a fuzzy set A relating to the PCC lower portion temperature $T_{1L}$, a fuzzy set B relating to the PCC upper portion temperature $T_{1H}$, a fuzzy set C relating to the combustion gas NOX concentration $CON_{NOX}$, a fuzzy set D relating to the combustion gas oxygen concentration $CON_{02}$, a fuzzy set E relating to the PCC upper combustion air supply amount $AIR_{1H}$, and a fuzzy set F relating to the PCC lower combustion air supply amount $AIR_{1L}$. As a result of the fuzzy inference, the fuzzy controller 220 obtains the PCC upper combustion air supply amount $AIR_{1H}$ and the PCC lower combustion air supply amount $AIR_{1L}$, and outputs these amounts from first and second outputs as an inferred PCC upper combustion air supply amount $AIR_{1H}^f$ and an inferred PCC lower combustion air supply amount $AIR_{1L}^f$.

The fuzzy controller 220 comprises a fuzzy inference device 221 having first to fourth inputs which are respectively connected to the outputs of the NOX concentration detector 131, PCC lower portion temperature detector 116, temperature correcting device 210 and oxygen concentration detector 132. The fuzzy inference device 221 executes fuzzy inference on the basis of fuzzy rules held among the fuzzy set A relating to the PCC lower portion temperature $T_{1L}$, the fuzzy set B relating to the PCC upper portion temperature $T_{1H}$, the fuzzy set C relating to the combustion gas NOX concentration $CON_{NOX}$, the fuzzy set D relating to the combustion gas oxygen concentration $CON_{02}$, the fuzzy set E relating to the PCC upper combustion air supply amount $AIR_{1H}$ and the fuzzy set F relating to the PCC lower combustion air supply amount $AIR_{1L}$. As a result of the fuzzy inference, in accordance with the detected PCC lower portion temperature $T_{1L}$*, the corrected PCC upper portion temperature $T_{1H}$**, the detected combustion gas NOX concentration $CON_{NOX}$* and the detected combustion gas oxygen concentration $CON_{02}$*, the fuzzy inference device 221 obtains the PCC upper combustion air supply amount $AIR_{1H}$ and the PCC lower combustion air supply amount $AIR_{1L}$, and outputs these obtained amounts from first and second outputs as the inferred PCC upper combustion air supply amount $AIR_{1H}^f$ and the inferred PCC lower combustion air supply amount $AIR_{1L}^f$.

The controller 200 further comprises a sequence controller 230 having first and second inputs which are respectively connected to the first and second outputs of the fuzzy controller 220 (i.e., the first and second outputs of the fuzzy inference device 221), and third to sixth inputs which are respectively connected to the outputs of the combustion air supply amount detectors 112A, 113A and 121E and fuel supply amount detector 122B. On the basis of the inferred PCC upper combustion air supply amount $AIR_{1H}^f$, the inferred PCC lower combustion air supply amount $AIR_{1L}^f$, the detected PCC upper combustion air supply amount $AIR_{1H}$*, the detected PCC lower combustion air supply amount $AIR_{1L}$*, the detected total combustion air supply amount $AIR_{TL}$* and the detected SCC burner fuel supply amount $F_2$*, the sequence controller 230 obtains a target PCC upper combustion air supply amount $AIR_{1H}°$ and a target PCC lower combustion air supply amount $AIR_{1L}°$, and outputs these obtained values from first and second outputs.

The controller 200 further comprises a PID controller 240 having first to fourth inputs which are respectively connected to the first and second outputs of the sequence controller 230, an output of a total combustion air supply amount manually setting device (not shown) for manually setting the total combustion air supply amount $AIR_{TL}$ and an output of an SCC burner fuel supply amount manually setting device (not shown) for manually setting the SCC burner fuel supply amount $F_2$, and also fifth to eighth inputs which are respectively connected to the outputs of the combustion air supply amount detectors 112A, 113A and 121E and fuel supply amount detector 122B for the SCC. The PID controller 240 has first to fourth outputs which are respectively connected to the control terminals of the valve apparatuses 112B, 113B, 121F and 122C. The PID controller 240 generates a PCC upper combustion air supply amount control signal $AIR_{1HC}$, a PCC lower combustion air supply amount control signal $AIR_{1LC}$, a total combustion air supply amount control signal $AIR_{TLC}$ and an SCC burner fuel supply amount control signal $F_{2C}$ which are used for controlling the valve apparatuses 112B, 113B, 121F and 122C so as to attain the target PCC upper combustion air supply amount $AIR_{1H}°$, the target PCC lower combustion air supply amount $AIR_{1L}°$, a target total combustion air supply amount $AIR_{TL}^M$ set through the total combustion air supply amount manually setting device (not shown) and a target SCC burner fuel supply amount $F_2^M$ set through the SCC burner fuel supply amount manually setting device (not shown). These control signals are output from first to fourth outputs.

The PID controller 240 comprises a comparator 241A, a PID controller 241B, a comparator 241C and an open degree adjustor 241D. The comparator 241A has a noninverting input which is connected to the first output of the sequence controller 230, and an inverting input which is connected to an output of the combustion air supply amount detector 112A. The comparator 241A obtains the difference (referred to as "controlled PCC upper combustion air supply amount") $AIR_{1H}°$* between the target PCC upper combustion air supply amount $AIR_{1H}°$ and the detected PCC upper combustion air supply amount $AIR_{1H}$*. The PID controller 241B has an input connected to an output of the comparator 241A, and calculates an open degree (referred to as "target open degree") $AP_1°$ of the valve apparatus 112B which corresponds to the controlled PCC upper combustion air supply amount $AIR_{1H}°$*. The comparator 241C has a noninverting input which is connected to an output of the PID controller 241B, and an inverting input which is connected to an output of the open degree detector $112B_3$ of the valve apparatus 112B. The comparator 241C obtains the difference (referred to as "controlled open degree") $AP_1°$* between the target open degree $AP_1°$ of the valve apparatus 112B and the detected open degree $AP_1$*. The open degree adjustor 241D has an input connected to an output of the comparator 241C, and an output connected to the control terminal of the drive motor $112B_1$ for the valve apparatus 112B. The open degree adjustor 241D generates the PCC upper combustion air supply amount control signal $AIR_{1HC}$ which corresponds to the controlled open degree $AP_1°*$ and which is given to the drive motor 112B$_l$ for the valve apparatus 112B.

Moreover, the PID controller 240 comprises a comparator 242A, a PID controller 242B, a comparator 242C and an open degree adjustor 242D. The comparator 242A has a noninverting input which is connected to the second output of the sequence controller 230, and an inverting input which is connected to an output of the combustion air supply amount detector 113A. The comparator 242A obtains the difference (referred to as "controlled PCC lower combustion air supply amount") $AIR_{1L}°*$ between the target PCC lower combustion air supply amount $AIR_{1L}°$ and the detected PCC lower combustion air supply amount $AIR_{1L}*$. The PID controller 242B has an input connected to an output of the comparator 242A, and calculates an open degree (referred to as "target open degree") $AP_2°$ of the valve apparatus 113B which corresponds to the controlled PCC lower combustion air supply amount $AIR_{1L}°*$. The comparator 242C has a noninverting input which is connected to an output of the PID controller 242B, and an inverting input which is connected to an output of the open degree detector 113B$_3$ for the valve apparatus 113B. The comparator 242C obtains the difference (referred to as "controlled open degree") $AP_2°*$ between the target open degree $AP_2°$ of the valve apparatus 113B and the detected open degree $AP_2*$. The open degree adjustor 242D has an input connected to an output of the comparator 242C, and an output connected to the control terminal of the drive motor 113B$_1$ for the valve apparatus 113B. The open degree adjustor 242D generates the PCC lower combustion air supply amount control signal $AIR_{1LC}$ which corresponds to the controlled open degree $AP_2°*$ and which is given to the drive motor 113B$_1$ for the valve apparatus 113B.

Moreover, the PID controller 240 comprises a comparator 243A, a PID controller 243B, a comparator 243C and an open degree adjustor 243D. The comparator 243A has a noninverting input which is connected to an output of the total combustion air supply amount manually setting device (not shown), and an inverting input which is connected to an output of the combustion air supply amount detector 121E. The comparator 243A obtains the difference (referred to as "controlled total combustion air supply amount) $AIR_{TL}^{M*}$ between the target total combustion air supply amount $AIR_{TL}^{M}$ and the detected total combustion air supply amount $AIR_{TL}*$. The PID controller 243B o has an input connected to an output of the comparator 243A, and calculates an open degree (referred to as "target open degree") $AP_3^M$ of the valve apparatus 121F which corresponds to the controlled total combustion air supply amount $AIR_{TL}^{M*}$. The comparator 243C has a noninverting input which is connected to an output of the PID controller 243B, and an inverting input which is connected to an output of the open degree detector 121F$_3$ for the valve apparatus 121F. The comparator 243A obtains the difference (referred to as "controlled open degree") $AP_3^{M*}$ between the target open degree $AP_3^M$ of the valve apparatus 121F and the detected open degree $AP_3*$. The open degree adjustor 243D has an input connected to an output of the comparator 243C, and an output connected to the control terminal of the drive motor 121F$_1$ for the valve apparatus 121F. The open degree adjustor 243D generates the total combustion air supply amount control signal $AIR_{TLC}$ which corresponds to the controlled open degree $AP_3^{M*}$ and which is given to the drive motor 121F$_1$ for the valve apparatus 121F.

Furthermore, the PID controller 240 comprises a comparator 244A, a PID controller 244B, a comparator 244C and an open degree adjustor 244D. The comparator 244A has a noninverting input which is connected to an output of the SCC burner fuel supply amount manually setting device (not shown), and an inverting input which is connected to an output of the fuel supply amount detector 122B. The comparator 244A obtains the difference (referred to as "controlled SCC burner fuel supply amount") $F_2^{M*}$ between the target SCC burner fuel supply amount $F_2^M$ and the detected SCC burner fuel supply amount $F_2*$. The PID controller 244B has an input connected to an output of the comparator 244A, and calculates an open degree (referred to as "target open degree") $AP_4^M$ of the valve apparatus 122C which corresponds to the controlled SCC burner fuel supply amount $F_2^{M*}$. The comparator 244C has a noninverting input which is connected to an output of the PID controller 244B, and an inverting input which is connected to an output of the open degree detector 122C$_3$ for the valve apparatus 122C. The comparator 244C obtains the difference (referred to as "controlled open degree") $AP_4^{M*}$ between the target open degree $AP_4^M$ of the valve apparatus 122C and the detected open degree $AP_4*$. The open degree adjustor 244D has an input connected to an output of the comparator 244C, and an output connected to the control terminal of the drive motor 122C$_1$ for the valve apparatus 122C. The open degree adjustor 244D generates the SCC burner fuel supply amount control signal $F_{2C}$ which corresponds to the controlled open degree $AP_4^{M*}$ and which is given to the drive motor 122C$_1$ for the valve apparatus 122C.

The controller 200 further comprises a manual controller 250 and a display device 260. The manual controller 250 has first to fifth outputs which are respectively connected to the control terminals of the valve apparatuses 111E and 114D, air blower 111C, PCC burner 114 and SCC burner 122. When manually operated by the operator, the manual controller 250 generates a dried sludge supply amount control signal $D_C$ which is given to the valve apparatus 111E so that the dried sludge supply amount D for the PCC 110A is adequately adjusted, and a PCC burner fuel supply amount control signal $F_{1C}$ which is supplied to the valve apparatus 114D so that the PCC burner fuel supply amount $F_l$ for the PCC burner 114 is adequately adjusted, and gives a control signal $FN_C$ for activating the air blower 111C thereto, an ignition control signal $IG_1$ for igniting the PCC burner 114 thereto, and an ignition control signal $IG_2$ for igniting the SCC burner 122 thereto. The display device 260 has an input which is connected to at least one of the outputs of the dried sludge supply amount detector 111D, combustion air supply amount detectors 112A, 113A and 121E, fuel supply amount detectors 114C and 122B, PCC upper portion temperature detector 115, PCC lower portion temperature detector 116, NOX concentration detector 131, oxygen concentration detector 132 and slag temperature detector 133. The display device 260 displays at least one of the detected dried sludge supply amount D*, detected PCC upper combustion air supply amount $AIR_{1H}*$, detected PCC lower combustion air supply amount $AIR_{1L}*$, detected total combustion air supply amount $AIR_{TL}*$, detected PCC burner fuel supply amount $F_1$*, detected SCC burner fuel supply amount $F_2$*, detected PCC upper portion temperature $T_{1H}$*, detected PCC lower portion temperature $T_{1L}$*, detected combustion gas NOX concentration $CON_{NOX}$*, detected combustion gas oxygen concentration $CON_{02}$* and detected slag temperature $T_3$*.

Function of the Second Embodiment

Next, referring to FIGS. 1, 5 to 12 and 17 to 19, the function of the second embodiment of the dried sludge melting furnace of the invention will be described in detail. In order to simplify description, description duplicated with that of the first embodiment in conjunction with FIGS. 1 to 16 is omitted as much as possible.

Correction of the detected PCC upper temperature $T_{1H}$*

The temperature correcting device 210 of the controller 200 corrects the detected value of the PCC upper portion temperature $T_{1H}$ (i.e., the detected PCC upper portion temperature $T_{1H}$*) sent from the PCC upper portion temperature detector 115, according to Ex. 9 or Ex. 12, and on the basis of the detected value of the PCC upper portion temperature $T_{1H}$ (i.e., the detected PCC upper portion temperature $T_{1H}$*) sent from the PCC upper portion temperature detector 115, the detected value of the dried sludge supply amount D (i.e., the detected dried sludge supply amount D*) sent from the dried sludge supply amount detector 111D, the detected value of the combustion gas oxygen concentration $CON_{02}$ (i.e., the detected combustion gas oxygen concentration $CON_{02}$*) sent from the oxygen concentration detector 132, and the detected value of the total combustion air supply amount $AIR_{TL}$ (i.e., the detected total combustion air supply amount $AIR_{TL}$*) sent from the combustion air supply amount detector 121E. The value is given as the corrected PCC upper portion temperature $T_{1H}$ to the fuzzy inference device 221 of the fuzzy controller 220**.

[Ex. 9]

$$T_{1H}^{**}=T_{1H}^{*}+\Delta T$$

In Ex. 9, ΔT is a correction amount for the detected PCC upper portion temperature $T_{1H}$*, and can be expressed by Ex. 10 using the slag pouring point $T_s$ and appropriate temperature correction coefficients a and b. The temperature correction coefficients a and b may be adequately determined on the basis of data displayed on the display device 260 and manually set to the temperature correcting device 210, or may be determined in the temperature correcting device 210 on the basis of at least one of the detected PCC upper portion temperature $T_{1H}$*, the detected dried sludge supply amount D*, the detected combustion gas oxygen concentration $CON_{02}$* and the detected total combustion air supply amount $AIR_{TL}$* which are given to the temperature correcting device 210. Alternatively, the coefficients a and b may be suitably calculated by a temperature correction coefficient setting device (not shown) and then given to the temperature correcting device 210.

[Ex. 10]

$$\Delta T=a(T_S-b)$$

Using the detected combustion gas oxygen concentration $CON_{02}$*, the detected total combustion air supply amount $AIR_{TL}$* the detected dried sludge supply amount D* and the water content W of dried sludge, the slag pouring point $T_s$ of Ex. 10 can be expressed by Ex. 11 as follows:

[Ex. 11]

$$T_s=1490-(21-CON_{02}^{*})\times AIR_{TL}^{*}\times 69\times 100/\{D-W)\times 21\}$$

Therefore, Ex. 9 can be modified as Ex. 12.

[Ex. 12]

$$T_{1H}^{**}=T_{1H}^{*}+a[1490-(21-CON_{02}^{**})\times AIR_{TL}^{*}\times 69\times 100/\{D^{*}(100-W)\times 21-b\}]$$

Fuzzy inference

The fuzzy controller 220 of the controller 200 executes fuzzy inference as follows.

In accordance with the detected PCC lower portion temperature $T_{1L}$*, the corrected PCC upper portion temperature $T_{1H}$**, the detected combustion gas NOX concentration $CON_{NOX}$* and the detected combustion gas oxygen concentration $CON_{02}$*, the fuzzy inference device 221 firstly executes the fuzzy inference to obtain the PCC upper combustion air supply amount $AIR_{1H}$ and the PCC lower combustion air supply amount $AIR_{1L}$, on the basis of fuzzy rules $f_{01}$ to $f_{30}$ shown in Table 1 and held among the fuzzy set A relating to the PCC lower portion temperature $T_{1L}$, the fuzzy set B relating to the PCC upper portion temperature $T_{1H}$, the fuzzy set C relating to the combustion gas NOX concentration $CON_{NOX}$, the fuzzy set D relating to the combustion gas oxygen concentration $CON_{02}$, the fuzzy set E relating to the PCC upper combustion air supply amount $AIR_{1H}$ and the fuzzy set F relating to the PCC lower combustion air supply amount $AIR_{1L}$. These obtained amounts are given to the sequence controller 230 as the inferred PCC upper combustion air supply amount $AIR_H^f$ and the inferred PCC lower combustion air supply amount $AIR_{1L}^f$, respectively.

When the detected PCC lower portion temperature $T_{1L}$* is 1,107° C., the corrected PCC upper portion temperature $T_{1H}$** is 1,210° C., the detected combustion gas NOX concentration $CON_{NOX}$* is 290 ppm and the detected combustion gas oxygen concentration $CON_{02}$* is 3.4 wt %, for example, the fuzzy inference device 221 obtains the grade of membership functions $ZR_A$, $PS_A$ and $PL_A$ of the fuzzy set A relating to the PCC lower portion temperature $T_{1L}$ and shown in FIG. 5A, the grade of membership functions $NL_B$, $NS_B$, $ZR_B$, $PS_B$ and $PL_B$ of the fuzzy set B relating to the PCC upper portion temperature $T_{1H}$ and shown in FIG. 6A, the grade of membership functions $ZR_C$, $PS_C$, $PM_C$ and $PL_C$ of the fuzzy set C relating to the combustion gas NOX concentration $CON_{NOX}$ and shown in FIG. 5B, and the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, as shown in FIGS. 9A to 9D and Table 3.

With respect to each of the fuzzy rules $f_{01}$ to $f_{30}$, the fuzzy inference device 221 then compares the grade of membership functions $ZR_A$, $PS_A$ and $PL_A$ of the fuzzy set A relating to the PCC lower portion temperature $T_{1L}$ and shown in FIG. 5A, the grade of membership functions $NL_B$, $NS_B$, $ZR_B$, $PS_B$ and $PL_B$ of the fuzzy set B relating to the PCC upper portion temperature $T_{1H}$ and shown in FIG. 6B, the grade of membership functions $ZR_C$, $PS_C$, $PM_C$ and $PL_C$ of the fuzzy set C relating to the combustion gas NOX concentration $CON_{NOX}$ and shown in FIG. 5B, and the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, with each other in FIGS. 9A to 9D and Table 3. The minimum one among them is set as the grade of membership functions $NL_E$, $NS_E$, $ZR_E$, $PS_E$ and $PL_E$ of the fuzzy set E relating to the PCC upper combustion air supply amount $AIR_{1H}$ and shown in FIG. 7B, and also as the grade of membership functions $NL_F$, $NS_F$, $ZR_F$, $PS_F$ and $PL_F$ of the fuzzy set F relating to the PCC lower combustion air supply amount $AIR_{1L}$ and shown in FIG. 7C.

With respect to the fuzzy rules $f_{01}$ to $f_{30}$, the fuzzy inference device 221 modifies the membership functions $NL_E$, $NS_E$, $ZR_E$, $PS_E$ and $PL_E$ of the fuzzy set E relating to the PCC upper combustion air supply amount $AIR_{1H}$ and shown in FIG. 7B to stepladder-like membership functions $NS_E^{*24}$, $NS_E^{*25}$ and $NS_E^{*27}$ which are cut at the grade positions indicated in Table 4 (see FIG. 10A). In FIG. 10A, cases where the grade is 0.0 are not shown.

The fuzzy inference device 221 calculates the center of gravity of the hatched area enclosed by the stepladder-like o membership functions $NS_E^{*24}$ $NS_E^{*25}$ and $NS_E^{*27}$ which have been produced in the above-mentioned process, as shown in FIG. 10A, and outputs its abscissa of $-2.5$ $Nm^3/h$ to the sequence controller 230 as the inferred PCC upper combustion air supply amount (in this case, the corrected value for the current value) $AIR_{1H}$.

With respect to the fuzzy rules $f_{01}$ to $f_{30}$, the fuzzy inference device 221 further modifies the membership functions $NL_F$, $NS_F$, $ZR_F$, $PS_F$ and $PL_F$ of the fuzzy set F relating to the PCC lower combustion air supply amount $AIR_{1L}$ and shown in FIG. 7C to stepladder-like membership functions $ZR_F^{*24}$, $ZR_F^{*25}$ and $ZR_F^{*27}$ which are cut at the grade positions indicated in Table 4 (see FIG. 10B). In FIG. 10B, cases where the grade is 0.0 are not shown.

The fuzzy inference device 221 calculates the center of gravity of the hatched area enclosed by the stepladder-like membership functions $ZR_F^{*24}$ $ZR_F^{*25}$ and $ZR_F^{*27}$ which have been produced in the above-mentioned process, as shown in FIG. 10B, and outputs its abscissa of 0.0 $Nm^3/h$ to the sequence controller 230 as the inferred PCC lower combustion air supply amount (in this case, the corrected value for the current value) $AIR_{1L}^f$.

In the fuzzy inference performed in the fuzzy inference device 221, fuzzy rules $h_{01}$ to $h_{16}$ shown in Table 6 may be employed instead of the fuzzy rules $f_{01}$ to $f_{30}$ shown in Table 1. When the fuzzy rules $h_{01}$ to $h_{16}$ are employed, the fuzzy inference device 221 performs the fuzzy inference in the same manner as described above, and therefore, for the sake of convenience, its detail description is omitted.

Sequence control

The sequence controller 230 obtains mean values in a desired time period of the inferred PCC upper combustion air supply amount $AIR_{1H}^f$ and the inferred PCC lower combustion air supply amount $AIR_{1L}^f$, in accordance with the inferred PCC upper combustion air supply amount $AIR_{1H}^f$ and inferred PCC lower combustion air supply amount $AIR_{1L}^f$ given from the fuzzy inference device 221 of the fuzzy controller 220, the detected total combustion air supply amount $AIR_{TL}^*$ given from the combustion air supply amount detector 121E, the detected PCC upper combustion air supply amount $AIR_{1H}^*$ given from the combustion air supply amount detector 112A, the detected PCC lower combustion air supply amount $AIR_{1L}^*$ given from the combustion air supply amount detector 113A and the detected SCC burner fuel supply amount $F_2^*$ given from the fuel supply amount detector 122B. The obtained values are respectively output to the PID controller 240 as the target PCC upper combustion air supply amount $AIR_{1H}^\circ$ and target PCC lower combustion air supply amount $AIR_{1L}^\circ$.

PID control

The PID controller 240 generates the following control signals as described below: the PCC upper combustion air supply amount control signal $AIR_{1HC}$ in order to change the PCC upper combustion air supply amount $AIR_{1H}$; the PCC lower combustion air supply amount control signal $AIR_{1LC}$ in order to adjust the PCC lower combustion air supply amount $AIR_{1L}$; the total combustion air supply amount control signal $AIR_{TLC}$ in order to adjust the total combustion air supply amount $AIR_{TL}$; and the SCC burner fuel supply amount control signal $F_{2C}$ in order to adjust the SCC burner fuel supply amount signal $F_2$, in accordance with the target PCC upper combustion air supply amount $AIR_{1H}^\circ$ and target PCC lower combustion air supply amount $AIR_{1L}^\circ$ given from the sequence controller 230, the target total combustion air supply amount $AIR_{TL}^M$ given from the total combustion air supply amount manually setting device, the target SCC burner fuel supply amount $F_2^M$ given from the SCC burner fuel supply amount manually setting device, the detected total combustion air supply amount $AIR_{TL}^*$ given from the combustion air supply amount detector 121E, the detected PCC upper combustion air supply amount $AIR_{1H}^*$ given from the combustion air supply amount detector 112A, the detected PCC lower combustion air supply amount $AIR_{1L}^*$ given from the combustion air supply amount detector 113A, and the detected SCC burner fuel supply amount $F_2^*$ given from the fuel supply amount detector 122B. The PID controller 240 gives the generated signals to the valve apparatuses 112B, 113B, 121F and 122C, respectively.

In the PID controller 240, firstly, the comparator 241A compares the target PCC upper combustion air supply amount $AIR_{1H}^\circ$ given from the sequence controller 230 with the detected PCC upper combustion air supply amount $AIR_{1H}^*$ given from the combustion air supply amount detector 112A. The result of the comparison, or a correcting value $AIR_{1H}^\circ$ of the PCC upper combustion air supply amount $AIR_{1H}$ is given to the PID controller 241B. In the PID controller 241B, an appropriate calculation corresponding to the correcting value $AIR_{1H}^\circ$ of the PCC upper combustion air supply amount $AIR_{1H}$ is executed to obtain a correcting open degree $AP_1^\circ$ of the valve apparatus 112B. The comparator 241C compares the correcting open degree $AP_1^\circ$ with the detected open degree $AP_1^*$ given from the open degree detector $112B_3$ of the valve apparatus 112B. The result of the comparison is given to the open degree adjustor 241D as a changing open degree $AP_1^\circ$ of the control valve $112B_2$ of the valve apparatus 112B.

The open degree adjustor 241D generates the PCC upper combustion air supply amount control signal $AIR_{1HC}$ in accordance with the changing open degree $AP_1{}^{\circ *}$ and gives it to the drive motor 112B$_1$ for the valve apparatus 112B. In response to this, the drive motor 112B$_1$ suitably changes the open degree of the control valve 112B$_2$ so as to change the PCC upper combustion air supply amount $AIR_{1H}$ supplied to the upper portion of the PCC 110A, to a suitable value.

In the PID controller 240, then, the comparator 242A compares the target PCC lower combustion air supply amount $AIR_{1L}{}^{o}$ given from the sequence controller 230 with the detected PCC lower combustion air supply amount $AIR_{1L}{}^{*}$ given from the combustion air supply amount detector 113A. The result of the comparison, or a correcting value $AIR_{1L}{}^{\circ}$ of the PCC lower combustion air supply amount $AIR_{1L}$ is given to the PID controller 242B. In the PID controller 242B, an appropriate calculation corresponding to the correcting value $AIR_{1L}{}^{\circ}$ of the PCC lower combustion air supply amount $AIR_{1L}$ is executed to obtain a correcting open degree $AP_2{}^{\circ}$ of the valve apparatus 113B. The comparator 242C compares the correcting open degree $AP_2{}^{\circ}$ with the detected open degree $AP_2{}^{*}$ given from the open degree detector 113B$_3$ of the valve apparatus 113B. The result of the comparison is given to the open degree adjustor 242D as a changing open degree $AP_2{}^{\circ}$ of the control valve 113B$_2$ of the valve apparatus 113B. The open degree adjustor 242D generates the PCC lower combustion air supply amount control signal $AIR_{1LC}$ in accordance with the changing open degree $AP_2{}^{\circ *}$ and gives it to the drive motor 113B$_1$ for the valve apparatus 113B. In response to this, the drive motor 113B$_1$ suitably changes the open degree of the control valve 113B$_2$ so as to change the PCC lower combustion air supply amount $AIR_{1L}$ supplied to the lower portion of the PCC 110A, to a suitable value.

In the PID controller 240, moreover, the comparator 243A compares the target total combustion air supply amount $AIR_{TL}{}^{M}$ given from the total combustion air supply amount manually setting device with the detected total combustion air supply amount $AIR_{TL}{}^{*}$ given from the combustion air supply amount detector 121E. The result of the comparison, or a correcting value $AIR_{TL}{}^{M*}$ of the total combustion air supply amount $AIR_{TL}$ is given to the PID controller 243B. In the PID controller 243B, an appropriate calculation corresponding to the correcting value $AIR_{TL}{}^{M*}$ of the total combustion air supply amount $AIR_{TL}$ is executed to obtain a correcting open degree $AP_3{}^{M}$ of the valve apparatus 121F. The comparator 243C compares the correcting open degree $AP_3{}^{M}$ with the detected open degree $AP_3{}^{*}$ given from the open degree detector 121F$_3$ of the valve apparatus 121F. The result of the comparison is given to the open degree adjustor 243D as a changing open degree $AP_3{}^{M*}$ of the control valve 121F$_2$ of the valve apparatus 121F. The open degree adjustor 243D generates the total combustion air supply amount control signal $AIR_{TLC}$ in accordance with the changing open degree $AP_3{}^{M*}$ and gives it to the drive motor 121F$_1$ for the valve apparatus 121F. In response to this, the drive motor 121F$_1$ suitably changes the open degree of the control valve 121F$_2$ so as to change the total combustion air supply amount $AIR_{TL}$ supplied to the PCC 110A and SCC 120A, to a suitable value.

In the PID controller 240, furthermore, the comparator 244A compares the target SCC burner fuel supply amount $F_2{}^{M}$ given from the SCC burner fuel supply amount manually setting device with the detected SCC burner fuel supply amount $F_2{}^{*}$ given from the burner fuel supply amount detector 122B. The result of the comparison, or a correcting value $F_2{}^{M*}$ of the SCC burner fuel supply amount $F_2$ is given to the PID controller 244B. In the PID controller 244B, an appropriate calculation corresponding to the correcting value $F_2{}^{M*}$ of the SCC burner fuel supply amount $F_2$ is executed to obtain a correcting open degree $AP_4{}^{M}$ of the valve apparatus 122C. The comparator 244C compares the correcting open degree $AP_4{}^{M}$ with the detected open degree $AP_4{}^{*}$ given from the open degree detector 122C$_3$ of the valve apparatus 122C. The result of the comparison is given to the open degree adjustor 244D as a changing open degree $AP_4{}^{M*}$ of the control valve 122C$_2$ of the valve apparatus 122C. The open degree adjustor 244D generates the SCC burner fuel supply amount control signal $F_{2C}$ in accordance with the changing open degree $AP_4{}^{M*}$ and gives it to the drive motor 122C$_1$ for the valve apparatus 122C. In response to this, the drive motor 122C$_1$ suitably changes the open degree of the control valve 122C$_2$ so as to change the SCC burner fuel supply amount $F_2$ supplied to the SCC burner 122, to a suitable value.

Configuration of the Third Embodiment

Then, referring to FIGS. 1 and 20 to 22, the configuration of the third embodiment of the dried sludge melting furnace apparatus of the invention will be described in detail. In order to simplify description, description duplicated with that of the first embodiment in conjunction with FIGS. 1 to 4 is omitted as much as possible by designating components corresponding to those of the first embodiment with the same reference numerals.

The controller 200 comprises a temperature correcting device 210 having first to fifth inputs which are respectively connected to the outputs of the slag temperature detector 133, dried sludge supply amount detector 111D, combustion air supply amount detector 121E and oxygen concentration detector 132. The temperature correcting device 210 obtains a correction value (referred to as "corrected slag temperature") $T_3{}^{**}$ of the slag temperature $T_3$ (i.e., the detected slag temperature $T_3{}^{*}$) detected by the slag temperature detector 133 which is disposed in the slag separation chamber 130A, and outputs the obtained value.

The controller 200 further comprises a fuzzy controller 220 having the input which are respectively connected to output of the temperature correcting device 210 and the output of the oxygen concentration detector 132. The fuzzy controller 220 executes fuzzy inference on the basis of fuzzy rules held among fuzzy sets, a fuzzy set D relating to the combustion gas oxygen concentration $CON_{02}$, a fuzzy set G relating to the slag temperature $T_3$, a fuzzy set H relating to the SCC burner fuel supply amount $F_2$ and a fuzzy set I relating to the total combustion air supply amount $AIR_{TL}$. As a result of the fuzzy inference, the fuzzy controller 220 obtains the total combustion air supply amount $AIR_{TL}$ and the SCC burner fuel supply amount $F_2$, and outputs these amounts from first and second outputs as an inferred total combustion air supply amount $AIR_{TL}{}^{f}$ and an inferred SCC burner fuel supply amount $F_2{}^{f}$.

The fuzzy controller 220 comprises a fuzzy inference device 222. The fuzzy inference device 222 has first and second inputs which are respectively connected to the output of the oxygen concentration detector 132 and the output of the temperature correcting device 210.

The fuzzy inference device 222 executes fuzzy inference on the basis of fuzzy rules held among the fuzzy set D relating to the combustion gas oxygen concentration $CON_{02}$, the fuzzy set G relating to the slag temperature $T_3$, the fuzzy set H relating to the SCC burner fuel supply amount $F_2$ and the fuzzy set I relating to the total combustion air supply amount $AIR_{TL}$. As a result of the fuzzy inference, in accordance with the corrected slag temperature $T_3$** and the detected combustion gas oxygen concentration $CON_{02}$*, the fuzzy inference device 222 obtains the total combustion air supply amount $AIR_{TL}$ and the SCC burner fuel supply amount $F_2$, and outputs these amounts from first and second outputs as the inferred total combustion air supply amount $AIR_{TL}^f$ and the inferred SCC burner fuel supply amount $F_2^f$.

The controller 200 further comprises a sequence controller 230 having first and second inputs which are respectively connected to the first and second outputs of the fuzzy controller 220 (i.e., the first and second outputs of the fuzzy o inference device 222), and third to sixth inputs which are respectively connected to the outputs of the combustion air supply amount detectors 112A, 113A and 121E and fuel supply amount detector 122B. On the basis of the inferred total combustion air supply amount $AIR_{TL}^f$, the inferred SCC burner fuel supply amount $F_2^f$, the detected PCC upper combustion air supply amount $AIR_{1H}$*, the detected PCC lower combustion air supply amount $AIR_{1L}$*, the detected total combustion air supply amount $AIR_{TL}$ * and the detected SCC burner fuel supply amount $F_2$*, the sequence controller 230 obtains a target total combustion air supply amount $AIR_{TL}^o$ and a target SCC burner fuel supply amount $F_2^o$, and outputs these obtained values from first and second outputs.

The controller 200 further comprises a PID controller 240 having first and second inputs which are respectively connected to the first and second outputs of the sequence controller 230, third and fourth inputs which are respectively connected to outputs of a PCC upper combustion air supply amount manually setting device (not shown) and PCC lower combustion air supply amount manually setting device (not shown), and fifth to eighth inputs which are respectively connected to the outputs of the combustion air supply amount detectors 112A, 113A and 121E and fuel supply amount detector 122B for the SCC. The PID controller 240 also has first to fourth outputs which are respectively connected to the control terminals of the valve apparatuses 112B, 113B, 121F and 122C. The PID controller 240 o generates a PCC upper combustion air supply amount control signal $AIR_{1HC}$, a PCC lower combustion air supply amount control signal $AIR_{1LC}$, a total combustion air supply amount control signal $AIR_{TLC}$ and an SCC burner fuel supply amount control signal $F_{2C}$ which are used for controlling the valve apparatuses 112B, 113B, 121F and 122C so as to attain a target PCC upper combustion air supply amount $AIR_{1H}^M$, a target PCC lower combustion air supply amount $AIR_{1L}^M$, the target total combustion air supply amount $AIR_{TL}^o$ and the target SCC burner fuel supply amount $F_2^o$. These control signals are output from first to fourth outputs.

The PID controller 240 comprises a comparator 241A, a PID controller 241B, a comparator 241C and an open degree adjustor 241D. The comparator 241A has a noninverting input which is connected to the output of the PCC upper combustion air supply amount manually setting device (not shown), and an inverting input which is connected to an output of the combustion air supply amount detector 112A. The comparator 241A obtains the difference (referred to as "controlled PCC upper combustion air supply amount") $AIR_{1H}^{M*}$ between the target PCC upper combustion air supply amount $AIR_{1H}^M$ and the detected PCC upper combustion air supply amount $AIR_{1H}$*. The PID controller 241B has an input connected to an output of the comparator 241A, and calculates an open degree (referred to as "target open degree") $AP_1^M$ of the valve apparatus 112B which corresponds to the controlled PCC upper combustion air supply amount $AIR_{1H}^{M*}$. The comparator 241C o has a noninverting input which is connected to an output of the PID controller 241B, and an inverting input which is connected to an output of the open degree detector 112B3 of the valve apparatus 112B. The comparator 241C obtains the difference (referred to as "controlled open degree") $AP_1^{M*}$ between the target open degree $AP_1^M$ of the valve apparatus 112B and the detected open degree $AP_1$*. The open degree adjustor 241D has an input connected to an output of the comparator 241C, and an output connected to the control terminal of the drive motor $112B_1$ for the valve apparatus 112B. The open degree adjustor 241D generates a PCC upper combustion air supply amount control signal $AIR_{1HC}$ which corresponds to the controlled open degree $AP_1^{M*}$ and which is given to the drive motor $112B_1$ for the valve apparatus 112B.

Moreover, the PID controller 240 comprises a comparator 242A, a PID controller 242B, a comparator 242C and an open degree adjustor 242D. The comparator 242A has a noninverting input which is connected to an output of the PCC lower combustion air supply amount manually setting device (not shown), and an inverting input which is connected to an output of the combustion air supply amount detector 113A. The comparator 242A obtains the difference (referred to as "controlled PCC lower combustion air supply amount") $AIR_{1L}^{M*}$ between the target PCC lower combustion air supply amount $AIR_{1L}^M$ and the detected PCC lower combustion air supply amount $AIR_{1L}$*, The PID controller 242B has an input connected to an output of the comparator 242A, and calculates an open degree (referred to as "target open degree") $AP_2^M$ of the valve apparatus 113B which corresponds to the controlled PCC lower combustion air supply amount $AIR_{1L}^{M*}$. The comparator 242C has a noninverting input which is connected to an output of the PID controller 242B, and an inverting input which is connected to an output of the open degree detector $113B_3$ for the valve apparatus 113B. The comparator 242C obtains the difference (referred to as "controlled open degree") $AP_2^{M*}$ between the target open degree $AP_2^o$ of the valve apparatus 113B and the detected open degree $AP_2$*. The open degree adjustor 242D has an input connected to an output of the comparator 242C, and an output connected to the control terminal of the drive motor $113B_1$ for the valve apparatus 113B. The open degree adjustor 242D generates a PCC lower combustion air supply amount control signal $AIR_{1LC}$ which corresponds to the controlled open degree $AP_2^{M*}$ and which is given to the drive motor $113B_1$ for the valve apparatus 113B.

Moreover, the PID controller 240 comprises a comparator 243A, a PID controller 243B, a comparator 243C and an open degree adjustor 243D. The comparator 243A has a noninverting input which is connected to the first output of the sequence controller 230, and an inverting input which is connected to an output of the combustion air supply amount detector 121E. The comparator 243A obtains the difference (referred to as "controlled total combustion air supply amount") $AIR_{TL}o^*$ between the target total combustion air supply amount $AIR_{TL}o$ and the detected total combustion air supply amount $AIR_{TL}^*$. The PID controller 243B has an input connected to an output of the comparator 243A, and calculates an open degree (referred to as "target open degree") $AP_3o$ of the valve apparatus 121F which corresponds to the controlled total combustion air supply amount $AIR_{TL}o^*$. The comparator 243C has a noninverting input which is connected to an output of the PID controller 243B, and an inverting input which is connected to an output of the open degree detector 121F$_3$ for the valve apparatus 121F. The comparator 243A obtains the difference (referred to as "controlled open degree") $AP_3o^*$ between the target open degree $AP_3o$ of the valve apparatus 121F and the detected open degree $AP_3^*$. The open degree adjustor 243D has an input connected to an output of the comparator 243C, and an output connected to the control terminal of the drive motor 121F$_1$ for the valve apparatus 121F. The open degree adjustor 243D generates the total combustion air supply amount control signal $AIR_{TLC}$ which corresponds to the controlled open degree $AP_3o^*$ and which is given to the drive motor 121F$_l$ for the valve apparatus 121F.

Furthermore, the PID controller 240 comprises a comparator 244A, a PID controller 244B, a comparator 244C and an open degree adjustor 244D. The comparator 244A has a noninverting input which is connected to the second output of the sequence controller 230, and an inverting input which is connected to an output of the fuel supply amount detector 122B. The comparator 244A obtains the difference (referred to as "controlled SCC burner fuel supply amount") $F_2o^*$ between the target SCC burner fuel supply amount $F_2o$ and the detected SCC burner fuel supply amount $F_2^*$. The PID controller 244B has an input connected to an output of the comparator 244A, and calculates an open degree (referred to as "target open degree") $AP_4o$ of the valve apparatus 122C which corresponds to the controlled SCC burner fuel supply amount $F_2o^*$. The comparator 244C has a noninverting input which is connected to an output of the PID controller 244B, and an inverting input which is connected to an output of the open degree detector 122C$_3$ for the valve apparatus 122C. The comparator 244C obtains the difference (referred to as "controlled open degree") $AP_4o^*$ between the target open degree $AP_4o$ of the valve apparatus 122C and the detected open degree $AP_4^*$. The open degree adjustor 244D has an input connected to an output of the comparator 244C, and an output connected to the control terminal of the drive motor 122C$_1$ for the valve apparatus 122C. The open degree adjustor 244D generates the SCC burner fuel supply amount control signal $F_{2C}$ which corresponds to the controlled open degree $AP_4o$ and which is given to the drive motor 122C$_1$ for the valve apparatus 122C.

The controller 200 further comprises a manual controller 250 and a display device 260. The manual controller 250 has first to fifth outputs which are respectively connected to the control terminals of the valve apparatuses 111E and 114D, air blower 111C, PCC burner 114 and SCC burner 122. When manually operated by the operator, the manual controller 250 generates o a dried sludge supply amount control signal $D_C$ which is given to the valve apparatus 111E so that the dried sludge supply amount D for the PCC 110A is adequately adjusted, and a PCC burner fuel supply amount control signal $F_{1C}$ which is supplied to the valve apparatus 114D so that the PCC burner fuel supply amount $F_1$ for the PCC burner 114 is adequately adjusted, and gives a control signal $FN_C$ for activating the air blower 111C thereto, an ignition control signal $IG_1$ for igniting the PCC burner 114 thereto, and an ignition control signal $IG_2$ for igniting the SCC burner 122 thereto. The display device 260 has an input which is connected to at least one of the outputs of the dried sludge supply amount detector 111D, combustion air supply amount detectors 112A, 113A and 121E, fuel supply amount detectors 114C and 122B, PCC upper portion temperature detector 115, PCC lower portion temperature detector 116, NOX concentration detector 131, oxygen concentration detector 132 and slag temperature detector 133. The display device 260 displays at least one of the detected dried sludge supply amount D*, detected PCC upper combustion air supply amount $AIR_{1H}^*$, detected PCC lower combustion air supply amount $AIR_{1L}^*$, detected total combustion air supply amount $AIR_{TL}^*$, detected PCC burner fuel supply amount $F_1^*$, detected SCC burner fuel supply amount $F_2^*$, detected PCC upper portion temperature $T_{1H}^*$, detected PCC lower portion temperature $T_{1L}^*$, detected combustion gas NOX concentration $CON_{NOX}^*$, detected combustion gas oxygen concentration $CON_{O2}^*$ and detected slag temperature $T_3^*$.

Function of the Third Embodiment

Next, referring to FIGS. 1, 5 to 12 and 20 to 22, the function of the third embodiment of the dried sludge melting furnace of the invention will be described in detail. In order to simplify description, description duplicated with that of the first embodiment in conjunction with FIGS. 1 to 16 is omitted as much as possible

Correction of the Detected Slag Temperature $T_3^*$

The temperature correcting device 210 of the controller 200 corrects the detected value of the slag temperature $T_3$ (i.e., the detected slag temperature $T_3^*$) sent from the slag temperature detector 133, according to Ex. 13 or Ex. 16, and on the basis of the detected value of the slag temperature $T_3$ (i.e., the detected slag temperature $T_3^*$) sent from the slag temperature detector 133, the detected value of the dried sludge supply amount D (i.e., the detected dried sludge supply amount D*) sent from the dried sludge supply amount detector 111D, the detected value of the combustion gas oxygen concentration $CON_{O2}$ (i.e., the detected combustion gas oxygen concentration $CON_{O2}^*$) sent from the oxygen concentration detector 132, and the detected value of the total combustion air supply amount $AIR_{TL}$ (i.e., the detected total combustion air supply amount $AIR_{TL}^*$) sent from the combustion air supply amount detector 121E. The value is given as the corrected slag temperature $T_3^{}$ to the fuzzy inference device 222 of the fuzzy controller 220**.

[Ex. 13]

$$T_3^{**}=T_3^*+\Delta T_{SL}$$

In Ex. 13, $T_{SL}$ is a correction amount for the detected slag temperature $T_3^*$, and can be expressed by Ex. 14 using the slag pouring point $T_S$ and appropriate temperature correction coefficients c and d. The temperature correction coefficients c and d may be adequately determined on the basis of data displayed on the display device 260 and manually set to the temperature correcting device 210, or may be adequately determined in the temperature correcting device 210 on the basis of at least one of the detected slag temperature $T_3$* the detected dried sludge supply amount D*, the detected combustion gas oxygen concentration $CON_{O2}$* and the detected total combustion air supply amount $AIR_{TL}$ * which are given to the temperature correcting device 210. Alternatively, the coefficients c and d may be suitably calculated by a temperature correction coefficient setting device (not shown) and then given to the temperature correcting device 210.

[Ex. 14]

$$\Delta T_{SL} = C(T_S - d)$$

Using the detected combustion gas oxygen concentration $CON_{O2}$*, the detected total combustion air supply amount $AIR_{TL}$* the detected dried sludge supply amount D* and the water o content W of dried sludge, the slag pouring point $T_S$ of Ex. 14 can be expressed by Ex. 15 as follows:

Ex. 15]

$$T_S = 1490 - (21 - CON_{O2}^{*}) \times AIR_{TL}^{*} \times 69 \times 100 / \{D^{*}(100 - W) \times 21\}$$

Therefore, Ex. 13 can be modified as Ex. 16.

[Ex. 16]

$$T_3^{**} = T_3^{*} + C[1490 - (21 - CON_{O2}^{*}) \times AIR_{TL}^{*} \times 69 \times 100 / \{D^{*}(100 - W) \times 21 - d\}]$$

Fuzzy Inference

The fuzzy controller 220 of the controller 200 executes the fuzzy inference as follows.

In accordance with the corrected slag temperature $T_3$** and the detected combustion gas oxygen concentration $CON_{O2}$*, the fuzzy inference device 222 executes fuzzy inference to obtain the SCC burner fuel supply amount $F_2$ and the total combustion air supply amount $AIR_{TL}$, on the basis of fuzzy rules $g_1$ to $g_9$ which are shown in Table 2 and held among the fuzzy set G relating to the slag temperature $T_3$, the fuzzy set D relating to the combustion gas oxygen concentration $CON_{O2}$, the fuzzy set H relating to the SCC burner fuel supply amount $F_2$ and the fuzzy set I relating to the total combustion air supply amount $AIR_{TL}$. These obtained amounts are given to the sequence controller 230 as the inferred SCC burner fuel supply amount $F_2^f$ and the inferred total combustion air supply amount $AIR_{TL}^f$, respectively.

When the detected slag temperature $T_3$* is 1,170° C. and the detected combustion gas oxygen concentration $CONO_{O2}$* is 3.4 wt. %, for example, the fuzzy inference device 222 obtains the grade of membership functions $NL_G$, $NS_G$, $ZR_G$ and $PS_G$ of the fuzzy set G relating to the slag temperature $T_3$ and shown in FIG. 6B, and the grade of membership functions $NL_D$, $NS_D$, $ZR_D$, $PS_D$ and $PL_D$ of the fuzzy set D relating to the combustion gas oxygen concentration $CONO_2$ and shown in FIG. 7A, as shown in FIGS. 11A and 11B and Table 5.

With respect to the fuzzy rules $g_1$ to $g_9$, the fuzzy inference device 222 then compares the grade of membership functions $NL_G$, $NS_G$, $ZR_G$ and $PS_G$ of the fuzzy set G relating to the slag temperature $T_3$ and shown in FIG. 6B with the grade of membership functions $NL_D$, $NS_D$, $ZR_D$, $PS_D$ and $PL_D$ of the fuzzy set D relating to the combustion gas oxygen concentration $CON_{O2}$ and shown in FIG. 7A, in FIGS. 11A and 11B and Table 5. The minimum one of them is set as shown in Table 5 as the grade of membership functions $NL_H$, $NS_H$, $ZR_H$, $PS_H$ and $PL_H$ of the fuzzy set H relating to the SCC burner fuel supply amount $F_2$ and shown in FIG. 8A, and as the grade of membership functions $NL_I$, $NS_I$, $ZR_I$, $PS_I$ and $PL_I$ of the fuzzy set I relating to the total combustion air supply amount $AIR_{TL}$ and shown in FIG. 8B.

With respect to the fuzzy rules $g_1$ to $g_9$, the fuzzy inference device 222 modifies the membership functions $NL_H$, $NS_H$, $ZR_H$, $PS_H$ and $PL_H$ of the fuzzy set H relating to the SCC burner fuel supply amount $F_2$ and shown in FIG. 8A to a stepladder-like (in this case, triangular) membership function $PL_H^{*1}$ which is cut at the grade position indicated in Table 5 (see FIG. 12A). In FIG. 12A, cases where the grade is 0.0 are not shown.

The fuzzy inference device 222 calculates the center of gravity of the hatched area enclosed by the stepladder-like membership function $PL_H^{*1}$ which has been produced in the above-mentioned process, as shown in FIG. 12A, and outputs its abscissa of 2.5 liter/h to the sequence controller 230 as the inferred SCC combustion fuel supply amount (in this case, the corrected value for the current value) $F_2^f$.

With respect to the fuzzy rules $g_1$ to $g_9$, the fuzzy inference device 222 further modifies the membership functions $NL_I$, $NS_I$, $ZR_I$, $PS_I$ and $PL_I$ of the fuzzy set I relating to the total combustion air supply amount $AIR_{TL}$ and shown in FIG. 8B to stepladder-like membership functions $NS_I^{*8}$ and $NL_I^{*9}$ which are cut at the grade positions indicated in Table 5 (see FIG. 12B). In FIG. 12B, cases where the grade is 0.0 are not shown.

The fuzzy inference device 222 calculates the center of gravity of the hatched area enclosed by the stepladder-like membership functions $NS_I^{*8}$ and $NL_I^{*9}$ which have been produced in the above-mentioned process, as shown in FIG. 12B, and outputs its abscissa of −26.1 $Nm^3/h$ to the sequence controller 230 as the inferred total combustion air supply amount (in this case, the corrected value for the current value) $AIR_{TL}^f$.

Sequence Control

The sequence controller 230 obtains mean values in a desired time period of the inferred SCC combustion fuel supply amount $F_2^f$ and the inferred total combustion air supply amount $AIR_{TL}^f$, in accordance with the inferred SCC burner fuel supply amount $F_2^f$ and inferred total combustion air supply amount $AIR_{TL}^f$ given form the fuzzy inference device 222 of the fuzzy controller 220, the detected total combustion air supply amount $AIR_{TL}$* given from the combustion air supply amount detector 121E, the detected PCC upper combustion air supply amount $AIR_{1H}$* given from the combustion air supply amount detector 112A, the detected PCC lower combustion air supply amount $AIR_{1L}$* given from the combustion air supply amount detector 113A and the detected SCC burner fuel supply amount $F_2$* given from the fuel supply amount detector 122B. The sequence controller 230 outputs the obtained values to the PID controller 240 as the target SCC burner fuel supply amount $F_2^\circ$ and the target total combustion air supply amount $AIR_{TL}^\circ$.

PID control

The PID controller 240 generates the following control signals as described below: the PCC upper combustion air supply amount control signal $AIR_{1HC}$ in order to change the PCC upper combustion air supply amount $AIR_{1H}$; the PCC lower combustion air supply amount control signal $AIR_{1LC}$ in order to adjust the PCC lower combustion air supply amount; the total combustion air supply amount control signal $AIR_{TLC}$ in order to adjust the total combustion air supply amount $AIR_{TL}$; and the SCC burner fuel supply amount control signal $F_{2C}$ in order to adjust the SCC burner fuel supply amount signal $F_2$, in accordance with the target PCC upper combustion air supply amount $AIR_{1H}^M$ given from the PCC upper combustion air supply amount manually setting device, target PCC lower combustion air supply amount $AIR_{1H}^M$ given from the PCC lower combustion air supply amount manually setting device, target total combustion air supply amount $AIR_{TL}^\circ$ and target SCC burner fuel supply amount $F_2^\circ$ given from the sequence controller 230, the detected total combustion air supply amount $AIR_{TL}^*$ given from the combustion air supply amount detector 121E, the detected PCC upper combustion air supply amount $AIR_{1H}^*$ given from the combustion air supply amount detector 112A, the detected PCC lower combustion air supply amount $AIR_{1L}^*$ given from the combustion air supply amount detector 113A, and the detected SCC burner fuel supply amount $F_2^*$ given from the fuel supply amount detector 122B. The generated signals are given to the valve apparatuses 112B, 113B, 121F and 122C, respectively.

In the PID controller 240, firstly, the comparator 241A compares the target PCC upper combustion air supply amount $AIR_{1H}^M$ given from the PCC upper combustion air supply amount manually setting device with the detected PCC upper combustion air supply amount $AIR_{1H}^*$ given from the combustion air supply amount detector 112A. The result of the comparison, or a correcting value $AIR_{1H}^{M*}$ of the PCC upper combustion air supply amount $AIR_{1H}$ is given to the PID controller 241B. In the PID controller 241B, an appropriate calculation corresponding to the correcting value $AIR_{1H}^{M*}$ of the PCC upper combustion air supply amount $AIR_{1H}$ is executed to obtain a correcting open degree $AP_1^M$ of the valve apparatus 112B. The comparator 241C compares the correcting open degree $AP_1^M$ with the detected open degree $AP_1^*$ given from the open degree detector 112B$_3$ of the valve apparatus 112B. The result of the comparison is given to the open degree adjustor 241D as a changing open degree $AP_1^{M*}$ of the control valve 112B$_2$ of the valve apparatus 112B. The open degree adjustor 241D generates the PCC upper combustion air supply amount control signal $AIR_{1HC}$ in accordance with the changing open degree $AP_1^{M*}$ and gives it to the drive motor 112B$_1$ for the valve apparatus 112B. In response to this, the drive motor 112B$_1$ suitably changes the open degree of the control valve 112B$_2$ so as to change the PCC upper combustion air supply amount $AIR_{1H}$ supplied to the upper portion of the PCC 110A, to a suitable value.

In the PID controller 240, then, the comparator 242A compares the target PCC lower combustion air supply amount $AIR_{1L}^M$ given from the PCC lower combustion air supply amount manually setting device with the detected PCC lower combustion air supply amount $AIR_{1L}^*$ given from the combustion air supply amount detector 113A. The result of the comparison, or a correcting value $AIR_{1L}^{M*}$ of the PCC lower combustion air supply amount $AIR_{1L}$ is given to the PID controller 242B. In the PID controller 242B, an appropriate calculation corresponding to the correcting value $AIR_{IL}^{M*}$ of the PCC lower combustion air supply amount $AIR_{1L}$ is executed to obtain a correcting open degree $AP_2^M$ of the valve apparatus 113B. The comparator 242C compares the correcting open degree $AP_2^o$ with the detected open degree $AP_2^*$ given from the open degree detector 113B$_3$ of the valve apparatus 113B. The result of the comparison is given to the open degree adjustor 242D as a changing open degree $AP_2^{M*}$ of the control valve 113B$_2$ of the valve apparatus 113B. The open degree adjustor 242D generates the PCC lower combustion air supply amount control signal $AIR_{1LC}$ in accordance with the changing open degree $AP_2^{M*}$ and gives it to the drive motor 113B$_1$ for the valve apparatus 113B. In response to this, the drive motor 113B$_1$ suitably changes the open degree of the control valve 113B$_2$ so as to change the PCC lower combustion air supply amount $AIR_{1L}$ supplied to the lower portion of the PCC 110A, to a suitable value.

In the PID controller 240, moreover, the comparator 243A compares the target total combustion air supply amount $AIR_{TL}^\circ$ given from the sequence controller 230 with the detected total combustion air supply amount $AIR_{TL}^*$ given from the combustion air supply amount detector 121E. The result of the comparison, or a correcting value $AIR_{TL}^{\circ *}$ of the total combustion air supply amount $AIR_{TL}$ is given to the PID controller 243B. In the PID controller 243B, an appropriate calculation corresponding to the correcting value $AIR_{TL}^{\circ *}$ of the total combustion air supply amount $AIR_{TL}$ is executed to obtain a correcting open degree $AP_3^o$ of the valve apparatus 121F. The comparator 243C compares the correcting open degree $AP_3^o$ with the detected open degree $AP_3^*$ given from the open degree detector 121F$_3$ of the valve apparatus 121F. The result of the comparison is given to the open degree adjustor 243D as a changing open degree $AP_3^{o*}$ of the control valve 121F$_2$ of the valve apparatus 121F. The open degree adjustor 243D generates the total combustion air supply amount control signal $AIR_{TLC}$ in accordance with the changing open degree $AP_3^{\circ *}$ and gives it to the drive motor 121F$_1$ for the valve apparatus 121F. In response to this, the drive motor 121F$_1$ suitably changes the open degree of the control valve 121F$_2$ so as to change the total combustion air supply amount $AIR_{TL}$ supplied to the PCC 110A and SCC 120A, to a suitable value.

In the PID controller 240, furthermore, the comparator 244A compares the target SCC burner fuel supply amount $F_2^o$ given from the sequence controller 230 with the detected SCC burner fuel supply amount $F_2^*$ given from the burner fuel supply amount detector 122B. The result of the comparison, or a correcting value $F_2^{o*}$ of the SCC burner fuel supply amount $F_2$ is given to the PID controller 244B. In the PID controller 244B, an appropriate calculation corresponding to the correcting value $F_2^{o*}$ of the SCC burner fuel supply amount $F_2$ is executed to obtain a correcting open degree $AP_4^o$ of the valve apparatus 122C. The comparator 244C compares the correcting open degree $AP_4^o$ with the detected open degree $AP_4^*$ given from the open degree detector 122C$_3$ of the valve apparatus 122C. The result of the comparison is given to the open degree adjustor 244D as a changing open degree $AP_4^{o*}$ of the control valve $122C_2$ of the valve apparatus 122C. The open degree adjustor 244D generates the SCC burner fuel supply amount control signal $F_{2C}$ in accordance with the changing open degree $AP_4{}^{o*}$ and gives it to the drive motor $122C_1$ for the valve apparatus 122C. In response to this, the drive motor $122C_1$ suitably changes the open degree of the control valve $122C_2$ so as to change the SCC burner fuel supply amount $F_2$ supplied to the SCC burner 122, to a suitable value.

Configuration of the Fourth Embodiment

Then, referring to FIGS. 1, 4, 23 and 24, the configuration of the fourth embodiment of the dried sludge melting furnace apparatus of the invention will be described in detail. In order to simplify description, description duplicated with that of the first embodiment in conjunction with FIGS. 1 to 4 is omitted as much as possible by designating components corresponding to those of the first embodiment with the same reference numerals.

The controller 200 comprises a fuzzy controller 220 having first to fifth inputs which are respectively connected to the outputs of the PCC upper portion temperature detector 115, slag temperature detector 133, NOX concentration detector 131, oxygen concentration detector 132 and PCC lower portion temperature detector 116. The fuzzy controller 220 executes fuzzy inference on the basis of fuzzy rules held among fuzzy sets, a fuzzy set A relating to the PCC lower portion temperature $T_{1L}$, a fuzzy set B relating to the PCC upper portion temperature $T_{1H}$, a fuzzy set C relating to the combustion gas NOX concentration $CON_{NOX}$, a fuzzy set D relating to the combustion gas oxygen concentration $CON_{02}$, a fuzzy set E relating to the PCC upper combustion air supply amount $AIR_{1H}$, a fuzzy set F relating to the PCC lower combustion air supply amount $AIR_{1L}$, a fuzzy set G relating to the slag temperature $T_3$, a fuzzy set H relating to the SCC burner fuel supply amount $F_2$ and a fuzzy set I relating to the total combustion air supply amount $AIR_{TL}$. As a result of the fuzzy inference, the fuzzy controller 220 obtains the PCC upper combustion air supply amount $AIR_{1H}$, the PCC lower combustion air supply amount $AIR_{1L}$, the total combustion air supply amount $AIR_{TL}$ and the SCC burner fuel supply amount $F_2$, and outputs these amounts from first to fourth outputs as an inferred PCC upper combustion air supply amount $AIR_{1H}{}^f$, an inferred PCC lower combustion air supply amount $AIR_{1L}{}^f$, an inferred total combustion air supply amount $AIR_{TL}{}^f$ and an inferred SCC burner fuel supply amount $F_2{}^f$.

The fuzzy controller 220 comprises a fuzzy inference device 221 and another fuzzy inference device 222. The fuzzy inference device 221 has first to fourth inputs which are respectively connected to the outputs of the NOX concentration detector 131, PCC lower portion temperature detector 116, PCC upper portion temperature detector 115 and oxygen concentration detector 132. The fuzzy inference device 221 executes fuzzy inference on the basis of first fuzzy rules held among the fuzzy set A relating to the PCC lower portion temperature $T_{1L}$, the fuzzy set B relating to the PCC upper portion temperature $T_{1H}$, the fuzzy set C relating to the combustion gas NOX concentration $CON_{NOX}$, the fuzzy set D relating to the combustion gas oxygen concentration $CON_{02}$, the fuzzy set E relating to the PCC upper combustion air supply amount $AIR_{1H}$ and the fuzzy set F relating to the PCC lower combustion air supply amount $AIR_{1L}$. As a result of the fuzzy inference, in accordance with the detected PCC lower portion temperature $T_{1L}{}^*$, the detected PCC upper portion temperature $T_{1H}{}^*$, the detected combustion gas NOX concentration $CON_{NOX}{}^*$ and the detected combustion gas oxygen concentration $CON_{02}{}^*$, the fuzzy inference device 221 obtains the PCC upper combustion air supply amount $AIR_{1H}$ and the PCC lower combustion air supply amount $AIR_{1L}$, and outputs these obtained amounts from first and second outputs as the inferred PCC upper combustion air supply amount $AIR_{1H}{}^f$ and the inferred PCC lower combustion air supply amount $AIR_{1L}{}^f$. The other fuzzy inference device 222 has first and second inputs which are respectively connected to the outputs of the oxygen concentration detector 132 and slag temperature detector 133. The other fuzzy inference device 222 executes fuzzy inference on the basis of second fuzzy rules held among the fuzzy set D relating to the combustion gas oxygen concentration $CON_{02}$, the fuzzy set G relating to the slag temperature $T_3$, the fuzzy set H relating to the SCC burner fuel supply amount $F_2$ and the fuzzy set I relating to the total combustion air supply amount $AIR_{TL}$. As a result of the fuzzy inference, in accordance with the detected slag temperature $T_3{}^*$ and the detected combustion gas oxygen concentration $CON_{02}{}^*$, the other fuzzy inference device 222 obtains the total combustion air supply amount $AIR_{TL}$ and the SCC burner fuel supply amount $F_2$, and outputs these amounts from first and second outputs as the inferred total combustion air supply amount $AIR_{TL}{}^f$ and the inferred SCC burner fuel supply amount $F_2{}^f$.

The controller 200 further comprises a sequence controller 230 having first to fourth inputs which are respectively connected to the first to fourth outputs of the fuzzy controller 220 (i.e., the first and second outputs of the fuzzy inference device 221 and the first and second outputs of the fuzzy inference device 222), and fifth to eighth inputs which are respectively connected to the outputs of the combustion air supply amount detectors 112A, 113A and 121E and fuel supply amount detector 122B. The sequence controller 230 obtains a target PCC upper combustion air supply amount $AIR_{1H}{}^\circ$, a target PCC lower combustion air supply amount $AIR_{1L}{}^\circ$, a target total combustion air supply amount $AIR_{TL}{}^\circ$ and a target SCC burner fuel supply amount $F_2{}^\circ$, on the basis of the inferred PCC upper combustion air supply amount $AIR_{1H}{}^f$, the inferred PCC lower combustion air supply amount $AIR_{1L}{}^f$, the inferred total combustion air supply amount $AIR_{TL}{}^f$, the inferred SCC burner fuel supply amount $F_2{}^f$, the detected PCC upper combustion air supply amount $AIR_{1H}{}^*$, the detected PCC lower combustion air supply amount $AIR_{1L}{}^*$, the detected total combustion air supply amount $AIR_{TL}{}^*$ and the detected SCC burner fuel supply amount $F_2{}^*$. These obtained values are output from first to fourth outputs.

The controller 200 further comprises a PID controller 240 having first to fourth inputs which are respectively connected to the first to fourth outputs of the sequence controller 230, and also fifth to eighth inputs which are respectively connected to the outputs of the combustion air supply amount detectors 112A, 113A and 121E and fuel supply amount detector 122B for the SCC. The PID controller 240 also has first to fourth outputs which are respectively connected to the control terminals of the valve apparatuses 112B, 113B, 121F and 122C. The PID controller 240 generates a PCC upper combustion air supply amount control signal $AIR_{1HC}$, a PCC lower combustion air supply amount control signal $AIR_{1LC}$, a total combustion air supply amount control signal $AIR_{TLC}$ and an SCC burner fuel supply amount control signal $F_{2C}$ which are used for controlling the valve apparatuses 112B, 113B, 121F and 122C so as to attain the target PCC upper combustion air supply amount $AIR_{1H}°$, the target PCC lower combustion air supply amount $AIR_{1L}°$, the target total combustion air supply amount $AIR_{TL}°$ and the target SCC burner fuel supply amount $F_2°$. These control signals are output from the first to fourth outputs.

The PID controller 240 comprises a comparator 241A, a PID controller 241B, a comparator 241C and an open degree adjustor 241D. The comparator 241A has a noninverting input which is connected to the first output of the sequence controller 230, and an inverting input which is connected to an output of the combustion air supply amount detector 112A. The comparator 241A obtains the difference (referred to as "controlled PCC upper combustion air supply amount") $AIR_{1H}°*$ between the target PCC upper combustion air supply amount $AIR_{1H}°$ and the detected PCC upper combustion air supply amount $AIR_{1H}*$. The PID controller 241B has an input connected to an output of the comparator 241A, and calculates an open degree (referred to as "target open degree") $AP_1°$ of the valve apparatus 112B which corresponds to the controlled PCC upper combustion air supply amount $AIR_{1H}°*$. The comparator 241C has a noninverting input which is connected to an output of the PID controller 241B, and an inverting input which is connected to an output of the open degree detector $112B_3$ of the valve apparatus 112B. The comparator 241C obtains the difference (referred to as "controlled open degree") $AP_1°*$ between the target open degree $AP_1°$ of the valve apparatus 112B and the detected open degree $AP_1*$. The open degree adjustor 241D has an input connected to an output of the comparator 241C, and an output connected to the control terminal of the drive motor $112B_1$ for the valve apparatus 112B. The open degree adjustor 241D generates the PCC upper combustion air supply amount control signal $AIR_{1HC}$ which corresponds to the controlled open degree $AP_1°*$ and which is given to the drive motor $112B_1$ for the valve apparatus 112B.

Moreover, the PID controller 240 comprises a comparator 242A, a PID controller 242B, a comparator 242C and an open degree adjustor 242D. The comparator 242A has a noninverting input which is connected to the second output of the sequence controller 230, and an inverting input which is connected to an output of the combustion air supply amount detector 113A. The comparator 242A obtains the difference (referred to as "controlled PCC lower combustion air supply amount") $AIR_{1L}°*$ between the target PCC lower combustion air supply amount $AIR_{1L}°$ and the detected PCC lower combustion air supply amount $AIR_{1L}*$. The PID controller 242B has an input connected to an output of the comparator 242A, and calculates an open degree (referred to as "target open degree") $AP_2°$ of the valve apparatus 113B which corresponds to the controlled PCC lower combustion air supply amount $AIR_{1L}°*$. The comparator 242C has a noninverting input which is connected to an output of the PID controller 242B, and an inverting input which is connected to an output of the open degree detector $113B_3$ for the valve apparatus 113B. The comparator 242C obtains the difference (referred to as "controlled open degree") $AP_2°*$ between the target open degree $AP_2°$ of the valve apparatus 113B and the detected open degree $AP_2*$. The open degree adjustor 242D has an input connected to an output of the comparator 242C, and an output connected to the control terminal of the drive motor $113B_1$ for the valve apparatus 113B. The open degree adjustor 242D generates the PCC lower combustion air supply amount control signal $AIR_{1LC}$ which corresponds to the controlled open degree $AP_2°*$ and which is given to the drive motor $113B_1$ for the valve apparatus 113B.

Moreover, the PID controller 240 comprises a comparator 243A, a PID controller 243B, a comparator 243C and an open degree adjustor 243D. The comparator 243A has a noninverting input which is connected to the third output of the sequence controller 230, and an inverting input which is connected to an output of the combustion air supply amount detector 121E. The comparator 243A obtains the difference (referred to as "controlled total combustion air supply amount") $AIR_{TL}°*$ between the target total combustion air supply amount $AIR_{TL}°$ and the detected total combustion air supply amount $AIR_{TL}*$. The controller 243B has an input connected to an output of the comparator 243A, and calculates an open degree (referred to as "target open degree") $AP_3°$ of the valve apparatus 121F which corresponds to the controlled total combustion air supply amount $AIR_{TL}°*$. The comparator 243C has a noninverting input which is connected to an output of the PID controller 243B, and an inverting input which is connected to an output of the open degree detector $121F_3$ for the valve apparatus 121F. The comparator 243A obtains the difference (referred to as "controlled open degree") $AP_3°*$ between the target open degree $AP_3°$ of the valve apparatus 121F and the detected open degree $AP_3*$. The open degree adjustor 243D has an input connected to an output of the comparator 243C, and an output connected to the control terminal of the drive motor $121F_1$ for the valve apparatus 121F. The open degree adjustor 243D generates the total combustion air supply amount control signal $AIR_{TLC}$ which corresponds to the controlled open degree $AP_3°*$ and which is given to the drive motor $121F_1$ for the valve apparatus 121F.

Furthermore, the PID controller 240 comprises a comparator 244A, a PID controller 244B, a comparator 244C and an open degree adjustor 244D. The comparator 244A has a noninverting input which is connected to the fourth output of the sequence controller 230, and an inverting input which is connected to an output of the fuel supply amount detector 122B. The comparator 244A obtains the difference (referred to as "controlled SCC burner fuel supply amount") $F_2°*$ between the target SCC burner fuel supply amount $F_2°$ and the detected SCC burner fuel supply amount $F_2*$. The PID controller 244B has an input connected to an output of the comparator 244A, and calculates an open degree (referred to as "target open degree") $AP_4°$ of the valve apparatus 122C which corresponds to the controlled SCC burner fuel supply amount $F_2°$. The comparator 244C has a noninverting input which is connected to an output of the PID controller 244B, and an inverting input which is connected to an output of the open degree detector $122C_3$ for the valve apparatus 122C. The comparator 244C obtains the difference (referred to as "controlled open degree") $AP_4°*$ between the target open degree $AP_4°$ of the valve apparatus 122C and the detected open degree $AP_4*$. The open degree adjustor 244D has an input connected to an output of the comparator 244C, and an output connected to the control terminal of the drive motor $122C_1$ for the valve apparatus 122C. The open degree adjustor 244D generates the SCC burner fuel supply amount control signal $F_{2C}$ which corresponds to the controlled open degree $AP_4$°* and which is given to the drive motor $122C_1$ for the valve apparatus 122C.

The controller 200 further comprises a manual controller 250 and a display device 260. The manual controller 250 has first to fifth outputs which are respectively connected to the control terminals of the valve apparatuses 111E and 114D, air blower 111C, PCC burner 114 and SCC burner 122. When manually operated by the operator, the manual controller 250 generates a dried sludge supply amount control signal $D_C$ which is given to the valve apparatus 111E so that the dried sludge supply amount D for the PCC 110A is adequately adjusted, and a PCC burner fuel supply amount control signal $F_{1C}$ which is supplied to the valve apparatus 114D so that the PCC burner fuel supply amount $F_1$ for the PCC burner 114 is adequately adjusted, and gives a control signal $FN_C$ for activating the air blower 111C thereto, an ignition control signal $IG_1$ for igniting the PCC burner 114 thereto, and an ignition control signal $IG_2$ for igniting the SCC burner 122 thereto. The display device 260 has an input which is connected to at least one of the outputs of the dried sludge supply amount detector 111D, combustion air supply amount detectors 112A, 113A and 121E, fuel supply amount detectors 114C and 122B, PCC upper portion temperature detector 115, PCC lower portion temperature detector 116, NOX concentration detector 131, oxygen concentration detector 132 and slag temperature detector 133. The display device 260 displays at least one of the detected dried sludge supply amount D*, detected PCC upper combustion air supply amount $AIR_{1H}$*, detected PCC lower combustion air supply amount $AIR_{1L}$*, detected total combustion air supply amount $AIR_{TL}$*, detected PCC burner fuel supply amount $F_1$*, detected SCC burner fuel supply amount $F_2$*, detected PCC upper portion temperature $T_{1H}$*, detected PCC lower portion temperature $T_{1L}$*, detected combustion gas NOX concentration $CON_{NOX}$*, detected combustion gas oxygen concentration $CON_{02}$* and detected slag temperature $T_3$*.

Function of the Fourth Embodiment

Next, referring to FIGS. 1, 4, 5, 7, 8 and 23 to 31, the function of the fourth embodiment of the dried sludge melting furnace of the invention will be described in detail. In order to simplify description, description duplicated with that of the first embodiment in conjunction with FIGS. 1 to 16 is omitted as much as possible.

Fuzzy inference

The fuzzy controller 220 of the controller 200 executes the fuzzy inference as follows.

In accordance with the detected comb the detected combustion gas oxygen concentration $CON_{02}$*, the fuzzy inference device 221 firstly executes the fuzzy inference to obtain the PCC upper combustion air supply amount $AIR_{1H}$ and the PCC lower combustion air supply amount $AIR_{1L}$, on the basis of fuzzy rules $f_{01}$ to $f_{30}$ shown in Table 1 and held among the fuzzy set A relating to the PCC lower portion temperature $T_{1L}$, the fuzzy set B relating to the PCC upper portion temperature $T_{1H}$, the fuzzy set C relating to the combustion gas NOX concentration $CON_{NOX}$, the fuzzy set D relating to the combustion gas oxygen concentration $CON_{02}$, the fuzzy set E relating to the PCC upper combustion air supply amount $AIR_{1H}$ and the fuzzy set F relating to the PCC lower combustion air supply amount $AIR_{1L}$. These obtained amounts are given to the sequence controller 230 as the inferred PCC upper combustion air supply amount $AIR_{1H}^f$ and the inferred PCC lower combustion air supply amount $AIR_{1L}^f$, respectively.

In accordance with the detected slag temperature $T_3$* and the detected combustion gas oxygen concentration $CON_{02}$*, the fuzzy inference device 222 executes fuzzy inference to obtain the SCC burner fuel supply amount $F_2$ and the total combustion air supply amount $AIR_{TL}$, on the basis of fuzzy rules $g_1$ to $g_9$ which are shogun in Table 2 and held among the fuzzy set G relating to the slag temperature $T_3$, the fuzzy set D relating to the combustion gas oxygen concentration $CON_{02}$, the fuzzy set H relating to the SCC burner fuel supply amount $F_2$ and the fuzzy set I relating to the total combustion air supply amount $AIR_{TL}$. These obtained amounts are given to the sequence controller 230 as the inferred SCC burner fuel supply amount $F_2^f$ and the inferred total combustion air supply amount $AIR_{TL}^f$, respectively.

Figure 25A:
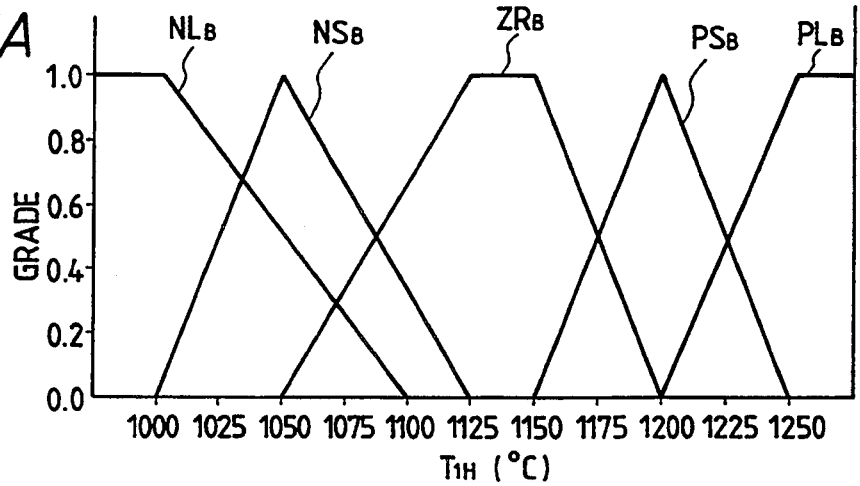
FIGS. 25A and 25B show graphs showing further exemplified membership functions belonging to fuzzy sets which are used in fuzzy inference performed in the fuzzy controller 220 included in the controller 200.

When the detected PCC lower portion temperature $T_{1L}$* is 1,107° C., the detected PCC upper portion temperature $T_{1H}$* is 1,260° C., the detected combustion gas NOX concentration $CON_{NOX}$* is 290 ppm and the detected combustion gas oxygen concentration $CON_{02}$* is 3.4 wt %, for example, the fuzzy inference device 221 obtains the grade of membership functions $ZR_A$, $PS_A$ and $PL_A$ of the fuzzy set A relating to the PCC lower portion temperature $T_{1L}$ and shown in FIG. 5A, the grade of membership functions $NL_B$, $NS_B$, $ZR_B$, $PS_B$ and $PL_B$ of the fuzzy set B relating to the PCC upper portion temperature $T_{1H}$ and shown in FIG. 25A, the grade of membership functions $ZR_C$, $PS_C$, $PM_C$ and $PL_C$ of the fuzzy set C relating to the combustion gas NOX concentration $CON_{NOX}$ and shown in FIG. 5B, and the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, as shown in FIGS. 26A to 26D and Table 7.

[TABLE 7]

| FUZZY RULE | ANTECEDENT $T_{1L}$ | | $T_{1H}$ | | $CON_{NOX}$ | | $CON_{O2}$ | |
|---|---|---|---|---|---|---|---|---|
| $f_{01}$ | — | — | $NL_B$ | 0.0 | $ZR_C$ | 0.09 | — | — |
| $f_{02}$ | — | — | $NL_B$ | 0.0 | $PS_C$ | 0.91 | — | — |
| $f_{03}$ | — | — | $NL_B$ | 0.0 | $PM_C$ | 0.0 | — | — |
| $f_{04}$ | — | — | $NL_B$ | 0.0 | $PL_C$ | 0.0 | — | — |
| $f_{05}$ | — | — | $NS_B$ | 0.0 | — | — | — | — |
| $f_{06}$ | $ZR_A$ | 0.68 | $ZR_B$ | 0.0 | $ZR_C$ | 0.09 | — | — |
| $f_{07}$ | $PS_A$ | 0.32 | $ZR_B$ | 0.0 | $ZR_C$ | 0.09 | — | — |
| $f_{08}$ | $PL_A$ | 0.0 | $ZR_B$ | 0.0 | $ZR_C$ | 0.09 | — | — |
| $f_{09}$ | $ZR_A$ | 0.68 | $ZR_B$ | 0.0 | $PS_C$ | 0.91 | — | — |
| $f_{10}$ | $PS_A$ | 0.32 | $ZR_B$ | 0.0 | $PS_C$ | 0.91 | — | — |
| $f_{11}$ | $PL_A$ | 0.0 | $ZR_B$ | 0.0 | $PS_C$ | 0.91 | — | — |
| $f_{12}$ | — | — | $ZR_B$ | 0.0 | $PM_C$ | 0.0 | — | — |
| $f_{13}$ | — | — | $ZR_B$ | 0.0 | $PL_C$ | 0.0 | — | — |
| $f_{14}$ | $ZR_A$ | 0.68 | $PS_B$ | 0.0 | $ZR_C$ | 0.09 | — | — |
| $f_{15}$ | $PS_A$ | 0.32 | $PS_B$ | 0.0 | $ZR_C$ | 0.09 | — | — |
| $f_{16}$ | $PL_A$ | 0.0 | $PS_B$ | 0.0 | $ZR_C$ | 0.09 | — | — |
| $f_{17}$ | — | — | $PS_B$ | 0.0 | $PS_C$ | 0.91 | — | — |
| $f_{18}$ | $ZR_A$ | 0.68 | $PS_B$ | 0.0 | $PM_C$ | 0.0 | — | — |
| $f_{19}$ | $PS_A$ | 0.32 | $PS_B$ | 0.0 | $PM_C$ | 0.0 | — | — |
| $f_{20}$ | $PL_A$ | 0.0 | $PS_B$ | 0.0 | $PM_C$ | 0.0 | — | — |
| $f_{21}$ | $ZR_A$ | 0.68 | $PS_B$ | 0.0 | $PL_C$ | 0.0 | — | — |
| $f_{22}$ | $PS_A$ | 0.32 | $PS_B$ | 0.0 | $PL_C$ | 0.0 | — | — |
| $f_{23}$ | $PL_A$ | 0.0 | $PS_B$ | 0.0 | $PL_C$ | 0.0 | — | — |
| $f_{24}$ | $ZR_A$ | 0.68 | $PL_B$ | 1.0 | — | — | — | — |
| $f_{25}$ | $PS_A$ | 0.32 | $PL_B$ | 1.0 | $ZR_C$ | 0.09 | — | — |
| $f_{26}$ | $PL_A$ | 0.0 | $PL_B$ | 1.0 | — | — | — | — |

[TABLE 7]-continued

| FUZZY RULE | ANTECEDENT $T_{1L}$ | | $T_{1H}$ | | $CON_{NOX}$ | | $CON_{O2}$ | |
|---|---|---|---|---|---|---|---|---|
| $f_{27}$ | $PS_A$ | 0.32 | $PL_B$ | 1.0 | $PS_C$ | 0.91 | — | — |
| $f_{28}$ | $PS_A$ | 0.32 | $PL_B$ | 1.0 | $PM_C$ | 0.0 | — | — |
| $f_{29}$ | $PS_A$ | 0.32 | $PL_B$ | 1.0 | $PL_C$ | 0.0 | — | — |
| $f_{30}$ | — | — | — | — | — | — | $NL_D$ | 0.0 |

Antecedent

PCC lower portion temperature $T_{1L}$

PCC upper portion temperature $T_{1H}$

Combustion gas NOX concentration $CON_{NOX}$

Combustion gas oxygen concentration $CON_{02}$

Note: The values in the table indicate compatibilities (grades).

With respect to each of the fuzzy rules $f_{01}$ to $f_{30}$, the fuzzy inference device 221 then compares the grade of membership functions $ZR_A$, $PS_A$ and $PL_A$ of the fuzzy set A relating to the PCC lower portion temperature $T_{1L}$ and shown in FIG. 5A, the grade of membership functions $NL_B$, $NS_B$, $ZR_B$, $PS_B$ and $PL_B$ of the fuzzy set B relating to the PCC upper portion temperature $T_{1H}$ and shown in FIG. 25A, the grade of membership functions $ZR_C$, $PS_C$, $PM_C$ and $PL_C$ of the fuzzy set C relating to the combustion gas NOX concentration $CON_{NOX}$ and shown in FIG. 5B, and the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, with each other in FIGS. 26A to 26D and Table 7. The minimum one among them is set as shown in Table 8 as the grade of membership functions $NL_E$, $NS_E$, $ZR_E$, $PS_E$ and $PL_E$ of the fuzzy set E relating to the PCC upper combustion air supply amount $AIR_{1H}$ and shown in FIG. 7B, and also as the grade of membership functions $NL_F$, $NS_F$, $ZR_F$, $PS_F$ and $PL_F$ of the fuzzy set F relating to the PCC lower combustion air supply amount $AIR_{1L}$ and shown in FIG. 7C.

[TABLE 8]

| FUZZY RULE | CONSEQUENT $AIR_{1H}$ | | $AIR_{1L}$ | |
|---|---|---|---|---|
| $f_{01}$ | $PS_E$ | 0.0 | $NS_F$ | 0.0 |
| $f_{02}$ | $PS_E$ | 0.0 | $NS_F$ | 0.0 |
| $f_{03}$ | $PS_E$ | 0.0 | $NS_F$ | 0.0 |
| $f_{04}$ | $PS_E$ | 0.0 | $NL_F$ | 0.0 |
| $f_{05}$ | $PS_E$ | 0.0 | $NS_F$ | 0.0 |
| $f_{06}$ | $ZR_E$ | 0.0 | $ZR_F$ | 0.0 |
| $f_{07}$ | $ZR_E$ | 0.0 | $ZR_F$ | 0.0 |
| $f_{08}$ | $NS_E$ | 0.0 | $ZR_F$ | 0.0 |
| $f_{09}$ | $ZR_E$ | 0.0 | $NS_F$ | 0.0 |
| $f_{10}$ | $ZR_E$ | 0.0 | $NS_F$ | 0.0 |
| $f_{11}$ | $NS_E$ | 0.0 | $ZR_F$ | 0.0 |
| $f_{12}$ | $NS_E$ | 0.0 | $ZR_F$ | 0.0 |
| $f_{13}$ | $NS_E$ | 0.0 | $ZR_F$ | 0.0 |
| $f_{14}$ | $ZR_E$ | 0.0 | $ZR_F$ | 0.0 |
| $f_{15}$ | $ZR_E$ | 0.0 | $ZR_F$ | 0.0 |
| $f_{16}$ | $NS_E$ | 0.0 | $PS_F$ | 0.0 |
| $f_{17}$ | $NS_E$ | 0.0 | $ZR_F$ | 0.0 |
| $f_{18}$ | $NS_E$ | 0.0 | $ZR_F$ | 0.0 |
| $f_{19}$ | $NS_E$ | 0.0 | $ZR_F$ | 0.0 |
| $f_{20}$ | $NL_E$ | 0.0 | $PS_F$ | 0.0 |
| $f_{21}$ | $NS_E$ | 0.0 | $ZR_F$ | 0.0 |
| $f_{22}$ | $NS_E$ | 0.0 | $ZR_F$ | 0.0 |
| $f_{23}$ | $NL_E$ | 0.0 | $PS_F$ | 0.0 |
| $f_{24}$ | $NS_E$ | 0.68 | $ZR_F$ | 0.68 |
| $f_{25}$ | $NS_E$ | 0.09 | $ZR_F$ | 0.09 |
| $f_{26}$ | $NL_E$ | 0.0 | $PS_F$ | 0.0 |
| $f_{27}$ | $NS_E$ | 0.32 | $ZR_F$ | 0.32 |
| $f_{28}$ | $NL_E$ | 0.0 | $PS_F$ | 0.0 |
| $f_{29}$ | $NL_E$ | 0.0 | $PS_F$ | 0.0 |

[TABLE 8]-continued

| FUZZY RULE | CONSEQUENT $AIR_{1H}$ | | $AIR_{1L}$ | |
|---|---|---|---|---|
| $f_{30}$ | — | — | $PS_F$ | 0.0 |

Consequent

PCC upper combustion air supply amount $AIR_{1H}$

PCC lower combustion air supply amount $AIR_{1L}$

Note: The values in the table indicate compatibilities (grades).

Figure 27A:
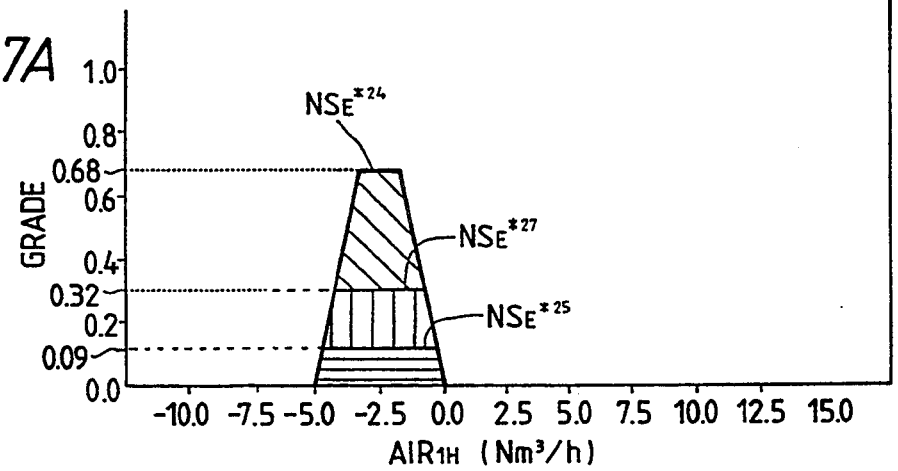
FIGS. 27A and 27B show graphs showing an example of fuzzy inference which is performed in the fuzzy inference device 222 of the fuzzy controller 220 included in the controller 200.

With respect to the fuzzy rules $f_{01}$ to $f_{30}$, the fuzzy inference device 221 modifies the membership functions $NL_E$, $NS_E$, $ZR_E$, $PS_E$ and $PL_E$ of the fuzzy set E relating to the PCC upper combustion air supply amount $AIR_{1H}$ and shown in FIG. 7B to stepladder-like membership functions $NS_E^{*24}$, $NS_E^{*25}$ and $NS_E^{*27}$ which are cut at the grade positions indicated in Table 8 (see FIG. 27A). In FIG. 27A, cases where the grade is 0.0 are not shown.

The fuzzy inference device 221 calculates the center of gravity of the hatched area enclosed by the stepladder-like membership functions $NS_E^{*24}$, $NS_E^{*25}$ and $NS_E^{*27}$ which have been produced in the above-mentioned process, as shown in FIG. 27A, and outputs its abscissa of $-2.5$ $Nm^3/h$ to the sequence controller 230 as the inferred PCC upper combustion air supply amount (in this case, the corrected value for the current value) $AIR_{1H}^f$.

Figure 27B:
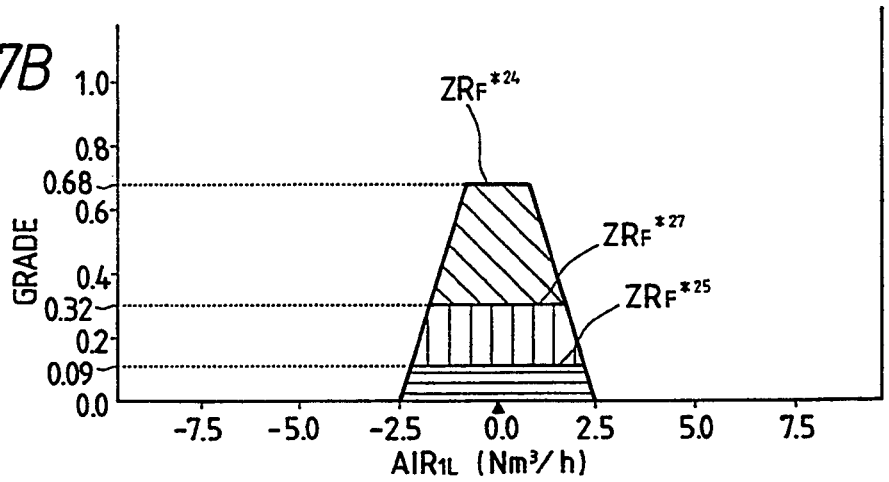

With respect to the fuzzy rules $f_{01}$ to $f_{30}$, the fuzzy inference device 221 further modifies the membership functions $NL_F$, $NS_F$, $ZR_F$, $PS_F$ and $PL_F$ of the fuzzy set F relating to the PCC lower combustion air supply amount $AIR_{1L}$ and shown in FIG. 7C to stepladder-like membership functions $ZR_F^{*24}$, $ZR_F^{*25}$ and $NR_F^{*27}$ which are cut at the grade positions indicated in Table 8 (see FIG. 27B). In FIG. 27B, cases where the grade is 0.0 are not shown.

The fuzzy inference device 221 calculates the center of gravity of the hatched area enclosed by the stepladder-like membership functions $ZR_F^{*24}$, $ZR_F^{*25}$ and $ZR_F^{*27}$ which have been produced in the above-mentioned process, as shown in FIG. 27B, and outputs its abscissa of 0.0 $Nm^3/h$ to the sequence controller 230 as the inferred PCC lower combustion air supply amount (in this case, the corrected value for the current value) $AIR_{1L}^f$.

Figure 25B:
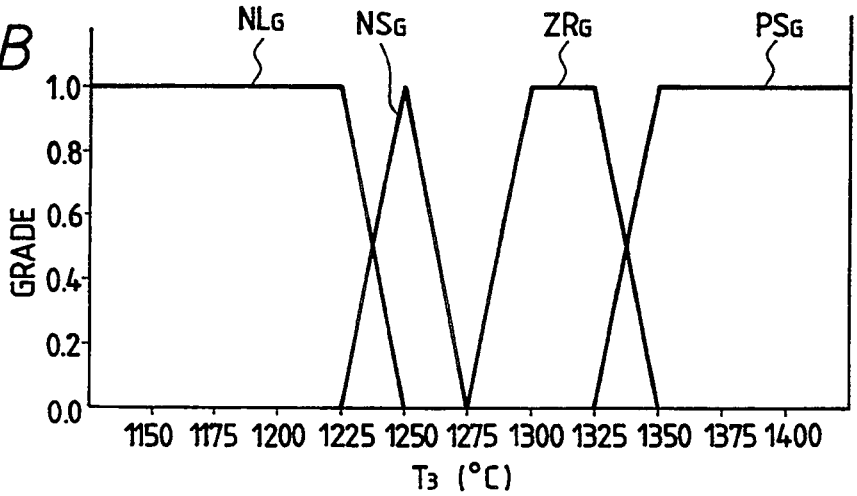
Figure 26A:
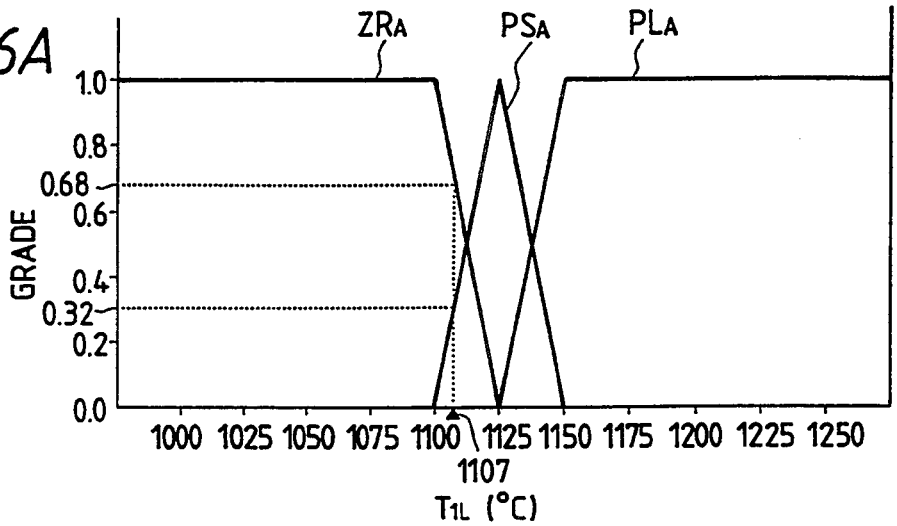
FIGS. 26A–26D show graphs showing an example of fuzzy inference which is performed in a fuzzy inference device 221 of the fuzzy controller 220 included in the controller 200.
Figure 26B:
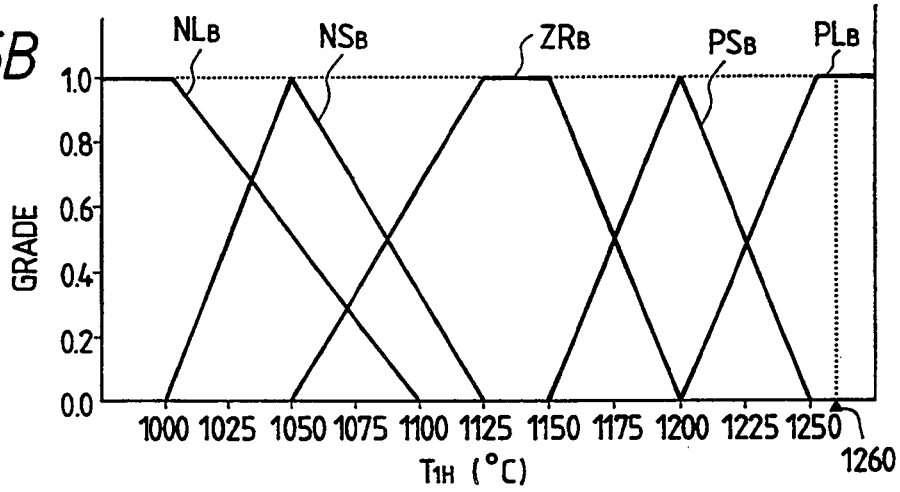
Figure 26C:
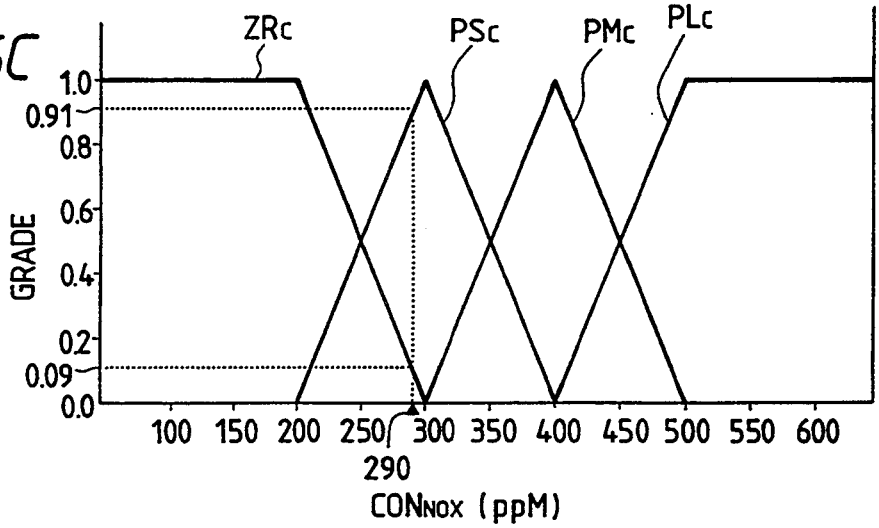
Figure 26D:
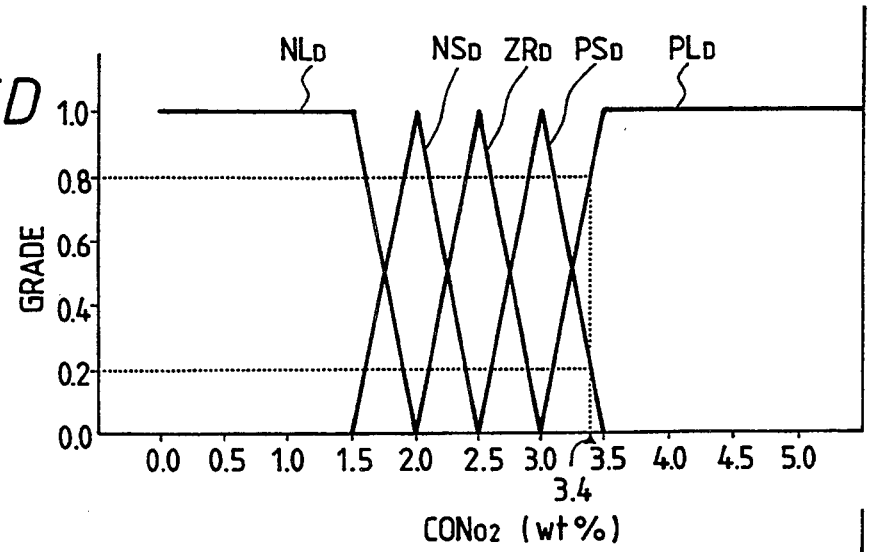
Figure 28A:
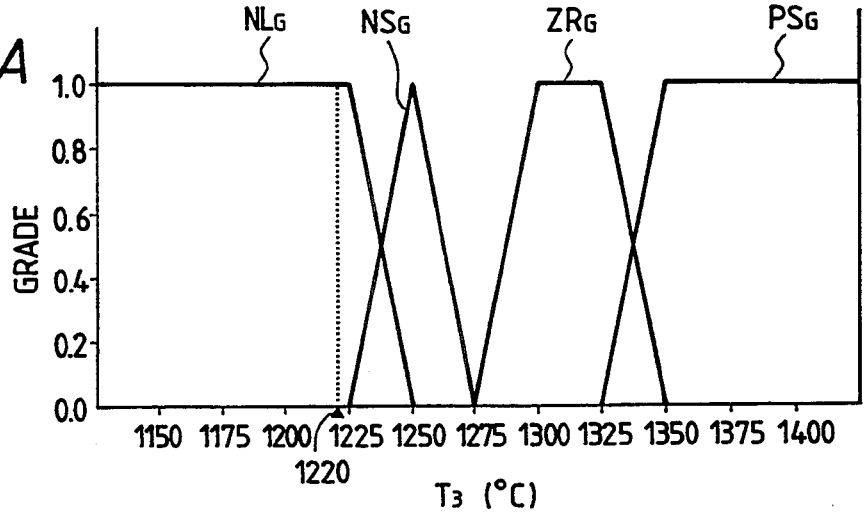
FIGS. 28A and 28B show graphs showing an example of fuzzy inference which is performed in the fuzzy inference device 222 of the fuzzy controller 220 included in the controller 200.
Figure 28B:
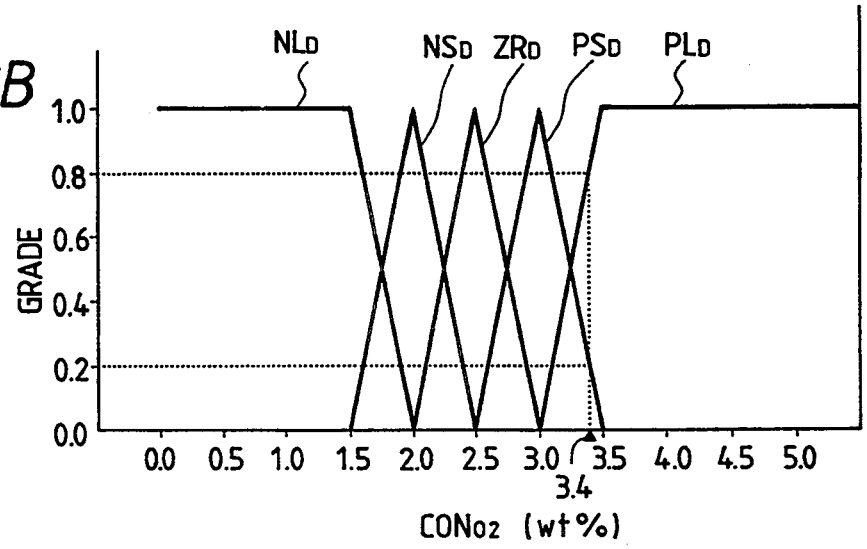

When the detected slag temperature $T_3$* is 1,220° C. and the detected combustion gas oxygen concentration $CON_{02}$* is 3.4 wt %, for example, the fuzzy inference device 222 obtains the grade of membership functions $NL_G$, $NS_G$, $ZR_G$ and $PS_G$ of the fuzzy set G relating to the slag temperature $T_3$ and shown in FIG. 25B, and the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, as shown in FIGS. 28A and 28B and Table 9.

[TABLE 9]

| FUZZY RULE | ANTECEDENT $T_3$ | | $CON_{O2}$ | | CONSEQUENT $F_2$ | | $AIR_{TL}$ | |
|---|---|---|---|---|---|---|---|---|
| $g_1$ | $NL_G$ | 1.0 | — | — | $PL_H$ | 1.0 | $NS_I$ | — |
| $g_2$ | $NS_G$ | 0.0 | — | — | $PS_H$ | 0.0 | $ZR_I$ | — |
| $g_3$ | $ZR_G$ | 0.0 | — | — | $ZR_H$ | 0.0 | $ZR_I$ | — |
| $g_4$ | $PS_G$ | 0.0 | — | — | $NS_H$ | 0.0 | $ZR_I$ | — |
| $g_5$ | — | — | $NL_D$ | 0.0 | — | — | $PL_I$ | 0.0 |
| $g_6$ | — | — | $NS_D$ | 0.0 | — | — | $PS_I$ | 0.0 |
| $g_7$ | — | — | $ZR_D$ | 0.0 | — | — | $ZR_I$ | 0.0 |
| $g_8$ | — | — | $PS_D$ | 0.2 | — | — | $NS_I$ | 0.2 |

[TABLE 9]-continued

| FUZZY RULE | ANTECEDENT | | | | CONSEQUENT | | | |
|---|---|---|---|---|---|---|---|---|
| | $T_3$ | | $CON_{O2}$ | | $F_2$ | | $AIR_{TL}$ | |
| $g_9$ | — | — | $PL_D$ | 0.8 | — | — | $NL_I$ | 0.8 |

Antecedent

Slag temperature $T_3$

Combustion gas oxygen concentration $CON_{02}$

Consequent

SCC burner fuel supply amount $F_2$

Total combustion air supply amount $AIR_{TL}$

With respect to each of the fuzzy rules $g_1$ to $g_9$, the fuzzy inference device 222 then compares the grade of membership functions $NL_G$, $NS_G$, $ZR_G$ and $PS_G$ of the fuzzy set G relating to the slag temperature $T_3$ and shown in FIG. 25B with the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, in FIGS. 28A and 28B and Table 9. The minimum one of them is set as shown in Table 9 as the grade of membership functions $NL_H$, $NS_H$, $ZR_H$, $PS_H$ and $PL_H$ of the fuzzy set H relating to the fuzzy set H relating to the SCC burner fuel supply amount $F_2$ and shown in FIG. 8A, and as the grade of membership functions $NL_I$, $NS_I$, $ZR_I$, $PS_I$ and $PL_I$ of the fuzzy set I relating to the total combustion air supply amount $AIR_{TL}$ and shown in FIG. 8B.

Figure 29A:
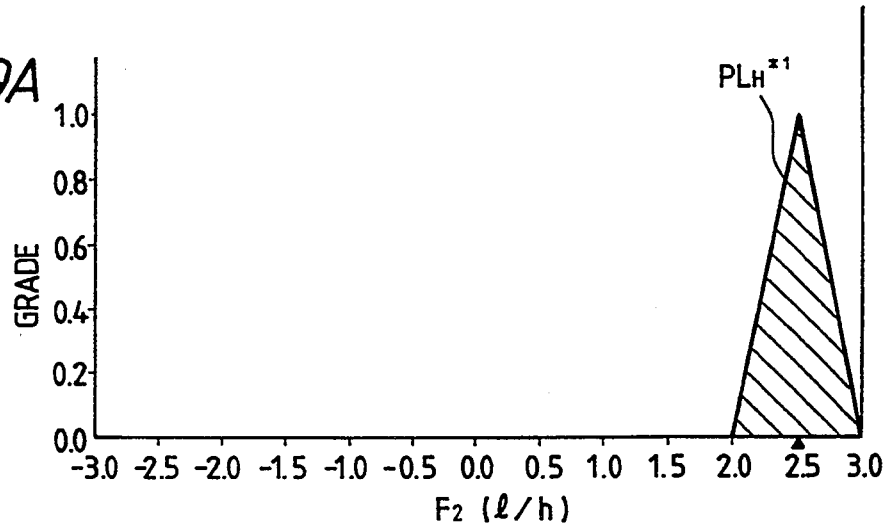
FIGS. 29A and 29B show graphs showing an example of fuzzy inference which is performed in the fuzzy inference device 222 of the fuzzy controller 220 included in the controller 200.

With respect to the fuzzy rules $g_1$ to $g_9$, the fuzzy inference device 222 modifies the membership functions $NL_H$, $NS_H$, $ZR_H$, $PS_H$ and $PL_H$ of the fuzzy set H relating to the SCC burner fuel supply amount $F_2$ and shown in FIG. 8A to a stepladder-like (in this case, triangular) membership function $PL_H^{*1}$ which is cut at the grade position indicated in Table 9 (see FIG. 29A). In FIG. 29A, cases where the grade is 0.0 are not shown.

The fuzzy inference device 222 calculates the center of gravity of the hatched area enclosed by the stepladder-like membership function $PL_H^{*1}$ which has been produced in the above-mentioned process, as shown in FIG. 29A, and outputs its abscissa of 2.5 liter/h to the sequence controller 230 as the inferred SCC combustion fuel supply amount (in this case, the corrected value for the current value) $F_2^f$.

Figure 29B:
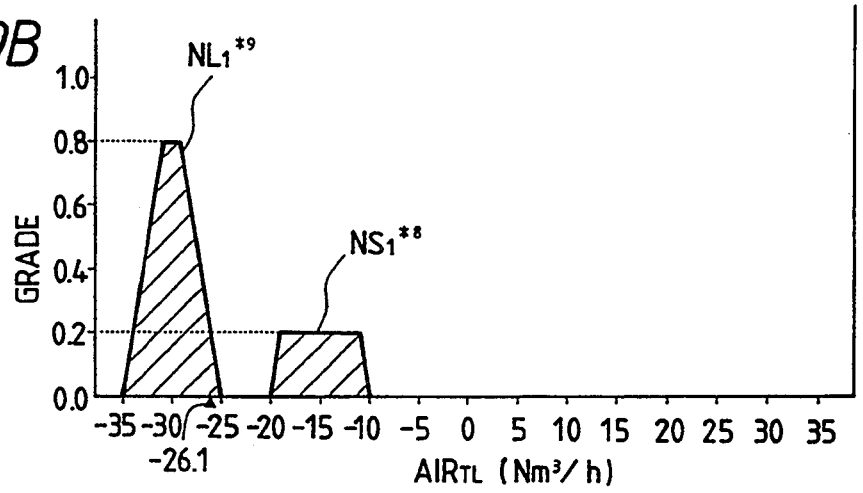

With respect to the fuzzy rules $g_1$ to $g_9$, the fuzzy inference device 222 further modifies the membership functions $NL_I$, $NS_I$, $ZR_I$, $PS_I$ and $PL_I$ of the fuzzy set I relating to the total combustion air supply amount $AIR_{TL}$ and shown in FIG. 8B to stepladder-like membership functions $NS_I^{*8}$ and $NL_I^{*9}$ which are cut at the grade positions indicated in Table 9 (see FIG. 29B). In FIG. 29B, cases where the grade is 0.0 are not shown.

The fuzzy inference device 222 calculates the center of gravity of the hatched area enclosed by the stepladder-like membership functions $NS_I^{*8}$ and $NL_I^{*9}$ which have been produced in the above-mentioned process, as shown in FIG. 29B, and outputs its abscissa of −26.1 $Nm^3/h$ to the sequence controller 230 as the inferred total combustion air supply amount (in this case, the corrected value for the current value) $AIR_{TL}^f$.

In the fuzzy inference performed in the fuzzy inference device 221, fuzzy rules $h_{01}$ to $h_{16}$ shown in Table 6 may be employed instead of the fuzzy rules $f_{01}$ to $f_{30}$ shown in Table 1. When the fuzzy rules $h_{01}$ to $h_{16}$ are employed, the fuzzy inference device 221 performs the fuzzy inference in the same manner as described above, and therefore, for the sake of convenience, its detail description is omitted.

Sequence control

The sequence controller 230 operates in the same manner as that of Embodiment 1 to execute the sequence control.

PID control

The PID controller 240 operates in the same manner as that of Embodiment 1 to execute the PID control.

Specific example of the control

Figure 30:
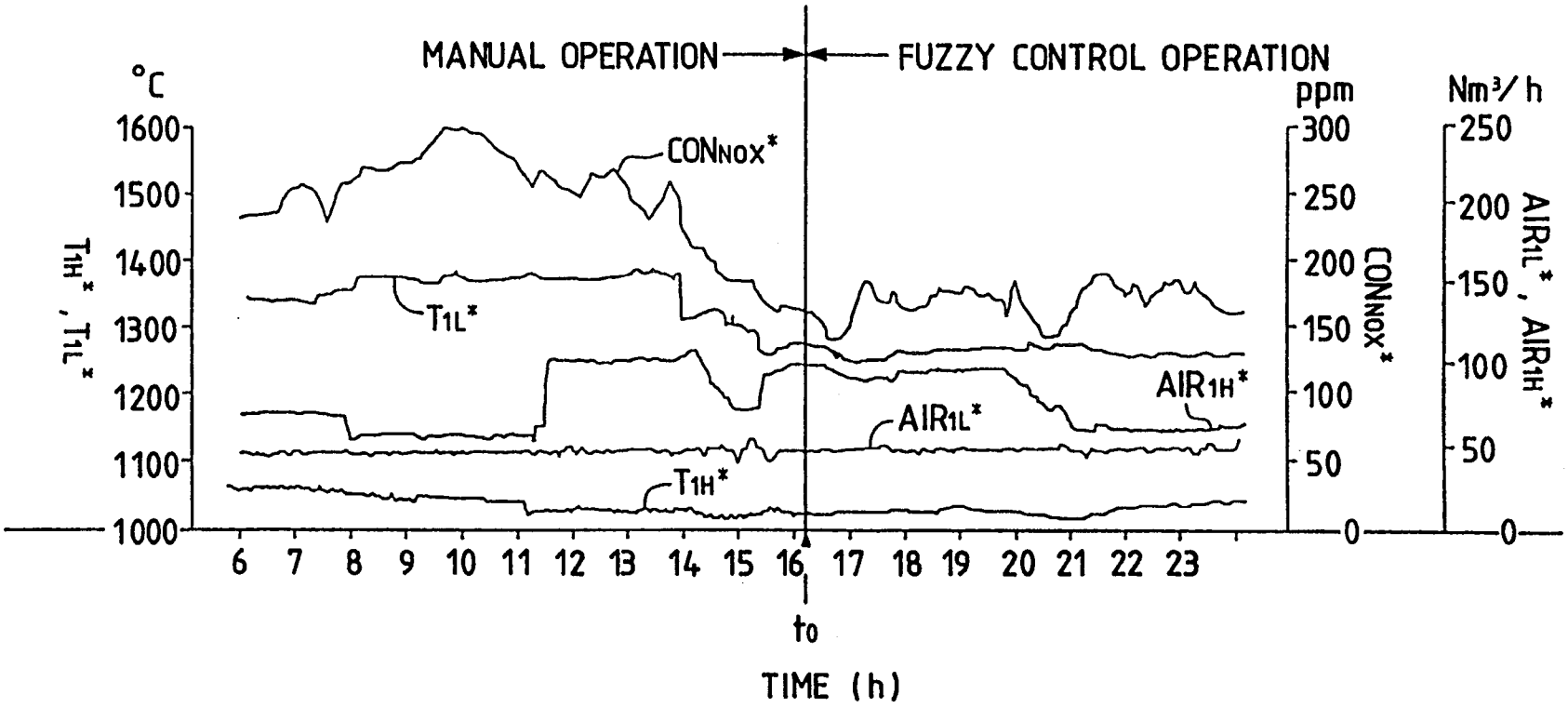
FIG. 30 shows a graph specifically illustrating the operation of the fourth embodiment of FIG. 1, and particularly showing the correlation between the detected PCC upper portion temperature $T_{1H}$*, detected lower portion temperature $T_{1L}$*, detected combustion gas NOX concentration $CON_{NOX}$*, detected PCC upper combustion air supply amount $AIR_{1H}$* and detected PCC lower combustion air supply amount $AIR_{1L}$* which correlation is obtained when the apparatus is operated under the fuzzy control operation according to the invention.
Figure 31:
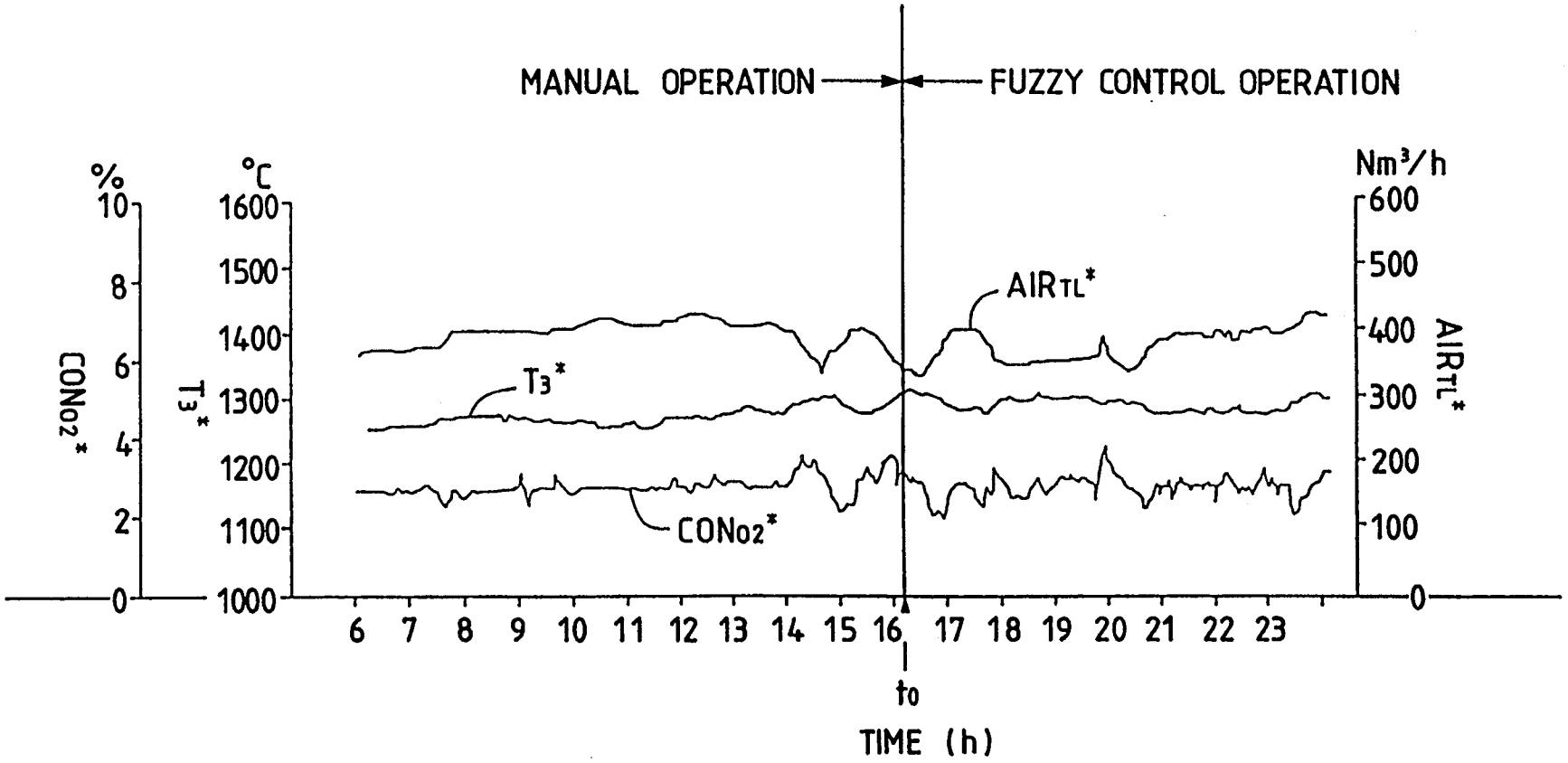
FIG. 31 shows a graph specifically illustrating the operation of the fourth embodiment of FIG. 1, and particularly showing the correlation between the detected total combustion air supply amount $AIR_{TL}$*, detected sludge temperature $T_3$* and detected combustion gas oxygen concentration $CON_{02}$* which correlation is obtained when the apparatus is operated under the fuzzy control operation according to the invention.
Figure 32:
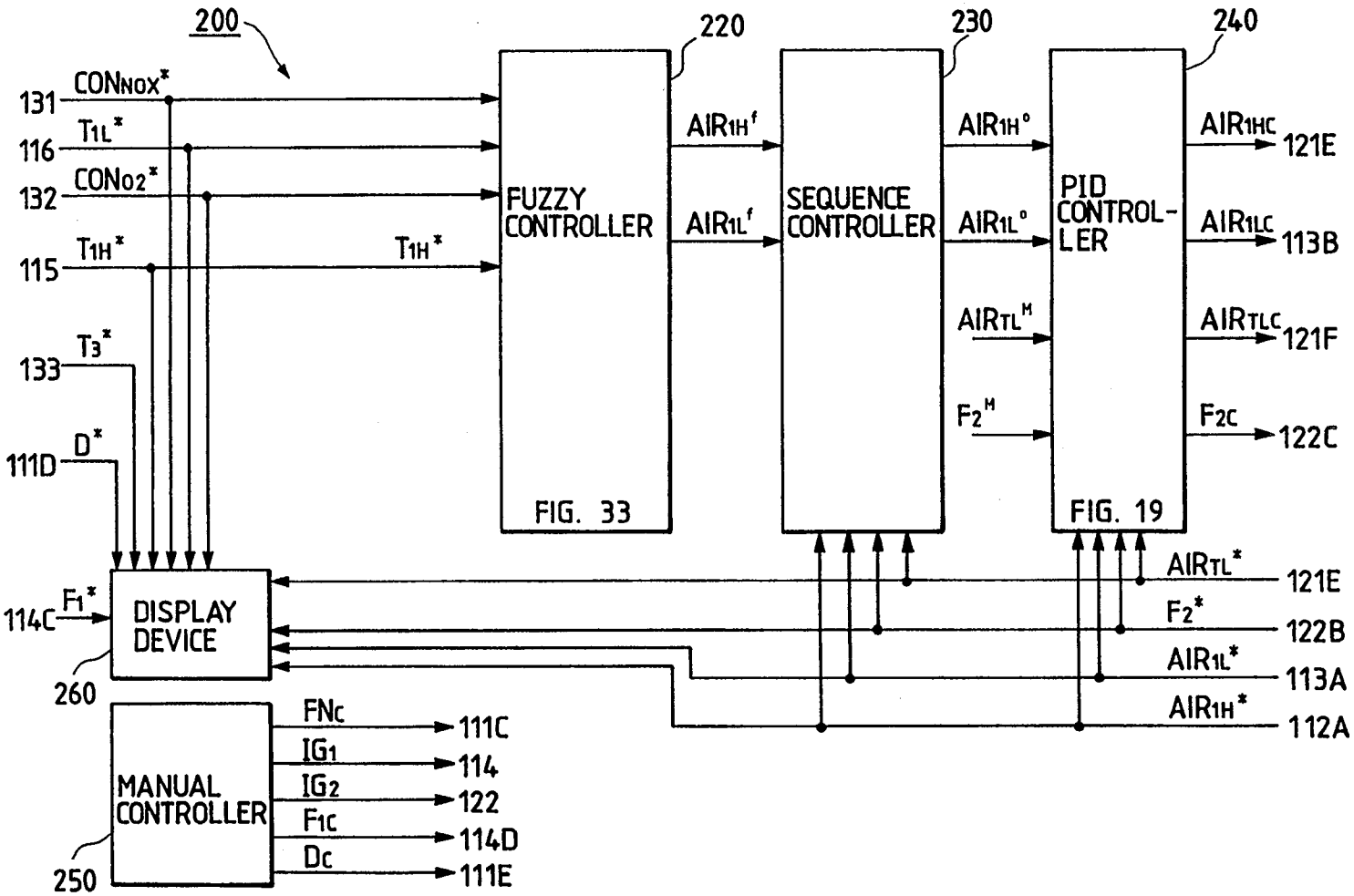
FIG. 32 is a block diagram illustrating one portion of the fifth embodiment of FIG. 1 on an enlarged scale, and particularly showing the controller 200 in detail.
Figure 33:
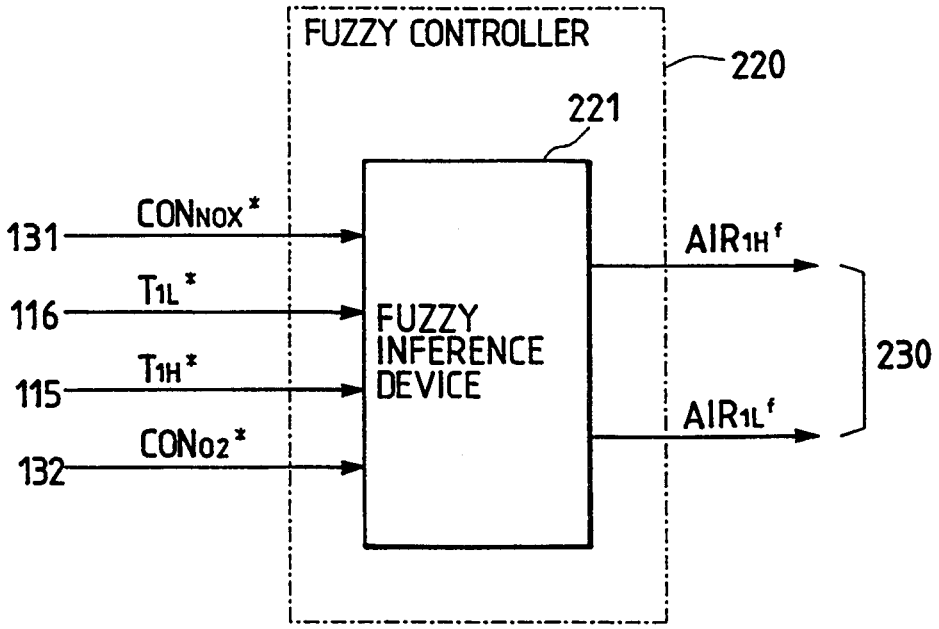
FIG. 33 is a block diagram illustrating one portion of the block diagram of FIG. 32 on an enlarged scale, and particularly showing in detail the fuzzy controller 220 included in the controller 200.
Figure 35:
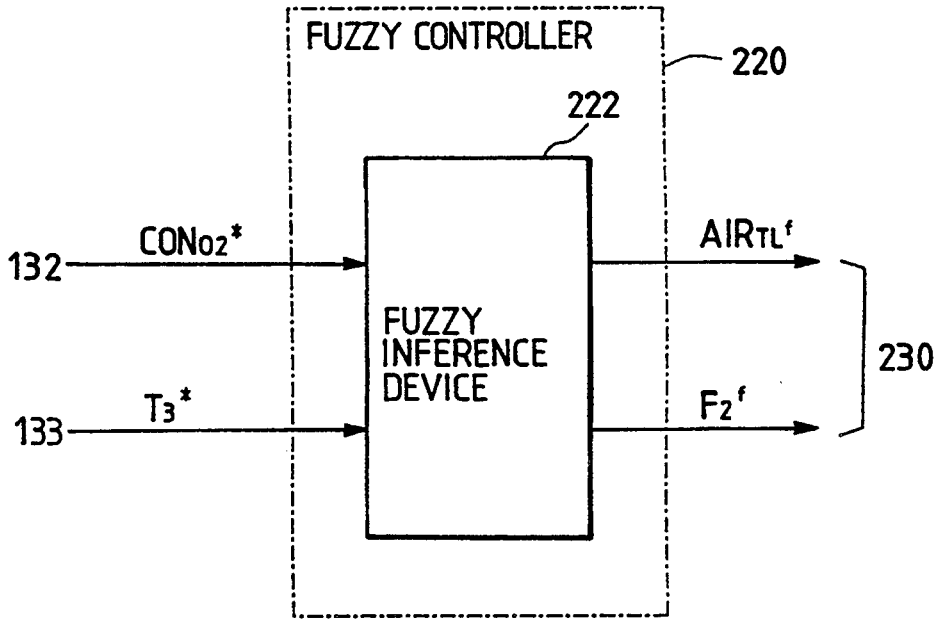
FIG. 35 is a block diagram illustrating one portion of the block diagram of FIG. 32 on an enlarged scale, and particularly showing in detail the fuzzy controller 220 included in the controller 200.
Figure 34:
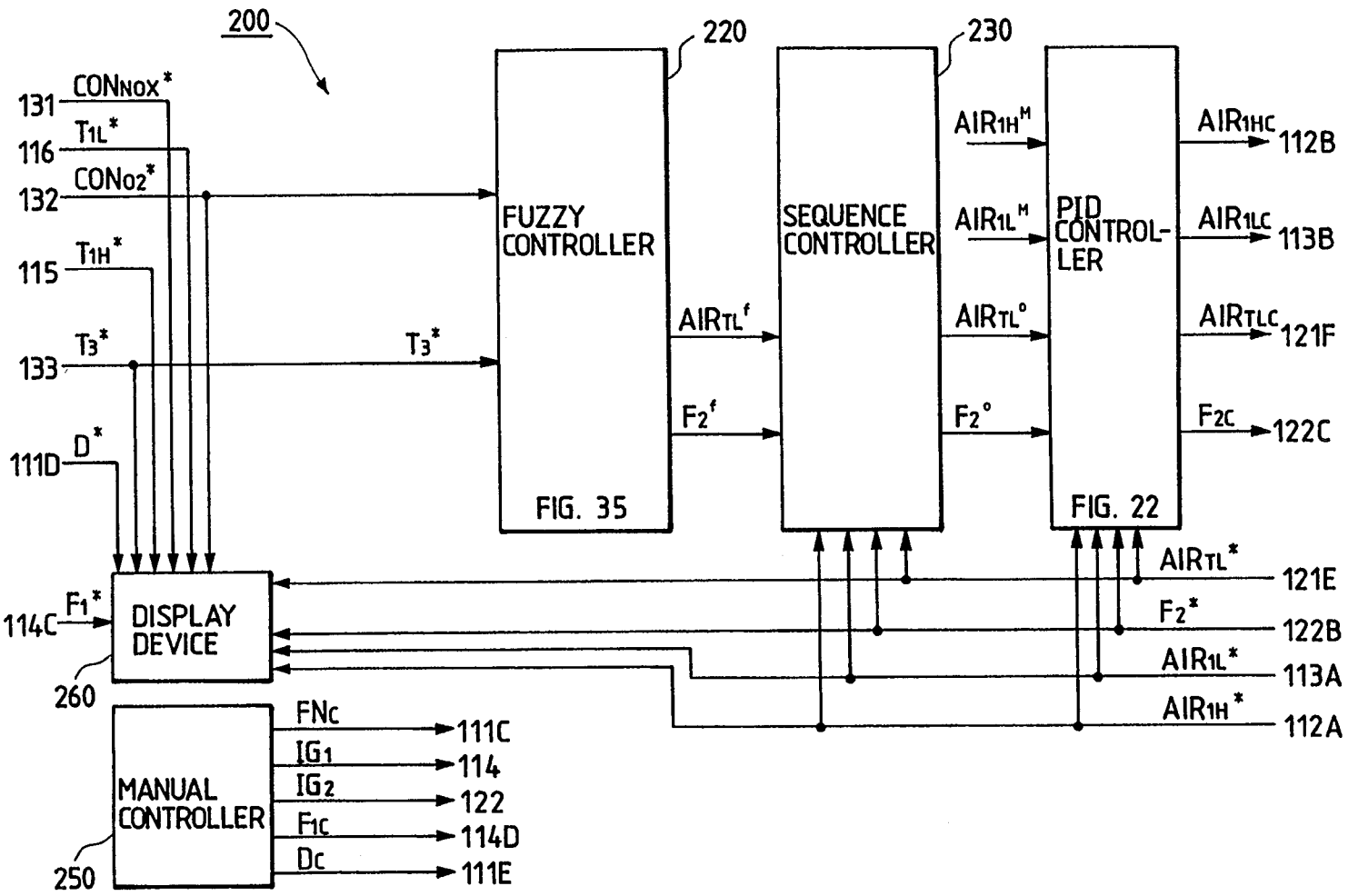
FIG. 34 is a block diagram illustrating one portion of the sixth embodiment of FIG. 1 on an enlarged scale, and particularly showing the controller 200 in detail.

According to the fourth embodiment of the dried sludge melting furnace apparatus of the invention, when the manner of operation is changed at time $t_0$ from a conventional manual operation to a fuzzy control operation according to the invention, the detected PCC upper portion temperature $T_{1H}^*$, the detected PCC lower portion temperature $T_{1L}^*$, the detected PCC upper combustion air supply amount $AIR_{1H}^*$, the detected PCC lower combustion air supply amount $AIR_{1L}^*$ and the detected combustion gas NOX concentration $CON_{NOX}^*$ were stabilized and maintained as shown in FIG. 30. Moreover, the detected slag temperature $T_3^*$, the detected combustion gas oxygen concentration $CON_{02}^*$ and the detected total combustion air supply amount $AIR_{TL}^*$ were stabilized and maintained as shown in FIG. 31.

Configuration of the Fifth Embodiment

Then, referring to FIGS. 1, 19, 32 and 33, the configuration of the fifth embodiment of the dried sludge melting furnace apparatus of the invention will be described in detail. In order to simplify description, description duplicated with that of the first embodiment in conjunction with FIGS. 1 to 4 is omitted as much as possible by designating components corresponding to those of the first embodiment with the same reference numerals.

The controller 200 comprises a fuzzy controller 220 having first to fourth inputs which are respectively connected to the outputs of the PCC upper portion temperature detector 115, NOX concentration detector 131, oxygen concentration detector 132 and PCC lower portion temperature detector 116. The fuzzy controller 220 executes fuzzy inference on the basis of fuzzy rules held among fuzzy sets, a fuzzy set A relating to the PCC lower portion temperature $T_{1L}$, a fuzzy set B relating to the PCC upper portion temperature $T_{1H}$, a fuzzy set C relating to the combustion gas NOX concentration $CON_{NOX}$, a fuzzy set D relating to the combustion gas oxygen concentration $CON_{02}$, a fuzzy set E relating to the PCC upper combustion air supply amount $AIR_{1H}$ and a fuzzy set F relating to the PCC lower combustion air supply amount $AIR_{1L}$. As a result of the fuzzy inference, the fuzzy controller 220 obtains the PCC upper combustion air supply amount $AIR_{1H}$ and the PCC lower combustion air supply amount $AIR_{1L}$, and outputs these amounts from first and second outputs as an inferred PCC upper combustion air supply amount $AIR_{1H}^f$ and an inferred PCC lower combustion air supply amount $AIR_{1L}^f$.

The fuzzy controller 220 comprises a fuzzy inference device 221 having first to fourth inputs which are respectively connected to the outputs of the NOX concentration detector 131, PCC lower portion temperature detector 116, PCC upper portion temperature detector 115 and oxygen concentration detector 132. The fuzzy inference device 221 executes fuzzy inference on the basis of a first fuzzy rule held among the fuzzy set A relating to the PCC lower portion temperature $T_{1L}$, the fuzzy set B relating to the PCC upper portion temperature $T_{1H}$, the fuzzy set C relating to the combustion gas NOX concentration $CON_{NOX}$, the fuzzy set D relating to the combustion gas oxygen concentration $CON_{02}$, the fuzzy set E relating to the PCC upper combustion air supply amount $AIR_{1H}$ and the fuzzy set F relating to the PCC lower combustion air supply amount $AIR_{1L}$. As a result of the fuzzy inference, in accordance with the detected PCC lower portion temperature $T_{1L}$*, the detected PCC upper portion temperature $T_{1H}$*, the detected combustion gas NOX concentration $CON_{NOX}$* and the detected combustion gas oxygen concentration $CON_{02}$*, the fuzzy inference device 221 obtains the PCC upper combustion air supply amount $AIR_{1H}$ and the PCC lower combustion air supply amount $AIR_{1L}$, and outputs these obtained amounts from first and second outputs as the inferred PCC upper combustion air supply amount $AIR_{1H}^f$ and the inferred PCC lower combustion air supply amount $AIR_{1L}^f$.

The controller 200 further comprises a sequence controller 230 having first and second inputs which are respectively connected to the first and second outputs of the fuzzy controller 220 (i.e., the first and second outputs of the fuzzy inference device 221), and third to sixth inputs which are respectively connected to the outputs of the combustion air supply amount detectors 112A, 113A and 121E and fuel supply amount detector 122B. The sequence controller 230 obtains a target PCC upper combustion air supply amount $AIR_{1H}°$ and a target PCC lower combustion air supply amount $AIR_{1L}°$, on the basis of the inferred PCC upper combustion air supply amount $AIR_{1H}^f$, the inferred PCC lower combustion air supply amount $AIR_{1L}^f$, the detected PCC upper combustion air supply amount $AIR_{1H}$*, the detected PCC lower combustion air supply amount $AIR_{1L}$*, the detected total combustion air supply amount $AIR_{TL}$* and the detected SCC burner fuel supply amount $F_2$*. These obtained values are output from first and second outputs.

The controller 200 further comprises a PID controller 240 having first to fourth inputs which are respectively connected to the first and second outputs of the sequence controller 230, an output of a total combustion air supply amount manually setting device (not shown) for manually setting the total combustion air supply amount $AIR_{TL}$ and an output of an SCC burner fuel supply amount manually setting device (not shown) for manually setting the SCC burner fuel supply amount $F_2$, and also fifth to eighth inputs which are respectively connected to the outputs of the combustion air supply amount detectors 112A, 113A and 121E and fuel supply amount detector 122B for the SCC. The PID controller 240 also has first to fourth outputs which are respectively connected to the control terminals of the valve apparatuses 112B, 113B, 121F and 122C. The PID controller 240 generates a PCC upper combustion air supply amount control signal $AIR_{1HC}$, a PCC lower combustion air supply amount control signal $AIR_{1LC}$, a total combustion air supply amount control signal $AIR_{TLC}$ and an SCC burner fuel supply amount control signal $F_{2C}$ which are used for controlling the valve apparatuses 112B, 113B, 121F and 122C so as to attain the target PCC upper combustion air supply amount $AIR_{1H}°$, the target PCC lower combustion air supply amount $AIR_{1L}°$, a target total combustion air supply amount $AIR_{TL}^M$ set through the total combustion air supply amount manually setting device (not shown) and a target SCC burner fuel supply amount $F_2^M$ set through the SCC burner fuel supply amount manually setting device (not shown). These control signals are output from the first to fourth outputs.

The PID controller 240 comprises a comparator 241A, a PID controller 241B, a comparator 241C and an open degree adjustor 241D. The comparator 241A has a noninverting input which is connected to the first output of the sequence controller 230, and an inverting input which is connected to an output of the combustion air supply amount detector 112A. The comparator 241A obtains the difference (referred to as "controlled PCC upper combustion air supply amount") $AIR_{1H}°$* between the target PCC upper combustion air supply amount $AIR_{1H}°$ and the detected PCC upper combustion air supply amount $AIR_{1H}$*. The PID controller 241B has an input connected to an output of the comparator 241A, and calculates an open degree (referred to as "target open degree") $AP_1°$ of the valve apparatus 112B which corresponds to the controlled PCC upper combustion air supply amount $AIR_{1H}°$*. The comparator 241C has a noninverting input which is connected to an output of the PID controller 241B, and an inverting input which is connected to an output of the open degree detector $112B_3$ of the valve apparatus 112B. The comparator 241C obtains the difference (referred to as "controlled open degree") $AP_1°$* between the target open degree $AP_1°$ of the valve apparatus 112B and the detected open degree $AP_1$*. The open degree adjustor 241D has an input connected to an output of the comparator 241C, and an output connected to the control terminal of the drive motor $112B_1$ for the valve apparatus 112B. The open degree adjustor 241D generates a PCC upper combustion air supply amount control signal $AIR_{1HC}$ which corresponds to the controlled open degree $AP_1°$* and which is given to the drive motor $112B_1$ for the valve apparatus 112B.

Moreover, the PID controller 240 comprises a comparator 242A, a PID controller 242B, a comparator 242C and an open degree adjustor 242D. The comparator 242A has a noninverting input which is connected to the second output of the sequence controller 230, and an inverting input which is connected to an output of the combustion air supply amount detector 113A. The comparator 242A obtains the difference (referred to as "controlled PCC lower combustion air supply amount") $AIR_{1L}°$* between the target PCC lower combustion air supply amount $AIR_{1L}°$ and the detected PCC lower combustion air supply amount $AIR_{1L}$*. The PID controller 242B has an input connected to an output of the comparator 242A, and calculates an open degree (referred to as "target open degree") $AP_2°$ of the valve apparatus 113B which corresponds to the controlled PCC lower combustion air supply amount $AIR_{1L}°$*. The comparator 242C has a noninverting input which is connected to an output of the PID controller 242B, and an inverting input which is connected to an output of the open degree detector $113B_3$ for the valve apparatus 113B. The comparator 242C obtains the difference (referred to as "controlled open degree") $AP_2°$* between the target open degree $AP_2°$ of the valve apparatus 113B and the detected open degree $AP_2$*. The open degree adjustor 242D has an input connected to an output of the comparator 242C, and an output connected to the control terminal of the drive motor $113B_1$ for the valve apparatus 113B. The open degree adjustor 242D generates a PCC lower combustion air supply amount control signal $AIR_{1LC}$ which corresponds to the controlled open degree $AP_2{}^{\circ}{}^*$ and which is given to the drive motor $113B_1$ for the valve apparatus 113B.

Moreover, the PID controller 240 comprises a comparator 243A, a PID controller 243B, a comparator 243C and an open degree adjustor 243D. The comparator 243A has a noninverting input which is connected to the output of the total combustion air supply amount manually setting device (not shown), and an inverting input which is connected to an output of the combustion air supply amount detector 121E. The comparator 243A obtains the difference (referred to as "controlled total combustion air supply amount") $AIR_{TL}{}^{M*}$ between the target total combustion air supply amount $AIR_{TL}{}^{M}$ and the detected total combustion air supply amount $AIR_{TL}{}^*$. The PID controller 243B has an input connected to an output of the comparator 243A, and calculates an open degree (referred to as "target open degree") $AP_3{}^M$ of the valve apparatus 121F which corresponds to the controlled total combustion air supply amount $AIR_{TL}{}^{M*}$. The comparator 243C has a noninverting input which is connected to an output of the PID controller 243B, and an inverting input which is connected to an output of the open degree detector $121F_3$ for the valve apparatus 121F. The comparator 243A obtains the difference (referred to as "controlled open degree") $AP_3{}^{M*}$ between the target open degree $AP_3{}^M$ of the valve apparatus 121F and the detected open degree $AP_3{}^*$. The open degree adjustor 243D has an input connected to an output of the comparator 243C, and an output connected to the control terminal of the drive motor $121F_1$ for the valve apparatus 121F. The open degree adjustor 243D generates a total combustion air supply amount control signal $AIR_{TLC}$ which corresponds to the controlled open degree $AP_3{}^{M*}$ and which is given to the drive motor $121F_1$ for the valve apparatus 121F.

Furthermore, the PID controller 240 comprises a comparator 244A, a PID controller 244B, a comparator 244C and an open degree adjustor 244D. The comparator 244A has a noninverting input which is connected to an output of the SCC burner fuel supply amount manually setting device (not shown), and an inverting input which is connected to an output of the fuel supply amount detector 122B. The comparator 244A obtains the difference (referred to as "controlled SCC burner fuel supply amount") $F_2{}^{M*}$ between the target SCC burner fuel supply amount $F_2{}^M$ and the detected SCC burner fuel supply amount $F_2{}^*$. The PID controller 244B has an input connected to an output of the comparator 244A, and calculates an open degree (referred to as "target open degree") $AP_4{}^M$ of the valve apparatus 122C which corresponds to the controlled SCC burner fuel supply amount $F_2{}^{M*}$. The comparator 244C has a noninverting input which is connected to an output of the PID controller 244B, and an inverting input which is connected to an output of the open degree detector $122C_3$ for the valve apparatus 122C. The comparator 244C obtains the difference (referred to as "controlled open degree") $AP_4{}^{M*}$ between the target open degree $AP_4{}^M$ of the valve apparatus 122C and the detected open degree $AP_4{}^*$. The open degree adjustor 244D has an input connected to an output of the comparator 244C, and an output connected to the control terminal of the drive motor $122C_1$ for the valve apparatus 122C. The open degree adjustor 244D generates an SCC burner fuel supply amount control signal $F_{2C}$ which corresponds to the controlled open degree $AP_4{}^{M*}$ and which is given to the drive motor $122C_1$ for the valve apparatus 122C.

The controller 200 further comprises a manual controller 250 and a display device 260. The manual controller 250 has first to fifth outputs which are respectively connected to the control terminals of the valve apparatuses 111E and 114D, air blower 111C, PCC burner 114 and SCC burner 122. When manually operated by the operator, the manual controller 250 generates a dried sludge supply amount control signal $D_C$ which is given to the valve apparatus 111E so that the dried sludge supply amount D for the PCC 110A is adequately adjusted, and a PCC burner fuel supply amount control signal $F_{1C}$ which is supplied to the valve apparatus 114D so that the PCC burner fuel supply amount $F_1$ for the PCC burner 114 is adequately adjusted, and gives a control signal $FN_C$ for activating the air blower 111C thereto, an ignition control signal $IG_1$ for igniting the PCC burner 114 thereto, and an ignition control signal $IG_2$ for igniting the SCC burner 122 thereto. The display device 260 has an input which is connected to at least one of the outputs of the outputs of the dried sludge supply amount detector 111D, combustion air supply amount detectors 112A, 113A and 121E, fuel supply amount detectors 114C and 122B, PCC upper portion temperature detector 115, PCC lower portion temperature detector 116, NOX concentration detector 131, oxygen concentration detector 132 and slag temperature detector 133. The display device 260 displays at least one of the detected dried sludge supply amount $D^*$, detected PCC upper combustion air supply amount $AIR_{1H}{}^*$, detected PCC lower combustion air supply amount $AIR_{IL}{}^*$, detected total combustion air supply amount $AIR_{TL}{}^*$, detected PCC burner fuel supply amount $F_1{}^*$, detected SCC burner fuel supply amount $F_2{}^*$, detected PCC upper portion temperature $T_{1H}{}^*$, detected PCC lower portion temperature $T_{1L}{}^*$, detected combustion gas NOX concentration $CON_{NOX}{}^*$, detected combustion gas oxygen concentration $CON_{02}{}^*$ and detected slag temperature $T_3{}^*$.

Function of the Fifth Embodiment

Next, referring to FIGS. 1, 5, 7, 8, 19, 32 and 33, the function of the fifth embodiment of the dried sludge melting furnace of the invention will be described in detail. In order to simplify description, description duplicated with that of the first embodiment in conjunction with FIGS. 1 to 16 is omitted as much as possible.

Fuzzy inference

The fuzzy controller 220 of the controller 200 executes the fuzzy inference as follows.

In accordance with the detected PCC lower portion temperature $T_{1L}{}^*$, the detected PCC upper portion temperature $T_{1H}{}^*$, the detected combustion gas NOX concentration $CON_{NOX}{}^*$ and the detected combustion gas oxygen concentration $CON_{02}{}^*$, the fuzzy inference device 221 firstly executes the fuzzy inference to obtain the PCC upper combustion air supply amount $AIR_{1H}$ and the PCC lower combustion air supply amount $AIR_{1L}$, on the basis of fuzzy rules $f_{01}$ to $f_{30}$ shown in Table 1 and held among the fuzzy set A relating to the PCC lower portion temperature $T_{1L}$, the fuzzy set B relating to the PCC upper portion temperature $T_{1H}$, the fuzzy set C relating to the combustion gas NOX concentration $CON_{NOX}$, the fuzzy set D relating to the combustion gas oxygen concentration $CON_{02}$, the fuzzy set E relating to the PCC upper combustion air supply amount $AIR_{1H}$ and the fuzzy set F relating to the PCC lower combustion air supply amount $AIR_{1L}$. These obtained amounts are given to the sequence controller 230 as the inferred PCC upper combustion air supply amount $AIR_{1H}^f$ and the inferred PCC lower combustion air supply amount $AIR_{1L}^f$, respectively.

When the detected PCC lower portion temperature $T_{1L}$* is 1,107° C., the detected PCC upper portion temperature $T_{1H}$* is 1,260° C., the detected combustion gas NOX concentration $CON_{NOX}$* is 290 ppm and the detected combustion gas oxygen concentration $CON_{02}$* is 3.4 wt %, for example, the fuzzy inference device 221 obtains the grade of membership functions $ZR_A$, $PS_A$ and $PL_A$ of the fuzzy set A relating to the PCC lower portion temperature $T_{1L}$ and shown in FIG. 5A, the grade of membership functions $NL_B$, $NS_B$, $ZR_B$, $PS_B$ and $PL_B$ of the fuzzy set B relating to the PCC upper portion temperature $T_{1H}$ and shown in FIG. 25A, the grade of membership functions $ZR_C$, $PS_C$, $PM_C$ and $PL_C$ of the fuzzy set C relating to the combustion gas NOX concentration $CON_{NOX}$ and shown in FIG. 5B, and the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, as shown in FIGS. 26A to 26D and Table 7.

With respect to each of the fuzzy rules $f_{01}$ to $f_{30}$, the fuzzy inference device 221 then compares the grade of membership functions $ZR_A$, $PS_A$ and $PL_A$ of the fuzzy set A relating to the PCC lower portion temperature $T_{1L}$ and shown in FIG. 5A, the grade of membership functions $NL_B$, $NS_B$, $ZR_B$, $PS_B$ and $PL_B$ of the fuzzy set B relating to the PCC upper portion temperature $T_{1H}$ and shown in FIG. 25A, the grade of membership functions $ZR_C$, $PS_C$, $PM_C$ and $PL_C$ of the fuzzy set C relating to the combustion gas NOX concentration $CON_{NOX}$ and shown in FIG. 5B, and the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, with each other in FIGS. 26A to 26D and Table 7. The minimum one among them is set as shown in Table 8 as the grade of membership functions $NL_E$, $NS_E$, $ZR_E$, $PS_E$ and $PL_E$ of the fuzzy set E relating to the PCC upper combustion air supply amount $AIR_{1H}$ and shown in FIG. 7B, and also as the grade of membership functions $NL_F$, $NS_F$, $ZR_F$, $PS_F$ and $PL_F$ of the fuzzy set F relating to the PCC lower combustion air supply amount $AIR_{1L}$ and shown in FIG. 7C.

With respect to the fuzzy rules $f_{01}$ to $f_{30}$, the fuzzy inference device 221 modifies the membership functions $NL_E$, $NS_E$, $ZR_E$, $PS_E$ and $PL_E$ of the fuzzy set E relating to the PCC upper combustion air supply amount $AIR_{1H}$ and shown in FIG. 7B to stepladder-like membership functions $NS_E^{*24}$, $NS_E^{*25}$ and $NS_E^{*27}$ which are cut at the grade positions indicated in Table 8 (see FIG. 27A). In FIG. 27A, cases where the grade is 0.0 are not shown.

The fuzzy inference device 221 calculates the center of gravity of the hatched area enclosed by the stepladder-like membership functions $NS_E^{*24}$, $NS_E^{*25}$ and $NS_E^{*27}$ which have been produced in the above-mentioned process, as shown in FIG. 27A, and outputs its abscissa of $-2.5$ $Nm^3/h$ to the sequence controller 230 as the inferred PCC upper combustion air supply amount (in this case, the corrected value for the current value) $AIR_{1H}^f$.

With respect to the fuzzy rules $f_{01}$ to $f_{30}$, the fuzzy inference device 221 further modifies the membership functions $NL_F$, $NS_F$, $ZR_F$, $PS_F$ and $PL_F$ of the fuzzy set F relating to the PCC lower combustion air supply amount $AIR_{1L}$ and shown in FIG. 7C to stepladder-like membership functions $ZR_F^{*24}$, $ZR_F^{*25}$ and $ZR_F^{*27}$ which are cut at the grade positions indicated in Table 8 (see FIG. 27B). In FIG. 27B, cases where the grade is 0.0 are not shown.

The fuzzy inference device 221 calculates the center of gravity of the hatched area enclosed by the stepladder-like membership functions $ZR_F^{*24}$, $ZR_F^{*25}$ and $ZR_F^{*27}$ which have been produced in the above-mentioned process, as shown in FIG. 27B, and outputs its abscissa of 0.0 $Nm^3/h$ to the sequence controller 230 as the inferred PCC lower combustion air supply amount (in this case, the corrected value for the current value) $AIR_{1L}^f$.

In the fuzzy inference performed in the fuzzy inference device 221, fuzzy rules $h_{01}$ to $h_{16}$ shown in Table 6 may be employed instead of the fuzzy rules $f_{01}$ to $f_{30}$ shown in Table 7. When the fuzzy rules $h_{01}$ to $h_{16}$ are employed, the fuzzy inference device 221 performs the fuzzy inference in the same manner as described above, and therefore, for the sake of convenience, its detail description is omitted.

Sequence control

The sequence controller 230 operates in the same manner as that of Embodiment 2 to execute the sequence control.

PID control

The PID controller 240 operates in the same manner as that of Embodiment 2 to execute the PID control.

Configuration of the Sixth Embodiment

Then, referring to FIGS. 1, 22, 34 and 35, the configuration of the sixth embodiment of the dried sludge melting furnace apparatus of the invention will be described in detail. In order to simplify description, description duplicated with that of the first embodiment in conjunction with FIGS. 1 to 4 is omitted as much as possible by designating components corresponding to those of the first embodiment with the same reference numerals.

The controller 200 comprises a fuzzy controller 220 having first and second inputs which are respectively connected to the outputs of the slag temperature detector 133 and oxygen concentration detector 132. The fuzzy controller 220 executes fuzzy inference on the basis of fuzzy rules held among fuzzy sets, a fuzzy set D relating to the combustion gas oxygen concentration $CON_{02}$, a fuzzy set G relating to the slag temperature $T_3$, a fuzzy set H relating to the SCC burner fuel supply amount $F_2$ and a fuzzy set I relating to the total combustion air supply amount $AIR_{TL}$. As a result of the fuzzy inference, the fuzzy controller 220 obtains the total combustion air supply amount $AIR_{TL}$ and the SCC burner fuel supply amount $F_2$, and outputs these amounts from first and second outputs as an inferred total combustion air supply amount $AIR_{TL}^f$ and an inferred SCC burner fuel supply amount $F_2^f$.

The fuzzy controller 220 comprises a fuzzy inference device 222 having first and second inputs which are respectively connected to the outputs of the oxygen concentration detector 132 and slag temperature detector 133. The fuzzy inference device 222 executes fuzzy inference on the basis of fuzzy rules held among the fuzzy set D relating to the combustion gas oxygen concentration $CON_{02}$, the fuzzy set G relating to the slag temperature $T_3$, the fuzzy set H relating to the SCC burner fuel supply amount $F_2$ and the fuzzy set I relating to the total combustion air supply amount $AIR_{TL}$. As a result of the fuzzy inference, in accordance with the detected slag temperature $T_3$* and the detected combustion gas oxygen concentration $CON_{02}$*, the fuzzy inference device 222 obtains the total combustion air supply amount $AIR_{TL}$ and the SCC burner fuel supply amount $F_2$, and outputs these amounts from first and second outputs as the inferred total combustion air supply amount $AIR_{TL}^f$ and the inferred SCC burner fuel supply amount $F_2^f$.

The controller 200 further comprises a sequence controller 230 having first and second inputs which are respectively connected to the first and second outputs of the fuzzy controller 220 (i.e., the first and second outputs of the fuzzy inference device 222), and third to sixth inputs which are respectively connected to the outputs of the combustion air supply amount detectors 112A, 113A and 121E and fuel supply amount detector 122B. The sequence controller 230 obtains a target total combustion air supply amount $AIR_{TL}°$ and a target SCC burner fuel supply amount $F_2°$, on the basis of the inferred total combustion air supply amount $AIR_{TL}^f$, the inferred SCC burner fuel supply amount $F_2^f$, the detected PCC upper combustion air supply amount $AIR_{1H}$*, the detected PCC lower combustion air supply amount $AIR_{1L}$*, the detected total combustion air supply amount $AIR_{TL}$* and the detected SCC burner fuel supply amount $F_2$*. These obtained values are output from first and second outputs.

The controller 200 further comprises a PID controller 240 having first and second inputs which are respectively connected to the first and second outputs of the sequence controller 230, third and fourth inputs which are respectively connected to outputs of a PCC upper combustion air supply amount manually setting device (not shogun) and PCC lower combustion air supply amount manually setting device (not shown), and also fifth to eighth inputs which are respectively connected to the outputs of the combustion air supply amount detectors 112A, 113A and 121E and fuel supply amount detector 122B for the SCC. The PID controller 240 also has first to fourth outputs which are respectively connected to the control terminals of the valve apparatuses 112B, 113B, 121F and 122C. The PID controller 240 generates a PCC upper combustion air supply amount control signal $AIR_{1HC}$, a PCC lower combustion air supply amount control signal $AIR_{1LC}$, a total combustion air supply amount control signal $AIR_{TLC}$ and an SCC burner fuel supply amount control signal $F_{2C}$ which are used for controlling the valve apparatuses 112B, 113B, 121F and 122C so as to attain a target PCC upper combustion air supply amount $AIR_{1H}^M$, a target PCC lower combustion air supply amount $AIR_{1L}^M$, the target total combustion air supply amount $AIR_{TL}°$ and the target SCC burner fuel supply amount $F_2°$. These control signals are output from the first to fourth outputs.

The PID controller 240 comprises a comparator 241A, a PID controller 241B, a comparator 241C and an open degree adjustor 241D. The comparator 241A has a noninverting input which is connected to the output of the PCC upper combustion air supply amount manually setting device (not shown), and an inverting input which is connected to an output of the combustion air supply amount detector 112A. The comparator 241A obtains the difference (referred to as "controlled PCC upper combustion air supply amount") $AIR_{1H}^{M*}$ between the target PCC upper combustion air supply amount $AIR_{1H}^M$ and the detected PCC upper combustion air supply amount $AIR_{1H}$*. The PID controller 241B has an input connected to an output of the comparator 241A, and calculates an open degree (referred to as "target open degree") $AP_1^M$ of the valve apparatus 112B which corresponds to the controlled PCC upper combustion air supply amount $AIR_{1H}$ The comparator 241C has a noninverting input which is connected to an output of the PID controller 241B, and an inverting input which is connected to an output of the open degree detector 112B$_3$ of the valve apparatus 112B. The comparator 241C obtains the difference (referred to as "controlled open degree") $AP_1^{M*}$ between the target open degree $AP_1^M$ of the valve apparatus 112B and the detected open degree $AP_1$*. The open degree adjustor 241D has an input connected to an output of the comparator 241C, and an output connected to the control terminal of the drive motor 112B$_1$ for the valve apparatus 112B. The open degree adjustor 241D generates a PCC upper combustion air supply amount control signal $AIR_{1HC}$ which corresponds to the controlled open degree $AP_1^{M*}$ and which is given to the drive motor 112B$_1$ for the valve apparatus 112B.

Moreover, the PID controller 240 comprises a comparator 242A, a PID controller 242B, a comparator 242C and an open degree adjustor 242D. The comparator 242A has a noninverting input which is connected to the output of the PCC lower combustion air supply amount manually setting device (not shown), and an inverting input which is connected to an output of the combustion air supply amount detector 113A. The comparator 242A obtains the difference (referred to as "controlled PCC lower combustion air supply amount") $AIR_{1L}^{M*}$ between the target PCC lower combustion air supply amount $AIR_{1L}^M$ and the detected PCC lower combustion air supply amount $AIR_{1L}$*. The PID controller 242B has an input connected to an output of the comparator 242A, and calculates an open degree (referred to as "target open degree") $AP_2^M$ of the valve apparatus 113B which corresponds to the controlled PCC lower combustion air supply amount $AIR_{1L}^{M*}$. The comparator 242C has a noninverting input which is connected to an output of the PID controller 242B, and an inverting input which is connected to an output of the open degree detector 113B$_3$ for the valve apparatus 113B. The comparator 242C obtains the difference (referred to as "controlled open degree") $AP_2^{M*}$ between the target open degree $AP_2^M$ of the valve apparatus 113B and the detected open degree $AP_2$*. The open degree adjustor 242D has an input connected to an output of the comparator 242C, and an output connected to the control terminal of the drive motor 113B$_1$ for the valve apparatus 113B. The open degree adjustor 242D generates a PCC lower combustion air supply amount control signal $AIR_{1LC}$ which corresponds to the controlled open degree $AP_2^{M*}$ and which is given to the drive motor 113B$_1$ for the valve apparatus 113B.

Moreover, the PID controller 240 comprises a comparator 243A, a PID controller 243B, a comparator 243C and an open degree adjustor 243D. The comparator 243A has a noninverting input which is connected to the first output of the sequence controller 230, and an inverting input which is connected to an output of the combustion air supply amount detector 121E. The comparator 243A obtains the difference (referred to as "controlled total combustion air supply amount") $AIR_{TL}°*$ between the target total combustion air supply amount $AIR_{TL}°$ and the detected total combustion air supply amount $AIR_{TL}*$. The PID controller 243B has an input connected to an output of the comparator 243A, and calculates an open degree (referred to as "target open degree") $AP_3°$ of the valve apparatus 121F which corresponds to the controlled total combustion air supply amount $AIR_{TL}°*$. The comparator 243C has a noninverting input which is connected to an output of the PID controller 243B, and an inverting input which is connected to an output of the open degree detector 121F$_3$ for the valve apparatus 121F. The comparator 243A obtains the difference (referred to as "controlled open degree") $AP_3°*$ between the target open degree $AP_3°$ of the valve apparatus 121F and the detected open degree $AP_3*$. The open degree adjustor 243D has an input connected to an output of the comparator 243C, and an output connected to the control terminal of the drive motor 121F$_1$ for the valve apparatus 121F. The open degree adjustor 243D generates a total combustion air supply amount control signal $AIR_{TLC}$ which corresponds to the controlled open degree $AP_3°*$ and which is given to the drive motor 121F$_1$ for the valve apparatus 121F.

Furthermore, the PID controller 240 comprises a comparator 244A, a PID controller 244B, a comparator 244C and an open degree adjustor 244D. The comparator 244A has a noninverting input which is connected to the second output of the sequence controller 230, and an inverting input which is connected to an output of the fuel supply amount detector 122B. The comparator 244A obtains the difference (referred to as "controlled SCC burner fuel supply amount") $F_2°*$ between the target SCC burner fuel supply amount $F_2°$ and the detected SCC burner fuel supply amount $F_2*$. The PID controller 244B has an input connected to an output of the comparator 244A, and calculates an open degree (referred to as "target open degree") $AP_4°$ of the valve apparatus 122C which corresponds to the controlled SCC burner fuel supply amount $F_2°*$. The comparator 244C has a noninverting input which is connected to an output of the PID controller 244B, and an inverting input which is connected to an output of the open degree detector 122C$_3$ for the valve apparatus 122C. The comparator 244C obtains the difference (referred to as "controlled open degree") $AP_4°*$ between the target open degree $AP_4°$ of the valve apparatus 122C and the detected open degree $AP_4*$. The open degree adjustor 244D has an input connected to an output of the comparator 244C, and an output connected to the control terminal of the drive motor 122C$_1$ for the valve apparatus 122C. The open degree adjustor 244D generates an SCC burner fuel supply amount control signal $F_{2C}$ which corresponds to the controlled open degree $AP_4°*$ and which is given to the drive motor 122C$_1$ for the valve apparatus 122C.

The controller 200 further comprises a manual controller 250 and a display device 260. The manual controller 250 has first to fifth outputs which are respectively connected to the control terminals of the valve apparatuses 111E and 114D, air blower 111C, PCC burner 114 and SCC burner 122. When manually operated by the operator, the manual controller 250 generates a dried sludge supply amount control signal $D_C$ which is given to the valve apparatus 111E so that the dried sludge supply amount D for the PCC 110A is adequately adjusted, and a PCC burner fuel supply amount control signal $F_{1C}$ which is supplied to the valve apparatus 114D so that the PCC burner fuel supply amount $F_1$ for the PCC 110A is adequately adjusted, and gives a control signal $FN_C$ for activating the air blower 111C thereto, an ignition control signal $IG_1$ for igniting the PCC burner 114 thereto, and an ignition control signal $IG_2$ for igniting the SCC burner 122 thereto. The display device 260 has an input which is connected to at least one of the outputs of the outputs of the dried sludge supply amount detector 111D, combustion air supply amount detectors 112A, 113A and 121E, fuel supply amount detectors 114C and 122B, PCC upper portion temperature detector 115, PCC lower portion temperature detector 116, NOX concentration detector 131, oxygen concentration detector 132 and slag temperature detector 133. The display device 260 displays at least one of the detected dried sludge supply amount D*, detected PCC upper combustion air supply amount $AIR_{1H}*$, detected PCC lower combustion air supply amount $AIR_{1L}*$, detected total combustion air supply amount $AIR_{TL}*$, detected PCC burner fuel supply amount $F_1*$, detected SCC burner fuel supply amount $F_2*$, detected PCC upper portion temperature $T_{1H}*$, detected PCC lower portion temperature $T_{1L}*$, detected combustion gas NOX concentration $CON_{NOX}*$, detected combustion gas oxygen concentration $CON_{02}*$ and detected slag temperature $T_3*$.

Function of the Sixth Embodiment

Next, referring to FIGS. 1, 5, 7, 8, 22, 34 and 35, the function of the sixth embodiment of the dried sludge melting furnace of the invention will be described in detail. In order to simplify description, description duplicated with that of the first embodiment in conjunction with FIGS. 1 to 16 is omitted as much as possible.

Fuzzy inference

The fuzzy controller 220 of the controller 200 executes the fuzzy inference as follows.

In accordance with the detected slag temperature $T_3*$ and the detected combustion gas oxygen concentration $CON_{02}*$, the fuzzy inference device 222 executes fuzzy inference to obtain the SCC burner fuel supply amount $F_2$ and the total combustion air supply amount $AIR_{TL}$, on the basis of fuzzy rules $g_1$ to $g_9$ which are shown in Table 2 and held among the fuzzy set G relating to the slag temperature $T_3$, the fuzzy set D relating to the combustion gas oxygen concentration $CON_{02}$, the fuzzy set H relating to the SCC burner fuel supply amount $F_2$ and the fuzzy set I relating to the total combustion air supply amount $AIR_{TL}$. These obtained amounts are given to the sequence controller 230 as the inferred SCC burner fuel supply amount $F_2^f$ and the inferred total combustion air supply amount $AIR_{TL}^f$, respectively.

When the detected slag temperature $T_3$ is 1,220° C. and the detected combustion gas oxygen concentration $CON_{02}*$ is 3.4 wt %, for example, the fuzzy inference device 222 obtains the grade of membership functions $NL_G$, $NS_G$, $ZR_G$ and $PS_G$ of the fuzzy set G relating to the slag temperature $T_3$ and shown in FIG. 25B, and the grade of membership functions $NL_D$, $NS_D$, $ZR_D$, $PS_D$ and $PL_D$ of the fuzzy set D relating to the combustion gas oxygen concentration $CON_{02}$and shown in FIG. 7A, as shown in FIGS. 28A and 28B and Table 9.

With respect to each of the fuzzy rules $g_1$ to $g_9$, the fuzzy inference device 222 then compares the grade of membership functions $NL_G$, $NS_G$, $ZR_G$ and $PS_G$ of the fuzzy set G relating to the slag temperature $T_3$ and shown in FIG. 25B with the grade of membership functions $NL_D$, $NS_D$, $ZR_D$, $PS_D$ and $PL_D$ of the fuzzy set D relating to the combustion gas oxygen concentration $CON_{02}$ and shown in FIG. 7A, in FIGS. 28A and 28B and Table 9. The minimum one of them is set as shown in Table 9 as the grade of membership functions $NL_H$, $NS_H$, $ZR_H$, $PS_H$ and $PL_H$ of the fuzzy set H relating to the SCC burner fuel supply amount $F_2$ and shown in FIG. 8A, and the grade of membership functions $NL_I$, $NS_I$, $ZR_I$, $PS_I$ and $PL_I$ of the fuzzy set I relating to the total combustion air supply amount $AIR_{TL}$ and shown in FIG. 8B.

With respect to the fuzzy rules $g_1$ to $g_9$, the fuzzy inference device 222 modifies the membership functions $NL_H$, $NS_H$, $ZR_H$, $PS_H$ and $PL_H$ of the fuzzy set H relating to the SCC burner fuel supply amount $F_2$ and shown in FIG. 8A to a stepladder-like (in this case, triangular) membership function $PL_H{}^{*1}$ which is cut at the grade position indicated in Table 9 (see FIG. 29A). In FIG. 29A, cases where the grade is 0.0 are not shown.

The fuzzy inference device 222 calculates the center of gravity of the hatched area enclosed by the stepladder-like membership function $PL_H{}^{*1}$ which has been produced in the above-mentioned process, as shown in FIG. 29A, and outputs its abscissa of 2.5 liter/h to the sequence controller 230 as the inferred SCC combustion fuel supply amount (in this case, the corrected value for the current value) $F_2{}^f$.

With respect to the fuzzy rules $g_1$ to $g_9$, the fuzzy inference device 222 further modifies the membership functions $NL_I$, $NS_I$, $ZR_I$, $PS_I$ and $PL_I$ of the fuzzy set I relating to the total combustion air supply amount $AIR_{TL}$ and shown in FIG. 8B to stepladder-like membership functions $NS_I{}^{*8}$ and $NL_I{}^{*9}$ which are cut at the grade positions indicated in Table 9 (see FIG. 29B). In FIG. 29B, cases where the grade is 0.0 are not shown.

The fuzzy inference device 222 calculates the center of gravity of the hatched area enclosed by the stepladder-like membership functions $NS_I{}^{*8}$ and $NL_I{}^{*9}$ which have been produced in the above-mentioned process, as shown in FIG. 29B, and outputs its abscissa of −26.1 $Nm^3/h$ to the sequence controller 230 as the inferred total combustion air supply amount (in this case, the corrected value for the current value) $AIR_{TL}{}^f$.

Sequence control

The sequence controller 230 operates in the same manner as that of Embodiment 3 to execute the sequence control.

PID control

The PID controller 240 operates in the same manner as that of Embodiment 3 to execute the PID control.

As seen from the above, the first to sixth dried sludge melting furnace apparatuses of the invention are configured as described above, and therefore have the following effects:

(i) the control of the burning of dried sludge can be automated; and (ii) the operator is not required to be always stationed in a control room, and, consequently, have further the effects of:

(iii) the operation accuracy and efficiency can be improved; and (iv) the temperature of a combustion chamber can be prevented from rising so that the service life can be prolonged.

What is claimed is:

1. A dried sludge melting furnace apparatus in which dried sludge and combustion air are supplied to a primary combustion chamber (PCC), and the dried sludge is converted into slag in said PCC and a secondary combustion chamber (SCC) and then separated from the combustion gas in a slag separation chamber, wherein said apparatus comprises:

(a) a first temperature detector (115) for detecting a temperature $T_{1H}$ of the upper portion of said PCC, and for outputting the detected temperature as a detected PCC upper portion temperature $T_{1H}{}^*$;

(b) a second temperature detector (116) for detecting a temperature $T_{1L}$ of the lower portion of said PCC, and for outputting the detected temperature as a detected PCC lower portion temperature $T_{1L}{}^*$;

(c) a nitrogen oxide (NOX) concentration detector (131) for detecting the NOX concentration $CON_{NOX}$ of the combustion gas, said combustion gas being guided together with slag from said SCC and then separated from the slag, and for outputting the detected value as a detected combustion gas NOX concentration $CON_{NOX}{}^*$;

(d) an oxygen concentration detector (132) for detecting the oxygen concentration $CON_{02}$ of the combustion gas, said combustion gas being guided together with slag from said SCC and then separated from the slag, and for outputting the detected value as a detected combustion gas oxygen concentration $CON_{02}{}^*$;

(e) a dried sludge supply amount detector (111D) for detecting a supply amount D of dried sludge to said PCC, and for outputting the detected amount as a detected dried sludge supply amount D*;

(f) a first combustion air supply amount detector (112A) for detecting a supply amount $AIR_{1H}$ of combustion air to the upper portion of said PCC, and for outputting the detected amount as a detected PCC upper combustion air supply amount $AIR_{1H}{}^*$;

(g) a second combustion air supply amount detector (113A) for detecting a supply amount $AIR_{1L}$ of combustion air to the lower portion of said PCC, and for outputting the detected amount as a detected PCC lower combustion air supply amount $AIR_{1L}{}^*$;

(h) a third combustion air supply amount detector (121E) for detecting the total amount $AIR_{TL}$ of the combustion air supply amounts $AIR_{1H}$ and $AIR_{1L}$ to said PCC and the combustion air supply amount $AIR_2$ to said SCC, and for outputting the detected amount as a detected total combustion air supply amount $AIR_{TL}{}^*$;

(i) a fuel supply amount detector (122B) for detecting the supply amount $F_2$ of fuel to a burner for said SCC, and for outputting the detected amount as a detected SCC burner fuel supply amount $F_2{}^*$;

(j) a fuzzy controller (220) comprising a first fuzzy inference means (221) for executing fuzzy inference to obtain an inferred PCC upper combustion air supply amount $AIR_{1H}{}^f$ and an inferred PCC lower combustion air supply amount $AIR_{1L}{}^f$ on the basis of fuzzy rules held among a fuzzy set relating to the PCC lower portion temperature $T_{1L}$, a fuzzy set relating to the PCC upper portion temperature $T_{1H}$, a fuzzy set relating to the combustion gas NOX concentration $CON_{NOX}$, a fuzzy set relating to the combustion gas oxygen concentration $CON_{02}$, a fuzzy set relating to the PCC upper combustion air supply amount $AIR_{1H}$ and a fuzzy set relating to the PCC lower combustion air supply amount $AIR_{1L}$, in accordance with the detected PCC lower portion temperature $T_{1L}$*, the detected PCC upper portion temperature $T_{1H}$*, the detected combustion gas NOX concentration $CON_{NOX}$* and the detected combustion gas oxygen concentration $CON_{02}$*, and for outputting the obtained amounts;

(k) a sequence controller (230) for obtaining a target PCC upper combustion air supply amount $AIR_{1H}°$ and a target PCC lower combustion air supply amount $AIR_{1L}°$, from the inferred PCC upper combustion air supply amount $AIR_{1H}^f$ and inferred PCC lower combustion air supply amount $AIR_{1L}^f$ given from said first fuzzy inference means (221) of said fuzzy controller (220), the detected PCC upper combustion air supply amount $AIR_{1H}$*, detected PCC lower combustion air supply amount $AIR_{1L}$* and detected total combustion air supply amount $AIR_{TL}$* given from said first to third combustion air supply amount detectors (112A, 113A, 121E), and the detected SCC burner fuel supply amount $F_2$* given from said fuel supply amount detector (122B), and for outputting said obtained values; and (l) a PID controller (240) for obtaining a PCC upper combustion air supply amount control signal $AIR_{1HC}$ and a PCC lower combustion air supply amount control signal $AIR_{1LC}$ so that the PCC upper combustion air supply amount $AIR_{1H}$ and the PCC lower combustion air supply amount $AIR_{1L}$ respectively become the target PCC upper combustion air supply amount $AIR_{1H}°$ and the target PCC lower combustion air supply amount $AIR_{1L}°$, and for respectively outputting the obtained signals to first and second valve apparatuses which control the supply amount of combustion air to the primary combustion chamber (112B, 113B).

2. The dried sludge melting furnace apparatus according to claim 1, further comprising:

(m) a temperature correcting device (210) for correcting the detected PCC upper portion temperature $T_{1H}$* in accordance with the detected combustion gas oxygen concentration $CON_{02}$* given from said oxygen concentration detector (132), the detected PCC upper portion temperature $T_{1H}$* given from said first temperature detector (115), the detected dried sludge supply amount D* given from said dried sludge supply amount detector (111D), and the detected total combustion air supply amount $AIR_{TL}$* given from said third combustion air supply amount detector (121E), and for outputting the corrected value as a corrected PCC upper portion temperature $T_{1H}$, and wherein said fuzzy controller ( 220 ) uses the corrected PCC upper portion temperature $T_{1H}$ in place of the detected PCC upper portion temperature $T_{1H}$*.

3. The dried sludge melting furnace apparatus according to claim 1, further comprising:

(m) a third temperature detector (133) for detecting a temperature $T_3$ of slag guided from said SCC, and for outputting the detected temperature as a detected slag temperature $T_3$*, and wherein:

said fuzzy controller (220) further comprises a second fuzzy inference means (222) for executing fuzzy inference to obtain an inferred total combustion air supply amount $AIR_{TL}^f$ and an inferred SCC burner fuel supply amount $F_2^f$ on the basis of second fuzzy rules held among a fuzzy set relating to the combustion gas oxygen concentration $CON_{02}$, a fuzzy set relating to the slag temperature $T_3$, a fuzzy set relating to the total combustion air supply amount $AIR_{TL}$ and a fuzzy set relating to the SCC burner fuel supply amount $F_2$, in accordance with the detected combustion gas oxygen concentration $CON_{02}$* and the detected slag temperature $T_3$*, and for outputting the obtained amounts;

said sequence controller (230) further obtains a target total combustion air supply amount $AIR_{TL}°$ and a target SCC burner fuel supply amount $F_2°$, from the inferred total combustion air supply amount $AIR_{TL}^f$ and inferred SCC burner fuel supply amount $F_2^f$ given from said second inference means (222) of said fuzzy controller (220), the detected total combustion air supply amount $AIR_{TL}$* given from said third combustion air supply amount detector (121E), and the detected SCC burner fuel supply amount $F_2$* given from said fuel supply amount detector (122B), and outputs said obtained values; and said PID controller (240) further obtains a total combustion air supply amount control signal $AIR_{TLC}$ and an SCC burner fuel supply amount control signal $F_{2C}$ so that the total combustion air supply amount $AIR_{TL}$ becomes the target total combustion air supply amount $AIR_{TL}°$ and the SCC burner fuel supply amount $F_2$ becomes the target SCC burner fuel supply amount $F_2°$, and outputs the obtained signals to third and fourth valve apparatuses ($121_F$, 122C).

4. The dried sludge melting furnace apparatus according to claim 3, further comprising:

(n) a temperature correcting device (210) for correcting the detected PCC upper portion temperature $T_{1H}$* and the detected slag temperature $T_3$* in accordance with the detected combustion gas oxygen concentration $CON_{02}$* given from said oxygen concentration detector (132), the detected PCC upper portion temperature $T_{1H}$* given from said first temperature detector (115), the detected slag temperature $T_3$* given from said third temperature detector (133), the detected dried sludge supply amount D* given from said dried sludge supply amount detector (111D), and the detected total combustion air supply amount $AIR_{TL}$* given from said third combustion air supply amount detector (121E), and for outputting the corrected values as a corrected PCC upper portion temperature $T_{1H}$ and a corrected slag temperature $T_3$, and wherein said fuzzy controller (220) uses the corrected PCC upper portion temperature $T_{1H}$ and the corrected slag temperature $T_3$ in place of the detected PCC upper portion temperature $T_{1H}$* and the detected slag temperature $T_3$*, respectively.

5. A dried sludge melting furnace apparatus in which dried sludge and combustion air are supplied to a primary combustion chamber (PCC), and the dried sludge is converted into slag in said PCC and a secondary combustion chamber (SCC) and then separated from the combustion gas in a slag separation chamber, wherein said apparatus comprises:

(a) a temperature detector (133) for detecting a temperature $T_3$ of slag guided from said SCC, and for outputting the detected temperature as a detected slag temperature $T_3$*;

(b) an oxygen concentration detector (132) for detecting the oxygen concentration $CON_{02}$ of the combustion gas, said combustion gas being guided together with slag from said SCC and then separated from the slag, and for outputting the detected value as a detected combustion gas oxygen concentration $CON_{02}$*;

(c) a dried sludge supply amount detector (111D) for detecting a supply amount D of dried sludge to said PCC, and for outputting the detected amount as a detected dried sludge supply amount D*;

(d) a combustion air supply amount detector (121E) for detecting the total amount $AIR_{TL}$ of the combustion air supply amounts $AIR_{1H}$ and $AIR_{1L}$ to said PCC and the combustion air supply amount $AIR_2$ to said SCC, and for outputting the detected amount as a detected total combustion air supply amount $AIR_{TL}$*;

(e) a fuel supply amount detector (122B) for detecting the supply amount $F_2$ of fuel to a burner for said SCC, and for outputting the detected amount as a detected SCC burner fuel supply amount $F_2$*;

(f) a fuzzy controller (220) comprising a fuzzy inference means (222) for executing fuzzy inference to obtain an inferred total combustion air supply amount $AIR_{TL}^f$ and an inferred SCC burner fuel supply amount $F_2^f$ on the basis of fuzzy rules held among a fuzzy set relating to the combustion gas oxygen concentration $CON_{02}$, a fuzzy set relating to the slag temperature $T_3$, a fuzzy set relating to the total combustion air supply amount $AIR_{TL}$ and a fuzzy set relating to the SCC burner fuel supply amount $F_2$, in accordance with the detected combustion gas oxygen concentration $CON_{02}$* and the detected slag temperature $T_3$*, and for outputting the obtained amounts;

(g) a sequence controller (230) for obtaining a target total combustion air supply amount $AIR_{TL}°$ and a target SCC burner fuel supply amount $F_2°$, from the inferred total combustion air supply amount $AIR_{TL}^f$ and inferred SCC burner fuel supply amount $F_2^f$ given from said fuzzy inference means (222) of said fuzzy controller (220), the detected total combustion air supply amount $AIR_{TL}$* given from said combustion air supply amount detector (121E), and the detected SCC burner fuel supply amount $F_2$* given from said fuel supply amount detector (122B), and for outputting said obtained values; and (h) a PID controller (240) for obtaining a total combustion air supply amount control signal $AIR_{TLC}$ and an SCC burner fuel supply amount control signal $F_{2C}$ so that the total combustion air supply amount $AIR_{TL}$ becomes the target total combustion air supply amount $AIR_{TL}°$ and the SCC burner fuel supply amount $F_2$ becomes the target SCC burner fuel supply amount $F_2°$, and for respectively outputting the obtained signals to first and second valve apparatuses which respectively control the total combustion air supply amount and the burner fuel supply amount ($121_F$, 122C).

6. The dried sludge melting furnace apparatus according to claim 5, further comprising:

(i) a temperature correcting device (210) for correcting the detected slag temperature $T_3$* in accordance with the detected combustion gas oxygen concentration $CON_{02}$* given from said oxygen concentration detector (132), the detected slag temperature $T_3$* given from said temperature detector (133), the detected dried sludge supply amount D* given from said dried sludge supply amount detector (111D), and the detected total combustion air supply amount $AIR_{TL}$* given from said combustion air supply amount detector (121E), and for outputting the corrected temperature as a corrected slag temperature $T_3$, and wherein said fuzzy controller (220) uses said corrected slag temperature $T_3$ in place of the detected slag temperature $T_3$*.

* * * * *